US010451094B2

(12) United States Patent
Fukuda et al.

(10) Patent No.: US 10,451,094 B2
(45) Date of Patent: Oct. 22, 2019

(54) HYDRAULIC SYSTEM OF WORK MACHINE

(71) Applicant: Kubota Corporation, Osaka-shi (JP)

(72) Inventors: Yuji Fukuda, Sakai (JP); Kazuyoshi Arii, Sakai (JP); Ryohei Sumiyoshi, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 240 days.

(21) Appl. No.: 15/278,107

(22) Filed: Sep. 28, 2016

(65) Prior Publication Data

US 2017/0089366 A1 Mar. 30, 2017

(30) Foreign Application Priority Data

Sep. 28, 2015 (JP) ..... 2015-190459
Jun. 7, 2016 (JP) ..... 2016-113600

(51) Int. Cl.
*E02F 9/22* (2006.01)
*F15B 21/042* (2019.01)

(52) U.S. Cl.
CPC ..... *F15B 21/042* (2013.01); *F15B 2211/6343* (2013.01)

(58) Field of Classification Search
CPC ..... F15B 21/04; F15B 21/042; F15B 21/045
USPC ..... 60/359, 456
See application file for complete search history.

(56) References Cited

U.S. PATENT DOCUMENTS

2014/0338317 A1* 11/2014 Uemura ..... B66C 23/44 60/329

FOREIGN PATENT DOCUMENTS

| | | |
|---|---|---|
| JP | 61-031244 Y2 | 2/1982 |
| JP | 09-235756 | 9/1997 |
| JP | 2012-137156 | 7/2012 |
| JP | 2013-36274 | 2/2013 |
| JP | 5687970 B2 | 2/2013 |
| JP | 2013-117253 | 6/2013 |

OTHER PUBLICATIONS

Japanese Office Action for corresponding JP Application No. 2015-190459, dated Nov. 28, 2018 (w/ machine translation).
Japanese Office Action for corresponding JP Application No. 2016-113600, dated May 28, 2019 (w/ machine translation).

* cited by examiner

*Primary Examiner* — Michael Leslie
*Assistant Examiner* — Daniel S Collins
(74) *Attorney, Agent, or Firm* — Mori & Ward, LLP

(57) ABSTRACT

A hydraulic system of a work machine includes a first oil path which is connected to a hydraulic pump and though which hydraulic oil is to flow from the hydraulic pump. An operation valve is connected to the first oil path. An operation lever is to control the operation valve to control pressure of the hydraulic oil in accordance with an operation of the operation member. A hydraulic instrument is to be actuated by the hydraulic oil output from the operation valve. A second oil path connects the operation valve and the hydraulic instrument. The hydraulic oil in the second oil path is discharged through a discharge oil path. An actuation valve is provided in the discharge oil path. An actuation valve controller is to control the actuation valve to be opened and closed according to a temperature of hydraulic oil detected by a first sensor.

30 Claims, 22 Drawing Sheets

HYDRAULIC SYSTEM OF WORK MACHINE

CROSS-REFERENCE TO RELATED APPLICATIONS

The present application claims priority under 35 U. S. C. § 119 to Japanese Patent Application No. 2015-190459, filed Sep. 28, 2015 and Japanese Patent Application No. 2016-113600, filed Jun. 7, 2016. The contents of these applications are incorporated herein by reference in their entirety.

BACKGROUND OF THE INVENTION

Field of the Invention

The present invention relates to a hydraulic system of a work machine.

Discussion of the Background

JP 2013-117253 A discloses an example of the conventional technology of performing warm up of a work machine.

A work machine disclosed in JP 2013-117253 A includes a pilot pressure control valve configured to control the pressure of pilot oil discharged from a pump and transferred to a supply target, and a valve body in which the pilot pressure control valve is incorporated. In the disclosure of JP 2013-117253 A, the valve body is provided with a heatup oil path into which the pilot oil discharged from the pump enters. The valve body is heated up by allowing the pilot oil entered into the heatup oil path to flow to a hydraulic oil tank through a relief valve or an aperture.

A work machine disclosed in JP 2013-36274 A includes an engine, a HST pump configured to be driven by the power of the engine, a travel operation device configured to operate the HST pump, a pressure control valve configured to control a travel primary pressure that is the primary pressure of the travel operation device, and a control device configured to control the pressure control valve.

The control device controls the pressure control valve based on a no-load characteristic line employed when no load is applied and a drop characteristic line employed when a load equal to or larger than a predetermined value is applied to the engine, thereby preventing engine stall.

In the conventional work machine, for example, the output of a hydraulic instrument needs to be reduced because of various reasons. For example, in the disclosure of Japanese Patent No. 5687970, when an engine receives a load equal to or larger than a predetermined load, the output of a travel pump as a hydraulic instrument is reduced. Specifically, a work machine disclosed in Japanese Patent No. 5687970 includes an engine, a travel pump driven by the engine, a travel operation lever, an operation valve capable of changing the pressure (pilot pressure) of pilot oil in accordance with an operation on the travel operation lever, and a pressure control valve provided upstream of the operation valve.

SUMMARY

According to one aspect of the present invention, a hydraulic system of a work machine includes a hydraulic pump, a first sensor, a first oil path, an operation valve, an operation lever, a hydraulic instrument, a second oil path, a discharge oil path, an actuation valve, and an actuation valve controller. The hydraulic pump is to discharge hydraulic oil.

The first sensor is to detect temperature of the hydraulic oil. The first oil path is connected to the hydraulic pump. The hydraulic oil is to flow from the hydraulic oil through the first oil path. The operation valve is connected to the first oil path. The operation lever is to control the operation valve to control pressure of the hydraulic oil in accordance with an operation of the operation lever. The hydraulic instrument is to be actuated by the hydraulic oil output from the operation valve. The second oil path connects the operation valve and the hydraulic instrument. The hydraulic oil in the second oil path is discharged through the discharge oil path. The actuation valve is provided in the discharge oil path. The actuation valve controller is to control the actuation valve to be opened and closed according to the temperature of hydraulic oil detected by the first sensor.

According to another aspect of the present invention, a hydraulic system of a work machine includes a hydraulic pump, a first oil path, an operation valve, an operation lever, a hydraulic instrument, a second oil path, an actuation valve, a third oil path, and a check valve. The hydraulic pump is to discharge hydraulic oil. The first oil path is connected to the hydraulic pump. The operation valve is provided in the first oil path. The operation lever is to control the operation valve to control pressure of the hydraulic oil in accordance with an operation of the operation lever. The hydraulic instrument is to be actuated by the hydraulic oil output from the operation valve. The second oil path connects the operation valve and the hydraulic instrument. The actuation valve is provided in the first oil path between the operation valve and the hydraulic pump. The first oil path has a first section between the operation valve and the actuation valve. The third oil path connects the first section and the second oil path. The check valve is provided in the third oil path. The hydraulic oil is configured to flow from the second oil path to the first oil path via the check valve. The hydraulic oil is prevented from flowing from the first oil path to the second oil path via the check valve.

According to further aspect of the present invention, a hydraulic system of a work machine includes an operation lever, a hydraulic pump, a first oil path, a first operation valve, a second operation valve, a hydraulic instrument, and an oil pressure changing circuit. The operation lever is operable in a first direction and a second direction non-parallel to the first direction. The hydraulic pump is to discharge hydraulic oil. The first oil path is connected to the hydraulic pump. The first operation valve is connected to the first oil path. The operation lever is configured to control the first operation valve to control pressure of the hydraulic oil in accordance with an operation of the operation lever in the first direction to output a first pressure of the hydraulic oil. The second operation valve is connected to the first oil path. The operation lever is configured to control the second operation valve to control pressure of the hydraulic oil in accordance with an operation of the operation lever in the second direction to output a second pressure of the hydraulic oil. The hydraulic instrument is to be actuated by the hydraulic oil output from at least one of the first operation valve and the second operation valve. The oil pressure changing circuit is to change pressure of the hydraulic oil acting on the hydraulic instrument from the first operation valve from the first pressure when the operation lever is operated both in the first direction and in the second direction and to change pressure of the hydraulic oil acting on the hydraulic instrument from the second operation valve from the second pressure when the operation lever is operated both in the first direction and in the second direction.

According to further aspect of the present invention, a hydraulic system of a work machine includes a hydraulic pump, a first oil path, a travel device, a first operation device, a second operation device, a first selection valve, and a second selection valve. The hydraulic pump is to discharge hydraulic oil. The first oil path is connected to the hydraulic pump. The travel device is to be actuated by the hydraulic oil. The first operation device is connected to the travel device. The first operation device includes a first operation lever, a first operation valve, and a third operation valve. The first operation lever is operable in a first direction and a third direction opposite to the first direction. The first operation valve is connected to the first oil path. The first operation lever is configured to control the first operation valve to control pressure of the hydraulic oil in accordance with an operation of the first operation lever in the first direction. The third operation valve is connected to the first oil path. The first operation lever is configured to control the third operation valve to control pressure of the hydraulic oil in accordance with an operation of the first operation lever in the third direction. The second operation device is connected to the travel device. The second operation device includes a second operation lever, a fifth operation valve, and a sixth operation valve. The second operation lever is operable in a fifth direction and a sixth direction opposite to the fifth direction. The fifth operation valve is connected to the first oil path. The second operation lever is configured to control the fifth operation valve to control pressure of the hydraulic oil in accordance with an operation of the second operation lever in the fifth direction. The sixth operation valve is connected to the first oil path. The second operation lever is configured to control the sixth operation valve to control pressure of the hydraulic oil in accordance with an operation of the second operation lever in the sixth direction. The first selection valve includes an output port through which one of the hydraulic oil output from the first operation valve and the hydraulic oil output from the fifth operation valve is output. The one has a higher pressure than another of the hydraulic oil output from the first operation valve and the hydraulic oil output from the fifth operation valve has. The second selection valve includes an output port through which one of the hydraulic oil output from the third operation valve and the hydraulic oil output from the sixth operation valve is output. The one has a higher pressure than another of the hydraulic oil output from the third operation valve and the hydraulic oil output from the sixth operation valve has.

According to further aspect of the present invention, a hydraulic system of a work machine includes at least one operation lever, a hydraulic pump, a first oil path, at least one operation valve, at least one hydraulic instrument, a second oil path, and a reducing oil circuit. The hydraulic pump is to discharge hydraulic oil. The hydraulic oil discharged from the hydraulic pump flows through the first oil path. The at least one operation valve is connected to the first oil path. The at least one operation lever is to control the at least one operation valve to control pressure of the hydraulic oil in accordance with an operation of the at least one operation lever. The at least one hydraulic instrument is to be actuated by the hydraulic oil output from the at least one operation valve. The second oil path connects the at least one operation valve and the at least one hydraulic instrument. The reducing oil circuit is connected to the second oil path to reduce pressure of the hydraulic oil in the second oil path.

According to further aspect of the present invention, a hydraulic system of a work machine includes a hydraulic pump, a hydraulic instrument, a fifth oil path, a sixth oil path, and a proportional valve. The hydraulic pump is to discharge hydraulic oil. The hydraulic instrument is to be actuated by the hydraulic oil. The fifth oil path is connected to the hydraulic instrument. The hydraulic oil is discharged though the sixth oil path. The proportional valve includes a primary port, a secondary port connected to the fifth oil path, and a discharge port connected to the sixth oil path.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
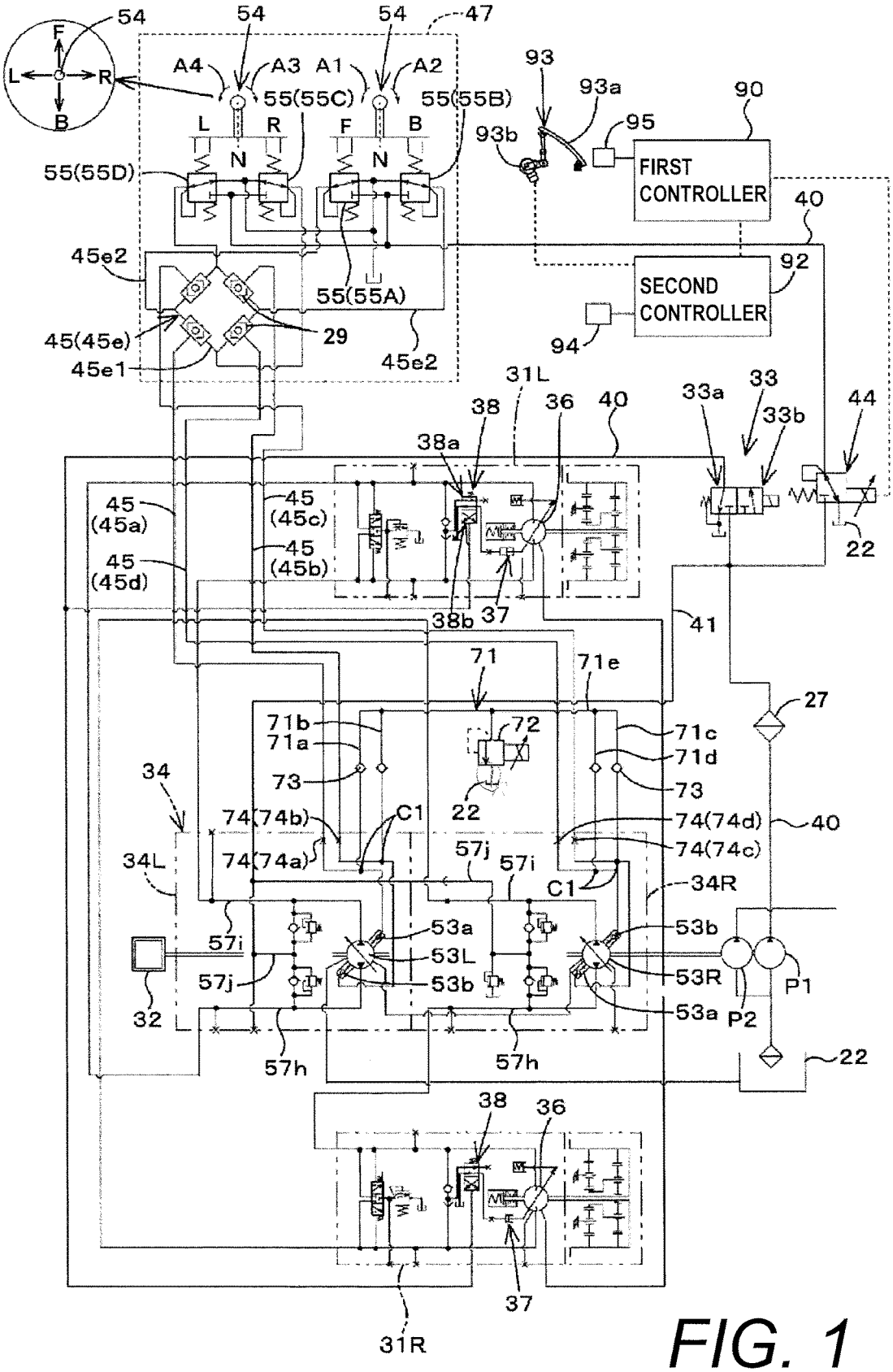
FIG. 1 is a diagram illustrating a hydraulic system (hydraulic circuit) of a traveling system of a work machine according to a first embodiment.

The embodiments will now be described with reference to the accompanying drawings, wherein like reference numerals designate corresponding or identical elements throughout the various drawings.

Embodiments of a hydraulic system of a work machine according to the present invention and the work machine including the hydraulic system will be described below with reference to the drawings as appropriate.

First Embodiment

Figure 10:
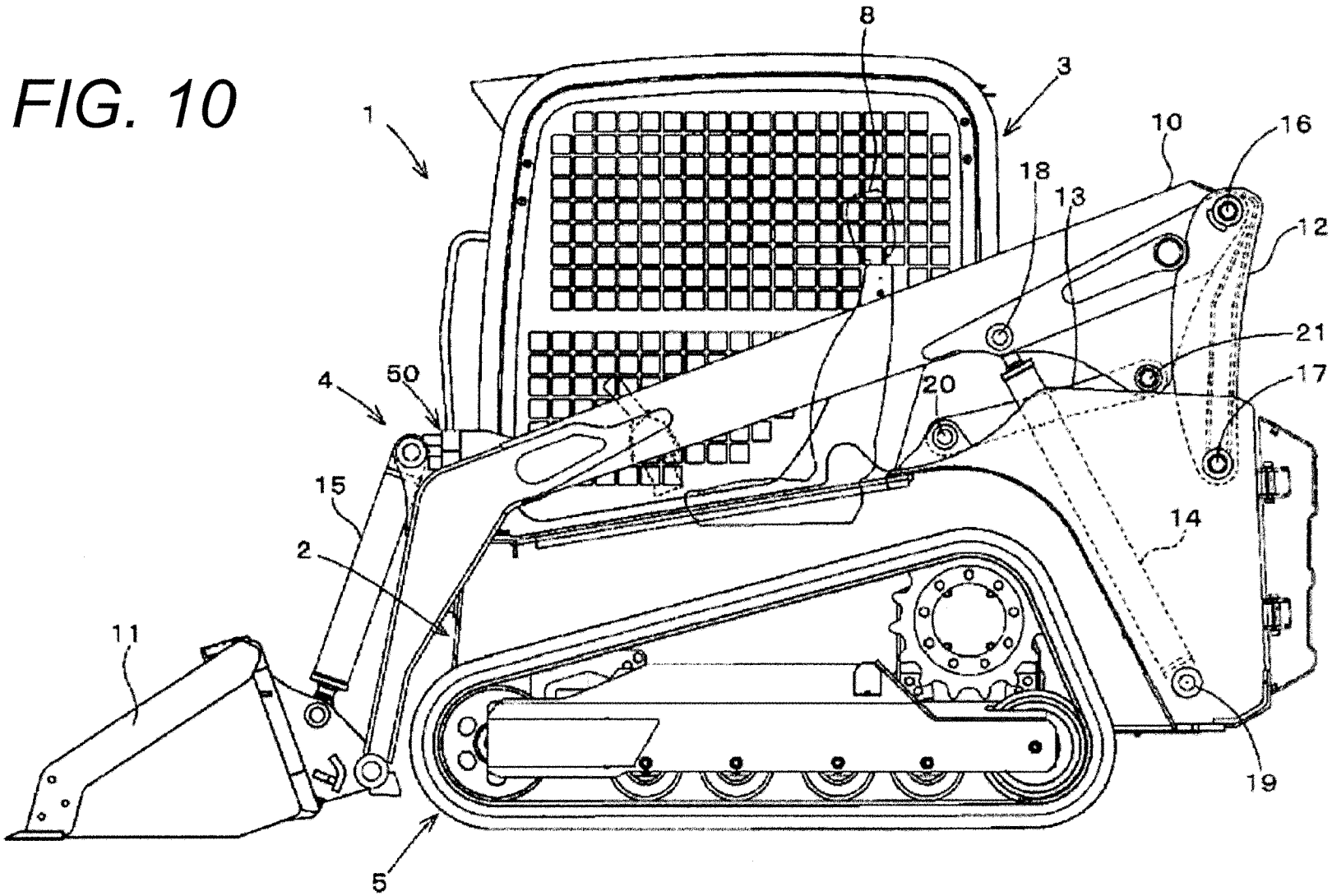
FIG. 10 is a side view illustrating a track loader as an exemplary work machine.

FIG. 10 is a side view of the work machine according to an embodiment of the present invention. FIG. 10 illustrates a compact track loader as an exemplary work machine. However, the work machine according to the embodiment of the present invention is not limited to a compact track loader, but may be, for example, another kind of a loader work machine such as a skid-steer loader. Alternatively, the work machine according to the embodiment of the present invention may be a work machine other than a loader work machine.

Figure 11:
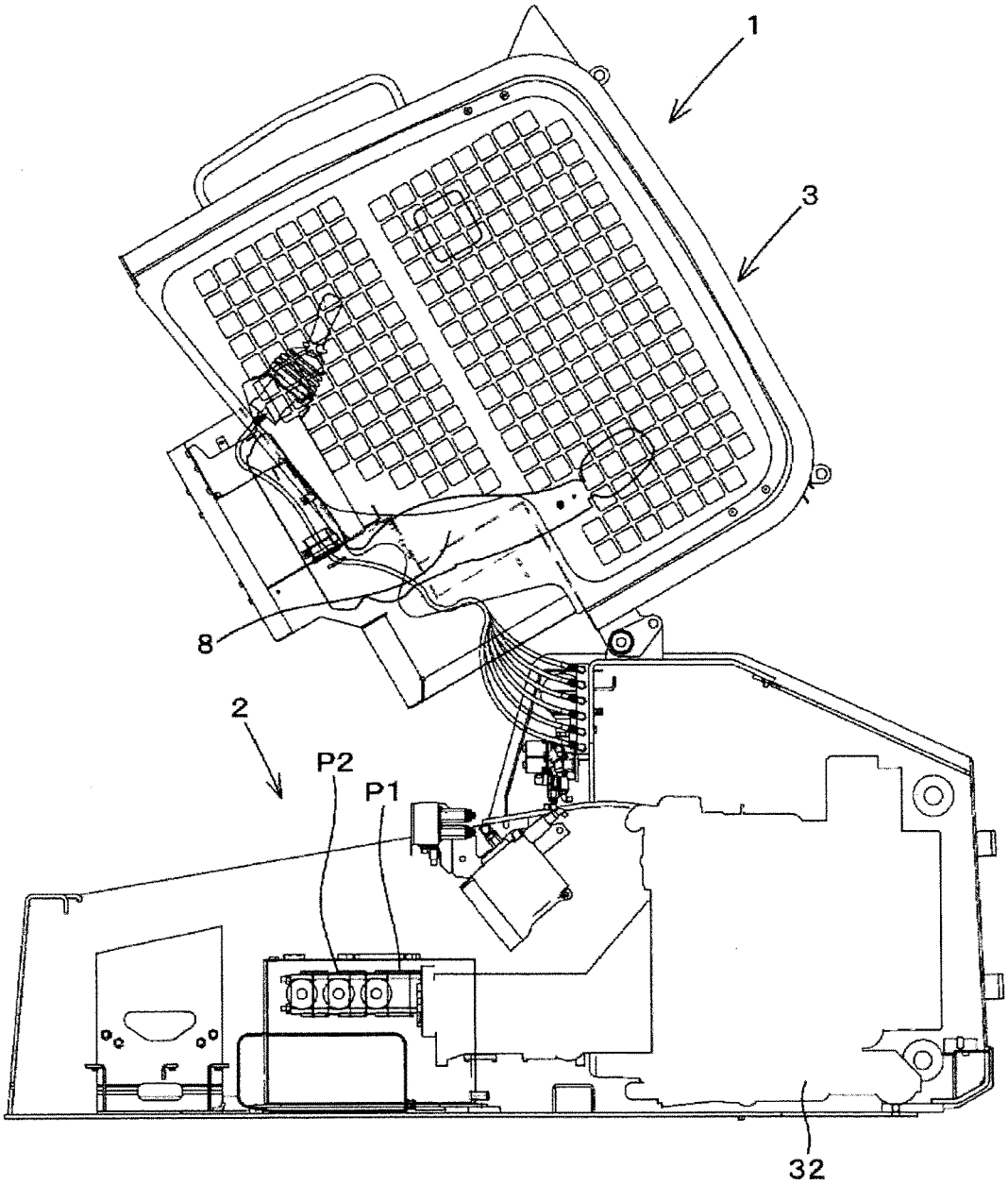
FIG. 11 is a side view illustrating part of the track loader when a cabin is moved up.

As illustrated in FIGS. 10 and 11, a work machine 1 includes a body 2, a cabin 3, a work device 4, and a travel device 5. In the following description of the embodiments of the present invention, a front side is defined to be the front (left side in FIG. 10) of an operator sitting on an operator seat 8 of the work machine 1, a back side is defined to be the back (right side in FIG. 10) of the operator, a left side is defined to be the left (front side in FIG. 10) of the operator, and a right side is defined to be the right (back side in FIG. 10) of the operator. In addition, a body width direction is defined to be a horizontal direction orthogonal to the front-back direction. A body outward direction is defined to be a direction of rightward or leftward from a central part of the body 2. In other words, the body outward direction is a direction departing from the body 2 along the body width direction. A body inward direction is defined to be a direction opposite to the body outward direction. In other words, the body inward direction is a direction toward the body 2 along the body width direction.

The cabin 3 is mounted on the body 2. The cabin 3 is provided with the operator seat 8. The work device 4 is mounted on the body 2. The travel device 5 is provided outside of the body 2. A drive device is mounted on a back part in the body 2.

The work device 4 includes a boom 10, a work tool 11, a lift link 12, a control link 13, a boom cylinder 14, and a bucket cylinder 15.

The booms 10 are provided swingably in the vertical direction on the right side and the left side of the cabin 3. The work tool 11 is, for example, a bucket, and this bucket 11 is swingably provided to a leading end part (front end part) of the boom 10 in the vertical direction. The lift link 12 and the control link 13 support a base part (back part) of the boom 10 so that the boom 10 is swingable in the vertical direction. The boom cylinder 14 moves up and down the boom 10 through expansion and contraction. The bucket cylinder 15 swings the bucket 11 through expansion and contraction.

Front parts of the booms 10 on the left side and the right side are coupled with each other through a curved and forked coupling pipe. Base parts (back parts) of the booms 10 are coupled with each other through a circular coupling pipe.

The lift link 12, the control link 13, and the boom cylinder 14 are provided on the left side and the right side of the body 2 in a manner corresponding to the booms 10 on the left side and the right side.

The lift link 12 is vertically provided to a back part of the base part of each the boom 10. An upper part (one end side) of the lift link 12 is pivoted rotatably about the horizontal axis closer to the back part of the base part of each boom 10 through a pivotal shaft 16 (first pivotal shaft). A lower part (other end side) of the lift link 12 is pivoted rotatably about the horizontal axis closer to the back part of the body 2 through a pivotal shaft 17 (second pivotal shaft). The second pivotal shaft 17 is provided below the first pivotal shaft 16.

An upper part of the boom cylinder 14 is pivoted rotatably about the horizontal axis through a pivotal shaft 18 (third pivotal shaft). The third pivotal shaft 18 is provided to a front part of the base part of each boom 10. A lower part of the boom cylinder 14 is pivoted rotatably about the horizontal axis through a pivotal shaft 19 (fourth pivotal shaft). The fourth pivotal shaft 19 is provided closer to a lower part of the back part of the body 2 and below the third pivotal shaft 18.

The control link 13 is provided on the front side of the lift link 12. One end of the control link 13 is pivoted rotatably about the horizontal axis through a pivotal shaft 20 (fifth pivotal shaft). The fifth pivotal shaft 20 is provided to the body 2 at a position corresponding to the front side of the lift link 12. The other end of the control link 13 is pivoted rotatably about the horizontal axis through a pivotal shaft 21 (sixth pivotal shaft). The sixth pivotal shaft 21 is provided to the boom 10 on the front side of the second pivotal shaft 17 and above the second pivotal shaft 17.

Each boom 10 vertically swings about the first pivotal shaft 16 through expansion and contraction of the boom cylinder 14 while the base part of the boom 10 is supported by the lift link 12 and the control link 13, and the leading end part of the boom 10 moves up and down. The control link 13 vertically swings about the fifth pivotal shaft 20 along with the vertical swing of each boom 10. The lift link 12 swings in the front-back direction about the second pivotal shaft 17 along with the vertical swing of the control link 13.

Instead of the bucket 11, another work tool is attachable to the front part of the boom 10. Examples of the other work tool include attachments (auxiliary attachments) such as a hydraulic crusher, a hydraulic breaker, an angle broom, an earth auger, a pallet folk, a sweeper, a mower, and a snow blower.

A connecting member 50 is provided to the front part of the boom 10 on the left side. The connecting member 50 is a device configured to connect a hydraulic instrument provided to an auxiliary attachment, and a first pipe member such as a pipe provided to the boom 10. Specifically, one end of the connecting member 50 is connectable to the first pipe member, and the other end is connectable to a second pipe member connected with the hydraulic instrument of the auxiliary attachment. With this configuration, hydraulic oil flowing through the first pipe member passes through the second pipe member before being supplied to the hydraulic instrument.

The bucket cylinder 15 is arranged closer to the front part of each boom 10. The bucket 11 is swung through expansion and contraction of the bucket cylinder 15.

The travel devices 5 on the left side and the right side are crawler travel devices (including semi-crawler travel devices) in the present embodiment. The travel devices 5 may be wheeled travel devices provided with front and rear wheels.

The following describes the hydraulic system of the work machine according to an embodiment of the present invention.

As illustrated in FIG. 1, a hydraulic system of a traveling system is configured to drive the travel device 5. The travel device 5 includes a left travel motor device (first travel motor device) 31L, a right travel motor device (second travel motor device) 31R, and a hydraulic device 34. The hydraulic system of the traveling system includes a drive device 32, a direction switching valve 33, and a first hydraulic pump P1.

The drive device 32 is, for example, an electric motor or an engine. In the present embodiment, the drive device 32 is an engine. The first hydraulic pump P1 is a constant-capacity gear pump driven by the power of the drive device 32. The first hydraulic pump P1 is capable of discharging hydraulic oil accumulated in a tank 22. In particular, the first hydraulic pump P1 discharges hydraulic oil mainly used for control. For the purpose of description, the tank 22 that accumulates hydraulic oil is also referred to as a hydraulic oil tank. Hydraulic oil discharged from the first hydraulic pump P1 and used for control is also referred to as pilot oil, and the pressure of the pilot oil is also referred to as pilot pressure.

A discharging oil path 40 is provided on a discharging side of the first hydraulic pump P1 so as to flow hydraulic oil (pilot oil) therethrough. The discharging oil path (first oil path) 40 is provided with a filter 27, direction switching valve 33, the first travel motor device 31L, and the second travel motor device 31R. A charge oil path 41 bifurcated from the discharging oil path 40 is provided between the filter 27 and the direction switching valve 33. The charge oil path 41 is connected to the hydraulic device 34.

The direction switching valve 33 is an electromagnetic valve for changing rotation of the first travel motor device 31L and the second travel motor device 31R, and is a two-position switching valve switchable between a first position 33*a* and a second position 33*b* by excitation. A switching operation of the direction switching valve 33 is performed by, for example, an operation member (not illustrated).

The first travel motor device 31L is a motor for transferring power to a drive shaft of the travel device 5 provided on the left side of the body 2. The second travel motor device 31R is a motor for transferring power to a drive shaft of the travel device 5 provided on the right side of the body 2.

The first travel motor device 31L includes an HST motor (travel motor) 36, a swash plate switching cylinder 37, and a travel control valve (hydraulic switching valve) 38. The HST motor 36 is a swash-plate variable capacitor axial motor capable of changing a vehicle speed (rotation) to the first or second speed. In other words, the HST motor 36 is capable of changing driving force of the work machine 1.

The swash plate switching cylinder 37 is a cylinder for changing the angle of a swash plate of the HST motor 36 through expansion and contraction. The travel control valve 38 is a valve for expansion and contraction of the swash plate switching cylinder 37 toward one end or the other end, and is a two-position switching valve switchable between the first position 38*a* and the second position 38*b*. A switching operation of the travel control valve 38 is performed by the direction switching valve 33 connected with the travel control valve 38 and positioned upstream thereof.

As described above, according to the first travel motor device 31L, when the direction switching valve 33 is switched to the first position 33*a* through an operation of the operation member, the pilot oil is discharged from a section between the direction switching valve 33 and the travel control valve 38, and the travel control valve 38 is switched to the first position 38*a*. As a result, the swash plate switching cylinder 37 is contracted to set the HST motor 36 to the first speed. When the direction switching valve 33 is switched to the second position 33*b* through an operation of the operation member, the pilot oil is supplied to the travel control valve 38 through the direction switching valve 33, and the travel control valve 38 is switched to the second position 38*b*. As a result, the swash plate switching cylinder 37 is expanded to set the HST motor 36 to the second speed.

The second travel motor device 31R is actuated in a similar manner to the first travel motor device 31L. The second travel motor device 31R has the same configuration and actuation as those of the first travel motor device 31L, and thus description thereof will be omitted.

The hydraulic device 34 is configured to drive the first travel motor device 31L and the second travel motor device 31R, and includes a drive circuit (left drive circuit) 34L for drive of the first travel motor device 31L, and a drive circuit (right drive circuit) 34R for drive of the second travel motor device 31R.

The drive circuits 34L and 34R include HST pumps (travel pumps) 53L and 53R, speed-change oil paths 57*h* and 57*i*, respectively, and each include a second charge oil path 57*j*. The speed-change oil paths 57*h* and 57*i* connect the HST pumps 53L and 53R and the HST motor 36. The second charge oil path 57*j* is connected with the speed-change oil paths 57*h* and 57*i* and is an oil path for supplying hydraulic oil from the first hydraulic pump P1 to the speed-change oil paths 57*h* and 57*i*.

The HST pumps 53L and 53R is a swash-plate variable capacitor axial pump driven by the power of the drive device 32. The HST pumps 53L and 53R includes a forward-movement pressure receiving unit 53*a* and a backward-movement pressure receiving unit 53*b* on which the pilot pressure acts. The pilot pressure acting on the pressure receiving units 53*a* and 53*b* changes the angle of the swash plate. Changing the angle of the swash plate can change the outputs (discharge amounts of hydraulic oil) of the HST pumps 53L and 53R and the discharge direction of hydraulic oil.

The change of the outputs of the HST pumps 53L and 53R and the discharge direction of hydraulic oil can be performed by an operation device 47 provided around the operator seat 8. The operation device 47 includes a swingably supported operation member 54 and a plurality of pilot valves (operation valves) 55.

As illustrated in FIG. 1, the operation member 54 is an operation lever supported by the operation valves 55 and configured to swing in the right-left direction (the body width direction) or the front-back direction. Thus, the operation member 54 is operable rightward and leftward with respect to a neutral position N and is operable forward and backward with respect to the neutral position N. In other words, the operation member 54 is capable of swing in at least four directions with respect to the neutral position N. For the purpose of description, a first direction refers to directions toward the front side and the back side, that is, the front-back direction. A second direction refers to directions toward the right side and the left side, that is, the right-left direction (body width direction).

The plurality of operation valves 55 are operated through the common and single operation member 54. The plurality of operation valves 55 are actuated in accordance with swing of the operation member 54. The plurality of operation valves 55 are connected with the discharging oil path 40, and can be supplied with hydraulic oil (the pilot oil) from the first hydraulic pump P1 through the discharging oil path 40.

The plurality of operation valves 55 are an operation valve 55A, an operation valve 55B, an operation valve 55C, and an operation valve 55D.

When the operation lever 54 is swung toward the front side (one side) in the front-back direction (first direction) (when a forward operation is performed), the operation valve 55A changes the pressure of hydraulic oil output in accordance with the operation amount (operation) of the forward operation. When the operation lever 54 is swung toward the back side (the other side) in the front-back direction (first direction) (when a backward operation is performed), the operation valve 55B changes the pressure of hydraulic oil output in accordance with the operation amount (operation) of the backward operation. When the operation lever 54 is swung toward the right side (one side) in the right-left direction (second direction) (when a rightward operation is performed), the operation valve 55C changes the pressure of hydraulic oil output in accordance with the operation amount (operation) of the rightward operation. When the operation lever 54 is swung toward the left side (the other side) in the right-left direction (second direction) (when a leftward operation is performed), the operation valve 55D changes the pressure of hydraulic oil output in accordance with the operation amount (operation) of the leftward operation.

The plurality of operation valves 55 are connected with the hydraulic device 34 (travel pumps 53L and 53R) of the traveling system through a travel oil path (second oil path) 45. In other words, the travel pumps 53L and 53R are hydraulic instruments that can be actuated by hydraulic oil output from the operation valves 55 (operation valve 55A, operation valve 55B, operation valve 55C, and operation valve 55D).

The travel oil path 45 includes a first travel oil path 45*a*, a second travel oil path 45*b*, a third travel oil path 45*c*, a fourth travel oil path 45*d*, and a fifth travel oil path 45*e*. The first travel oil path 45*a* is connected with the forward-movement pressure receiving unit 53*a* of the travel pump 53L. The second travel oil path 45*b* is connected with the backward-movement pressure receiving unit 53*b* of the travel pump 53L. The third travel oil path 45*c* is connected with the forward-movement pressure receiving unit 53*a* of the travel pump 53R. The fourth travel oil path 45*d* is connected with the backward-movement pressure receiving unit 53*b* of the travel pump 53R. The fifth travel oil path 45*e* connects the operation valves 55, the first travel oil path 45*a*, the second travel oil path 45*b*, the third travel oil path 45*c*, and the fourth travel oil path 45*d*. The fifth travel oil path 45*e* includes a bridge part 45*e*1 including a plurality of shuttle valves 29, and a coupling path 45*e*2 connecting a joint part of the bridge part 45*e*1 and the operation valves 55.

When the operation lever 54 is swung toward the front side (the direction of arrow A1 in FIG. 1), the operation valve 55A is operated to output the pilot pressure from the operation valve 55A. The pilot pressure acts on the pressure receiving unit 53*a* of the travel pump 53L through the first travel oil path 45*a* and acts on the pressure receiving unit 53*a* of the travel pump 53R through the third travel oil path 45*c*. Accordingly, an output shaft of the travel motor 36 performs normal rotation (forward rotation) at a speed proportional to the swing amount of the operation lever 54 to make the work machine 1 travel straight toward the front side.

When the operation lever 54 is swung toward the back side (the direction of arrow A2 in FIG. 1), the operation valve 55B is operated to output the pilot pressure from the operation valve 55B. The pilot pressure acts on the pressure receiving unit 53*b* of the travel pump 53L through the second travel oil path 45*b*, and acts on the pressure receiving unit 53*b* of the travel pump 53R through the fourth travel oil path 45*d*. Accordingly, the output shaft of the travel motor 36 performs reverse rotation (backward rotation) at a speed proportional to the swing amount of the operation lever 54 to make the work machine 1 travel straight toward the back side.

When the operation lever 54 is swung toward the right side (the direction of arrow A3 in FIG. 1), the operation valve 55C is operated to output the pilot pressure from the operation valve 55C. The pilot pressure acts on the pressure receiving unit 53*a* of the travel pump 53L through the first travel oil path 45*a* and acts on the pressure receiving unit 53*b* of the travel pump 53R through the fourth travel oil path 45*d*. Accordingly, the output shaft of the travel motor 36 on the left side performs normal rotation and the output shaft of the travel motor 36 on the right side performs reverse rotation to rotate the work machine 1 toward the right side.

When the operation lever 54 is swung toward the left side (the direction of arrow A in FIG. 1), the operation valve 55D is operated to output the pilot pressure from the operation valve 55D. The pilot pressure acts on the pressure receiving unit 53*a* of the travel pump 53R through the third travel oil path 45*c* and acts on the pressure receiving unit 53*b* of the travel pump 53L through the second travel oil path 45*b*. Accordingly, the output shaft of the travel motor 36 on the left side performs reverse rotation and the output shaft of the travel motor 36 on the right side performs normal rotation to rotate the work machine 1 toward the left side.

When the operation lever 54 is swung in a diagonal direction, the rotational directions and rotational speeds of the output shafts of the travel motors 36 on the left and right sides are determined in accordance with a difference between pilot pressures acting on the pressure receiving unit 53*a* and the pressure receiving unit 53*b*, and the work machine 1 rotates rightward or leftward while traveling forward or backward.

In other words, the work machine 1 rotates leftward while traveling forward at a speed corresponding to the swing angle of the operation lever 54 when the operation lever 54 is swung diagonally forward left, the work machine 1 rotates rightward while traveling forward at a speed corresponding to the swing angle of the operation lever 54 when the operation lever 54 is swung diagonally forward right, the work machine 1 rotates leftward while traveling backward at a speed corresponding to the swing angle of the operation lever 54 when the operation lever 54 is swung diagonally backward left, and the work machine 1 rotates rightward while traveling backward at a speed corresponding to the swing angle of the operation lever 54 when the operation lever 54 is swung diagonally backward right.

Figure 2:
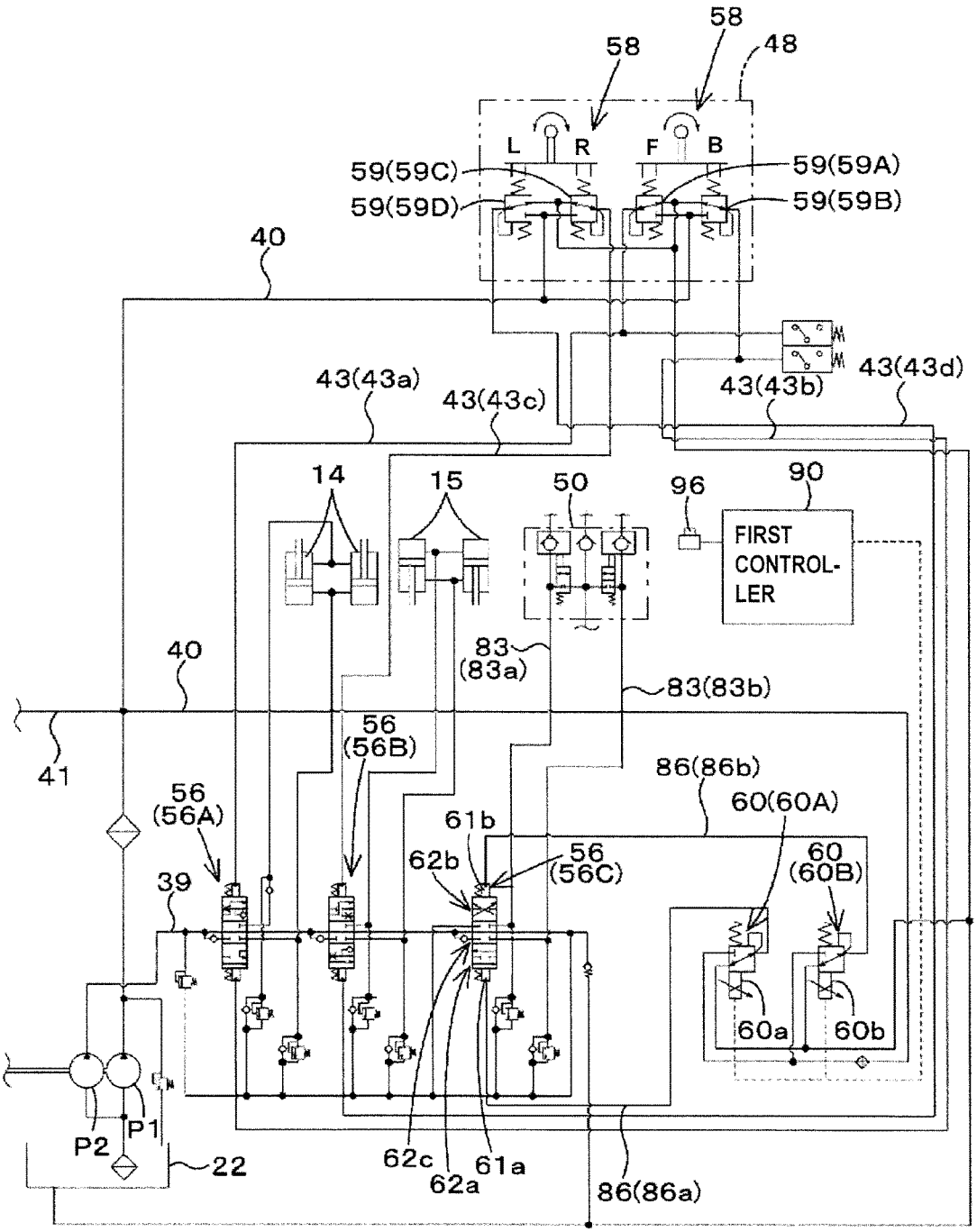
FIG. 2 is a diagram illustrating a hydraulic system (hydraulic circuit) of a work system of the work machine according to the first embodiment.

As illustrated in FIG. 2, a hydraulic system of a work system actuates, for example, the boom 10, the bucket 11, and an auxiliary attachment, and includes a plurality of control valves 56 and a work system hydraulic pump (second hydraulic pump) P2.

The second hydraulic pump P2 is a constant-capacity gear pump installed at a position different from that of the first hydraulic pump P1. The second hydraulic pump P2 is capable of discharging hydraulic oil accumulated in the hydraulic oil tank 22. In particular, the second hydraulic pump P2 discharges hydraulic oil mainly used to actuate a hydraulic actuator.

A main oil path (oil path) 39 is provided on a discharging side of the second hydraulic pump P2. The main oil path 39 is connected with the plurality of control valves 56. Each control valve 56 is capable of switching the flow direction of hydraulic oil in accordance with the pilot pressure of pilot oil.

As illustrated in FIG. 2, the plurality of control valves 56 are a first control valve 56A, a second control valve 56B, a third control valve 56C. The first control valve 56A controls the hydraulic cylinder (boom cylinder) 14 for controlling a boom. The second control valve 56B controls the hydraulic cylinder (bucket cylinder) 15 for controlling a bucket. The third control valve 56C controls an auxiliary hydraulic actuator mounted on an auxiliary attachment such as a hydraulic crusher, a hydraulic breaker, an angle broom, an earth auger, a pallet folk, a sweeper, a mower, or a snow blower.

The first control valve 56A and the second control valve 56B are each a pilot-type directly-operated spool three-position switching valve. The first control valve 56A and the second control valve 56B are each switched, by the pilot pressure, to a neutral position, a first position different from the neutral position, and a second position different from the neutral position and the first position.

The first control valve 56A is connected with the boom cylinder 14 through an oil path, and the second control valve 56B is connected with the bucket cylinder 15 through an oil path.

Operations of the boom 10 and the bucket 11 can be performed by the operation device 48 provided around the operator seat 8. The operation device 48 includes a swingably supported operation member 58 and a plurality of pilot valves (operation valves) 59. The operation member 58 is an operation lever supported by the operation valves 59 and configured to swing the right-left direction (body width direction) or the front-back direction. The plurality of operation valves 59 are actuated in accordance with the swing of the operation member (operation lever) 58. The plurality of operation valves 59 are connected with the discharging oil path 40, and can be supplied with hydraulic oil (the pilot oil) from the first hydraulic pump P1 through the discharging oil path 40.

The plurality of operation valves 59 are the operation valve 59A, the operation valve 59B, the operation valve 59C, and the operation valve 59D.

When the operation lever 58 is swung toward the front side (when a forward operation is performed), the operation valve 59A changes the pressure of hydraulic oil output in accordance with the operation amount (operation) of the forward operation. When the operation lever 58 is swung toward the back side (when a backward operation is performed), the operation valve 59B changes the pressure of hydraulic oil output in accordance with the operation amount (operation) of the backward operation. When the operation lever 58 is swung toward the right side (when a rightward operation is performed), the operation valve 59C changes the pressure of hydraulic oil output in accordance with the operation amount (operation) of the rightward operation. When the operation lever 58 is swung toward the left side (when a leftward operation is performed), the operation valve 59D changes the pressure of hydraulic oil output in accordance with the operation amount (operation) of the leftward operation.

The plurality of operation valves 59 (operation valve 59A, operation valve 59B, operation valve 59C, and operation valve 59D) are connected with a work oil path 43. The work oil path 43 includes a first work oil path 43*a*, a second work oil path 43*b*, a third work oil path 43*c*, and a fourth work oil path 43*d*. The first work oil path 43*a* is connected with the first control valve 56A and the operation valve 59A. The second work oil path 43*b* is connected with the first control valve 56A and the operation valve 59B. The third work oil path 43*c* is connected with the second control valve 56B and the operation valve 59C. The fourth work oil path 43*d* is connected with the second control valve 56B and the operation valve 59D.

When the operation lever 58 is tilted toward the front side, a moving-down pilot valve (operation valve) 59A is operated to set the pilot pressure of pilot oil output from the moving-down operation valve 59A. The pilot pressure acts on a pressure receiving unit of the first control valve 56A to contract the boom cylinder 14, thereby moving down the boom 10.

When the operation lever 58 is tilted toward the back side, the moving-up pilot valve (operation valve) 59B is operated to set the pilot pressure of pilot oil output from the moving-up operation valve 59B. The pilot pressure acts on the pressure receiving unit of the first control valve 56A to expand the boom cylinder 14, thereby moving up the boom 10.

When the operation lever 58 is tilted toward the right side, a bucket-dump pilot valve (operation valve) 59C is operated to set the pilot pressure of pilot oil output from the operation valve 59C. The pilot pressure acts on a pressure receiving unit of the second control valve 56B to expand the bucket cylinder 15, thereby causing the bucket 11 to perform a dumping operation.

When the operation lever 58 is tilted toward the left side, a bucket-scooping pilot valve (operation valve) 59D is operated to set the pilot pressure of pilot oil output from the operation valve 59D. The pilot pressure acts on the pressure receiving unit of the second control valve 56B to contract the bucket cylinder 15, thereby causing the bucket 11 to performed a scooping operation.

The third control valve 56C is a pilot-type directly-operated spool three-position switching valve. The third control valve 56C is switched, by the pilot pressure, to a first position 62*a*, a second position 62*b*, and a third position (neutral position) 62*c*. Accordingly, the third control valve 56C controls the direction, flow rate, and pressure of hydraulic oil flowing toward the auxiliary hydraulic actuator through switching of the first position 62*a*, the second position 62*b*, and the third position 62*c*.

The third control valve 56C is connected with a supplying and discharging oil path 83. One end of the supplying and discharging oil path 83 is connected with a supplying and discharging port of the third control valve 56C, and a middle part of the supplying and discharging oil path 83 is connected with the connecting member 50, the other end part of the supplying and discharging oil path 83 is connected with the auxiliary hydraulic actuator. The supplying and discharging oil path 83 includes the first pipe member and the second pipe member described above.

Specifically, the supplying and discharging oil path 83 includes a first supplying and discharging oil path 83*a* connecting a first supplying and discharging port of the third control valve 56C and a first port of the connecting member 50. The supplying and discharging oil path 83 includes a second supplying and discharging oil path 83*b* connecting a second supplying and discharging port of the third control valve 56C and a second port of the connecting member 50. Thus, the third control valve 56C can be operated to flow hydraulic oil from the third control valve 56C toward the first supplying and discharging oil path 83*a*, and flow hydraulic oil from the third control valve 56C toward the second supplying and discharging oil path 83*b*.

The third control valve 56C is operated through a plurality of proportional valves 60. Each proportional valve 60 is an electromagnetic valve capable of changing the degree of opening by excitation. The plurality of proportional valves 60 are a first proportional valve 60A and a second proportional valve 60B. The first proportional valve 60A and the second proportional valve 60B are connected with the discharging oil path 40. The proportional valves 60 (first proportional valve 60A and second proportional valve 60B) are connected with the third control valve 56C through an oil path 86.

The oil path 86 is an oil path through which pilot oil flows to the third control valve 56C through the proportional valves 60 (first proportional valve 60A and second proportional valve 60B). The oil path 86 is a pipe member such as a steel pipe, a pipe, or a hose. The oil path 86 includes a first control oil path 86*a* connecting the first proportional valve 60A and a pressure receiving unit 61*a* of the third control valve 56C, and a second control oil path 86*b* connecting the second proportional valve 60B and a pressure receiving unit 61*b* of the third control valve 56C.

Thus, when the first proportional valve 60A is opened, pilot oil acts on the pressure receiving unit 61*a* of the third control valve 56C through the first control oil path 86*a*, so that the pilot pressure applied (acted on) to the pressure receiving unit 61*a* is determined in accordance with the degree of opening of the first proportional valve 60A. When the pilot pressure applied to the pressure receiving unit 61*a* becomes equal to or higher than a predetermined value, movement of a spool switches the third control valve 56C from the third position (neutral position) 62*c* to the first position 62*a*. When the second proportional valve 60B is opened, the pilot oil acts on the pressure receiving unit 61*b* of the third control valve 56C through the second control oil path 86*b*, so that the pilot pressure applied (acted on) to the pressure receiving unit 61*b* is determined in accordance with the degree of opening of the second proportional valve 60B. When the pilot pressure applied to the pressure receiving unit 61*b* becomes equal to or higher than a predetermined value, movement of the spool switches the third control valve 56C from the third position (the neutral position) 62*c* to the second position 62*b*.

For example, excitation of the proportional valves 60 (first proportional valve 60A and second proportional valve 60B) is performed by the control device (first control device) 90. A control device 90 is, for example, a CPU. The control device 90 is connected with a switch 96 provided around the operator seat 8. The switch 96 is, for example, a swingable seesaw switch, a slidable slide switch, or a push switch that can be freely pressed. An operation of the switch is input to the control device 90. The first proportional valve 60A or the second proportional valve 60B is opened and closed through an operation of the switch 96. Thus, an auxiliary actuator can be actuated under control of the control device 90.

As illustrated in FIG. 1, the work machine 1 includes a control device 92 configured to control the drive device 32, in addition to the above-described control device 90. For example, when the drive device 32 is an engine, the control device 92 is an engine control device. For the purpose of description, the drive device 32 is assumed to be an engine in the following. Also in the following, a "first control device 90" refers to the control device 90, and a "second control device 92" refers to the control device 92.

The second control device 92 is connected with a command member 93 configured to issue a command to achieve an engine rotation speed (referred to as a target engine rotation speed). The command member 93 includes a pedal unit 93*a* and a sensor 93*b* configured to detect the operation amount of the pedal unit 93*a*. The pedal unit 93*a* is a swingably supported acceleration lever, or a swingably supported acceleration pedal. The operation amount detected by the sensor 93*b* is input to the second control device 92. The operation amount detected by the sensor 93*b* is the target engine rotation speed. The second control device 92 is connected with a sensor (measurement device) 94 configured to detect an engine rotation speed in reality (referred to as an actual engine rotation speed).

The second control device 92 performs typical engine control in which, for example, a control signal indicating a fuel injection amount, an injection timing, and a fuel injection rate is output to an injector. The second control device 92 outputs a signal indicating, for example, a fuel injection pressure, to a supply pump or a common rail. Thus, the second control device 92 controls the injector, the supply pump, and the common rail so that the actual engine rotation speed becomes equal to the target engine rotation speed.

The first control device 90 performs control (anti-stall control) for preventing engine stall in addition to control of, for example, the proportional valve 60. Specifically, the first control device 90 is connected with an actuation valve (second actuation valve) 44 provided to the discharging oil path 40. In the present embodiment, the actuation valve 44 is an electromagnetic proportional valve (proportional valve). The first control device 90 (an actuation valve controller 90) prevents engine stall by changing the degree of opening of the proportional valve 44 based on an engine drop amount that is a difference between the target engine rotation speed and the actual engine rotation speed. The first control device 90 is capable of acquiring the actual engine rotation speed and the target engine rotation speed. The actuation valve 44 may be a switching valve or a narrowing unit (throttle).

Figure 3:
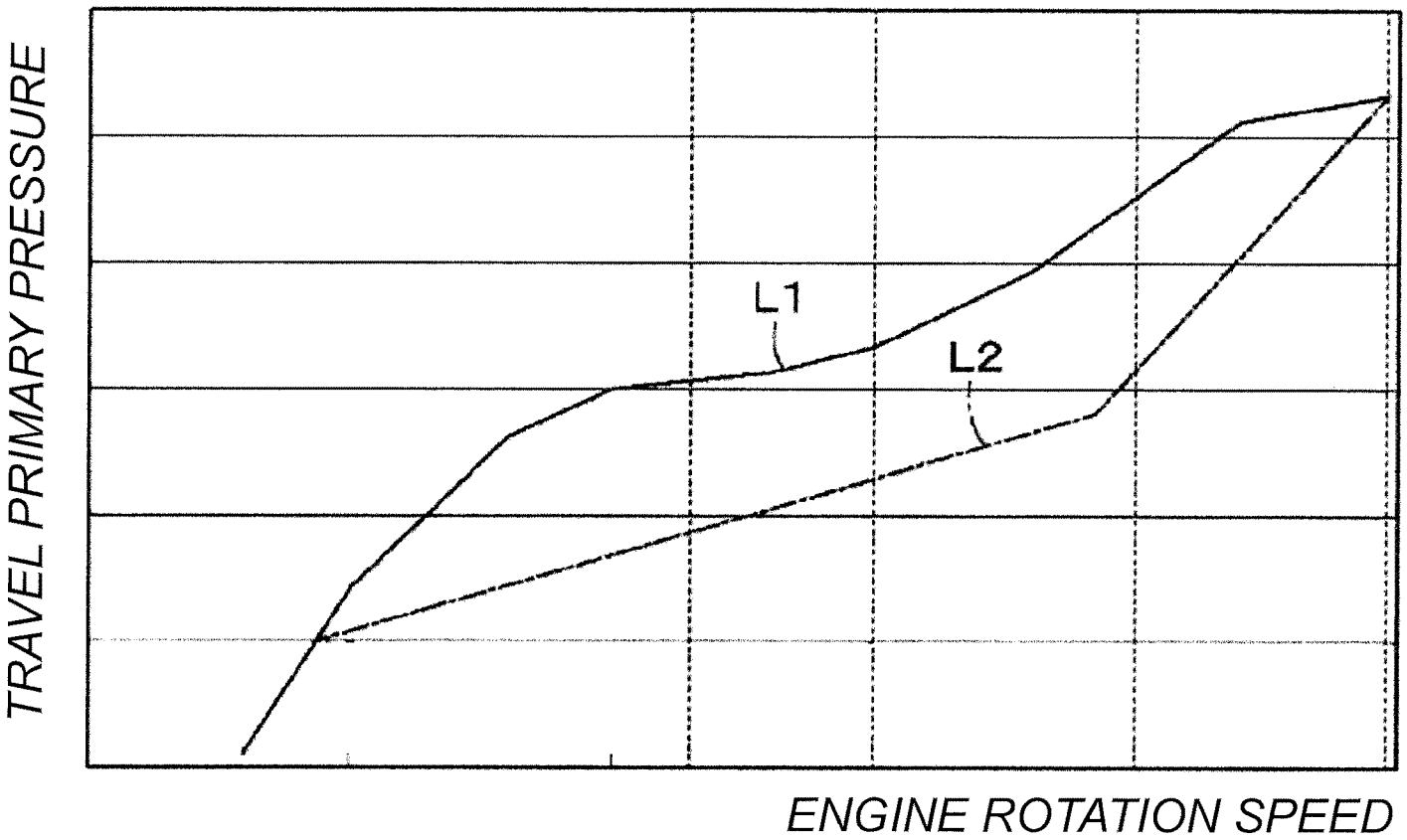
FIG. 3 is a diagram illustrating a relation among an engine rotation speed, travel primary pressure, and a control line.

FIG. 3 illustrates a relation among an engine rotation speed, a travel primary pressure, and control lines L1 and L2.

The travel primary pressure is the pressure (pilot pressure) of hydraulic oil in a section of the discharging oil path (first oil path) 40 from the proportional valve 44 to the operation valves 55 (operation valve 55A, operation valve 55B, operation valve 55C, and operation valve 55D). Thus, the travel primary pressure is the primary pressure of hydraulic oil entering into each operation valve 55 provided to the operation lever 54. The control line L1 illustrates the relation between the engine rotation speed and the travel primary pressure when the drop amount is smaller than a predetermined value. The control line L2 illustrates the relation between the engine rotation speed and the travel primary pressure when the drop amount is equal to or larger than the predetermined value.

When the drop amount is smaller than a predetermined value, the first control device 90 adjusts the degree of opening of the proportional valve 44 so that the relation between the actual engine rotation speed and the travel primary pressure matches with the control line L1. When the drop amount is equal to or larger than the predetermined value, the first control device 90 adjusts the degree of opening of the proportional valve 44 so that the relation between the actual engine rotation speed and the travel primary pressure matches with the control line L2. The travel primary pressure of the control line L2 is lower than the travel primary pressure of the control line L1 at a certain engine rotation speed. Thus, the travel primary pressure of the control line L2 is lower than the travel primary pressure of the control line L1 at an identical engine rotation speed.

Accordingly, the pressure (pilot pressure) of hydraulic oil entering into the operation valve 55 is reduced by control based on the control line L2. As a result, the angle of the swash plate of the HST pump 66 of the HST pump (travel pump) 53 is adjusted to decrease a load on the engine 32, thereby preventing stall of the engine 32. Although FIG. 3 illustrates one control line L2, but a plurality of control lines L2 may be provided. For example, the control line L2 may be set for each engine rotation speed. Control parameters such as data or functions providing the control line L1 and the control line L2 are preferably included in the first control device 90.

The hydraulic system is provided with a circuit capable of reducing (decompressing) the pressure of hydraulic oil in the travel oil path (second oil path) 45. As illustrated in FIG. 1, the travel oil path (second oil path) 45 is connected with a discharge oil path 71.

Specifically, the discharge oil path 71 includes a first discharge oil path 71*a*, a second discharge oil path 71*b*, a third discharge oil path 71*c*, a fourth discharge oil path 71*d*, and a fifth discharge oil path 71*e*.

The first discharge oil path 71*a* is bifurcated from a middle part of the first travel oil path 45*a*. The second discharge oil path 71*b* is bifurcated from a middle part of the second travel oil path 45*b*. The third discharge oil path 71*c* is bifurcated from a middle part of the third travel oil path 45*c*. The fourth discharge oil path 71*d* is bifurcated from a middle part of the fourth travel oil path 45*d*. The fifth discharge oil path 71*e* connects the first discharge oil path 71*a*, the second discharge oil path 71*b*, the third discharge oil path 71*c*, and the fourth discharge oil path 71*d*, and is connected with the hydraulic oil tank 22. An actuation valve (first actuation valve) 72 is connected with a middle part of the fifth discharge oil path 71*e*.

The first discharge oil path 71*a*, the second discharge oil path 71*b*, the third discharge oil path 71*c*, and the fourth discharge oil path 71*d* are each provided with a check valve 73. "C1" refers to a connecting part between the second oil paths 45 (first travel oil path 45*a*, second travel oil path 45*b*, third travel oil path 45*c*, and fourth travel oil path 45*d*), and the discharge oil paths 71 (the first discharge oil path 71*a*, the second discharge oil path 71*b*, the third discharge oil path 71*c*, and the fourth discharge oil path 71*d*). With this notation, the check valve 73 allows hydraulic oil to flow from the connecting part C1 toward the fifth discharge oil paths 71*e* but prevents hydraulic oil from flowing from the fifth discharge oil paths 71*e* toward the connecting part C1.

The travel oil path (second oil path) 45 is provided with a narrowing unit 74 (a throttle 74) for reducing the flow rate of hydraulic oil flowing from the operation valve 55 to the discharge oil paths 71. The narrowing unit 74 includes a first narrowing unit 74*a* (a first throttle 74*a*), a second narrowing unit 74*b* (a second throttle 74*b*), a third narrowing unit 74*c* (a third throttle 74*b*), and a fourth narrowing unit 74*d* (a fourth throttle 74*b*). The first narrowing unit 74*a* is an aperture provided to the first travel oil path 45*a* upstream of (closer to operation valve 55 than) the connecting part C1 connected with the first discharge oil path 71*a*. The second narrowing unit 74*b* is an aperture provided to the second travel oil path 45*b* upstream of the connecting part C1 connected with the second discharge oil path 71*b*. The third narrowing unit 74*c* is an aperture provided to the third travel oil path 45*c* upstream of the connecting part C1 connected with the third discharge oil path 71*c*. The fourth narrowing unit 74*d* is an aperture provided to the fourth travel oil path 45*d* upstream of the connecting part C1 connected with the fourth discharge oil paths 71*d*.

The actuation valve 72 is a variable relief valve in which a set pressure is changeable through excitation of a solenoid. When the set pressure of the variable relief valve 72 is set to be lower than a predetermined pressure (the set pressure is set to be lower than the pressure of hydraulic oil in second oil paths 45), the variable relief valve 72 is actuated (opened). This allows hydraulic oil in the second oil paths 45 (first travel oil path 45*a*, second travel oil path 45*b*, third travel oil path 45*c*, and fourth travel oil path 45*d*) to flow to the fifth discharge oil paths 71*e* before being discharged to the hydraulic oil tank 22 through the variable relief valve 72. When the set pressure of the variable relief valve 72 is set to be large (the set pressure is set to be larger than the pressure of hydraulic oil in second oil paths 45), the variable relief valve 72 is not actuated (is kept closed). Accordingly, hydraulic oil in the second oil paths 45 does not flow to the fifth discharge oil paths 71*e*, so that the travel pumps 53L and 53R can be actuated by the pressure of hydraulic oil in the second oil paths 45.

Change of the set pressure of the variable relief valve 72 is performed by the control device 90. The control device 90 is connected with a detect device (first measurement device, first sensor) 91 configured to detect the temperature of hydraulic oil. The first detect device 91 measures, for example, the temperature of hydraulic oil in the hydraulic oil tank 22 or the temperature of hydraulic oil discharged from the first hydraulic pump P1. For example, the first measurement device 91 is provided to a hose or a pipe connected with an inlet port of the first hydraulic pump P1. Alternatively, the first detect device 91 may be provided to the inlet ports of the first hydraulic pump P1 and the second hydraulic pump P2 before or after bifurcation. Installation of the first detect device 91 is not limited to the above-described places.

When the temperature of hydraulic oil (oil temperature) measured by the first measurement device 91 is equal to or lower than a predetermined temperature, the control device 90 outputs, for example, a control signal to set the set pressure of the variable relief valve 72 to be lower than a predetermined value (set the set pressure to be lower so that a secondary pressure of operation valve 55 is lower than a primary pressure of operation valve 55), thereby opening the variable relief valve 72. For example, when the oil temperature is low temperature equal to or lower than the predetermined temperature, the set pressure of the variable relief valve 72 is set to a minimum value. The low temperature is a temperature range in which hydraulic oil with a viscosity grade (kinetic viscosity) typically used in a work machine has an extremely high viscosity, and in which the pressure of hydraulic oil in an oil path increases. For example, the pressure of hydraulic oil increases at an oil temperature equal to or lower than 0° C., in particular, equal to or lower than −10° C. The degree of opening of the actuation valve 72 (variable relief valve 72) is not limited to the above-described degrees. For example, at high oil temperature, the set pressure of the variable relief valve 72 may be increased so that the variable relief valve 72 does not open (is kept fully closed).

In this manner, when the oil temperature measured by the first measurement device 91 is low temperature, the set pressure of the variable relief valve 72 is set to be low, which facilitates warm up by circulating hydraulic oil on a secondary side (second oil paths 45) of the operation valve 55. When the temperature of hydraulic oil is low temperature, the set pressure of the variable relief valve 72 is set to be low (the pilot pressure is restricted), which allows an operation of the work machine 1 to be delayed to reduce mistake in the operation. A measurement device configured to measure the primary and secondary pressures of the operation valve 55 may be provided to change the set pressure of the variable relief valve 72 so that the primary pressure is higher than the secondary pressure when hydraulic oil has a low temperature.

When the temperature of hydraulic oil (the oil temperature) measured by the first measurement device 91 is not equal to or lower than (low temperature) the predetermined temperature, the control device 90 sets the set pressure of the variable relief valve 72 back to a predetermined set pressure.

The control device 90 may be connected with a second measurement device (second sensor) 95 capable of measuring the temperature of external air. The control device 90 may change the set pressure of the variable relief valve 72 based on the temperature of external air measured by the second measurement device 95. The temperature of external air is, for example, a temperature around the work machine 1 or a temperature around an instrument mounted on the work machine 1. Specifically, the variable relief valve 72 is opened when the temperature of hydraulic oil is equal to or lower than the predetermined temperature (a first temperature threshold) and the temperature of external air measured by the second measurement device 95 is equal to or lower than the predetermined temperature (a second temperature threshold). For example, the set pressure of the variable relief valve 72 is set to be lower when the temperature of external air measured by the second measurement device 95 is low temperature below zero and the oil temperature measured by the first measurement device 91 is low temperature.

The actuation valve 72 is the variable relief valve 72 capable of changing a set pressure in the above-described embodiment, but may be an electromagnetic proportional valve (proportional valve). In this case, the proportional valve 72 is opened when the temperature of hydraulic oil (the oil temperature) measured by the first measurement device 91 is equal to or lower than the predetermined temperature (low temperature), but is closed (fully closed) when the oil temperature is not equal to or lower than the predetermined temperature. When the second measurement device 95 is provided, the proportional valve 72 is opened when the temperature of hydraulic oil is equal to or lower than the predetermined temperature and the temperature of external air measured by the second measurement device 95 is equal to or lower than the predetermined temperature, but is closed otherwise. Similarly to the variable relief valve 72, control of the proportional valve 72 is preferably performed by the control device 90.

Second Embodiment

Figure 4:
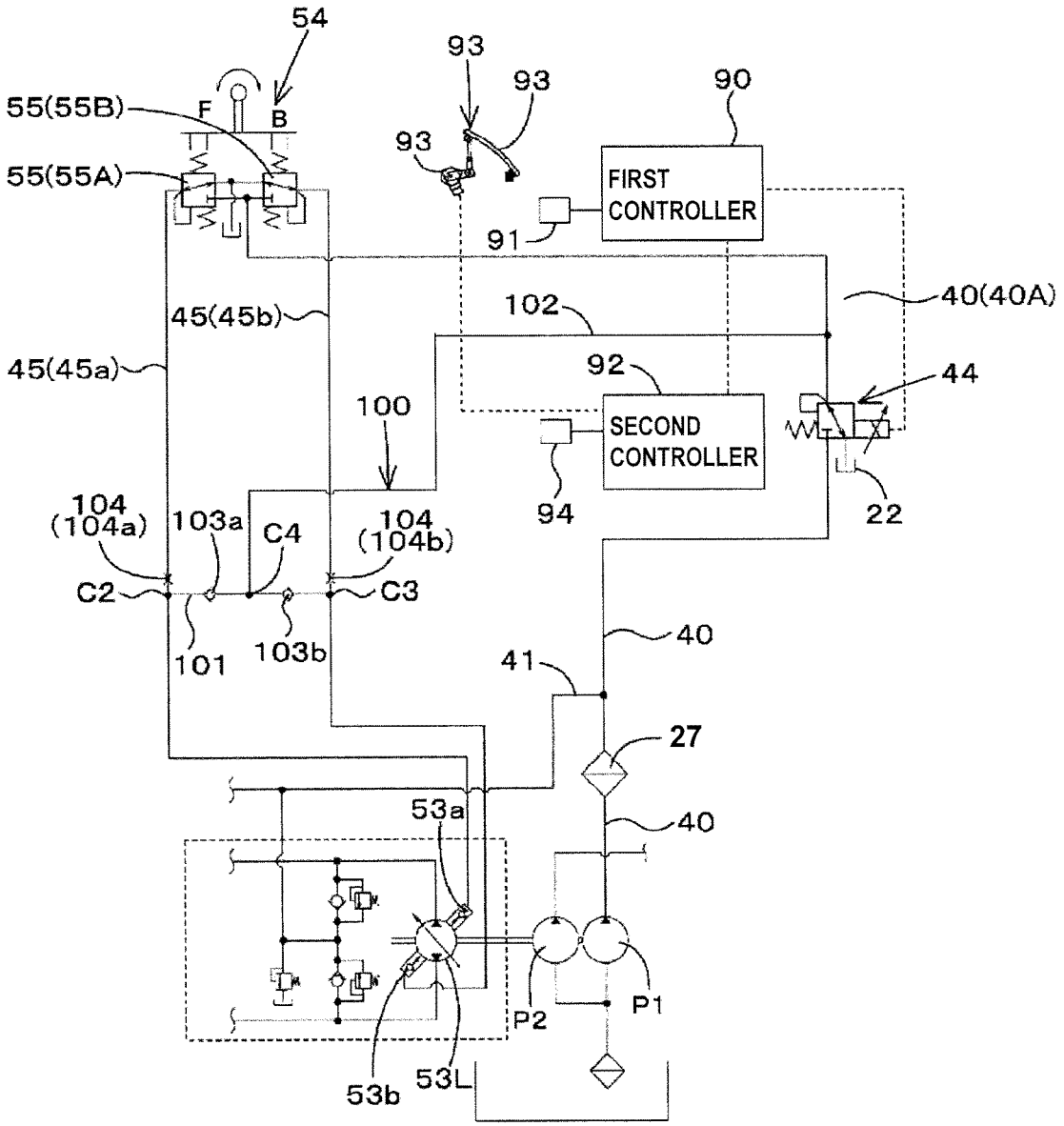
FIG. 4 is a diagram illustrating a hydraulic system (hydraulic circuit) of a traveling system according to a second embodiment.

FIG. 4 illustrates a hydraulic system according to a second embodiment. A hydraulic system of a traveling system described in the second embodiment is applicable to the above-described hydraulic system according to the first embodiment. Description of any configuration same as that of the first embodiment will be omitted.

As illustrated in FIG. 4, the hydraulic system is provided with a third oil path 100 connecting a section 40A of a discharging oil path 40 between a plurality of operation valves 55 and a proportional valve 44, and a second oil paths 45. The third oil path 100 includes a first communicate oil path 101 and a second communicate oil path 102. The first communicate oil path 101 couples a middle part of a first travel oil path 45*a* and a middle part of a second travel oil path 45*b*. The first communicate oil path 101 may couple a middle part of a third travel oil path 45*c*, and a fourth travel oil path 45*d*.

The second communicate oil path 102 connects a middle part of the first communicate oil path 101 and the section 40A of the discharging oil path 40. "C2" refers to a connecting part at which the first travel oil path 45*a* and the first communicate oil path 101 are connected with each other, "C3" refers to a connecting part at which the second travel oil path 45*b* and the first communicate oil path 101 are connected with each other, and "C4" refers to a connecting part at which the first communicate oil path 101 and the second communicate oil path 102 are connected with each other. With this notation, check valves 103*a* and 103*b* are provided in a section of the first communicate oil path 101 between the connecting part C2 and the connecting part C4 and a section of the first communicate oil path 101 between the connecting part C3 and the connecting part C4, respectively. The check valve 103*a* allows hydraulic oil to flow from the first travel oil path 45*a* to the second communicate oil path 102, but prevents hydraulic oil from flowing from the second communicate oil path 102 to the first travel oil path 45*a*. The check valve 103*b* allows hydraulic oil to flow from the second travel oil path 45*b* to the second communicate oil path 102, but prevents hydraulic oil from flowing from the second communicate oil path 102 to the second travel oil path 45*b*. Thus, the check valves 103*a* and 103*b* allow hydraulic oil to flow from the second oil paths 45 to the discharging oil path 40 (section 40A), but prevent hydraulic oil from flowing from the discharging oil path 40 (section 40A) to the second oil paths 45.

The travel oil path (second oil path) 45 is provided with a narrowing unit 104 (a throttle 104) for reducing the flow rate of hydraulic oil flowing from the operation valve 55 to the third oil path 100 (first communicate oil path 101). The narrowing unit 104 includes a first narrowing unit 104*a* (a first throttle 104*a*) and a second narrowing unit 104*b* (a second throttle 104*a*). The first narrowing unit 104*a* is an aperture provided to the first travel oil path 45*a* upstream of (closer to operation valve 55 than) the connecting part C2. The second narrowing unit 104*b* is an aperture provided to the second travel oil path 45*b* upstream of the connecting part C2.

When anti-stall control is performed, the degree of opening of the proportional valve 44 is set in accordance with the drop amount to reduce a secondary pressure of the operation valve 55 (the pressure of hydraulic oil in second oil paths 45). When a path (second oil paths 45) from the operation valve 55 to travel pumps 53L and 53R is long or when the narrowing units are provided to the second oil paths 45, a longer time is required until the secondary pressure of the operation valve 55 (the pressure of hydraulic oil in second oil paths 45) is reduced, potentially causing a response delay.

The hydraulic system of the work machine described above includes the third oil path 100 connecting the section 40A between the operation valve 55 and the proportional valve 44, and the second oil paths 45, and the check valve 103 provided to the third oil path 100. Thus, when the engine rotation speed is largely reduced, in other words, when the drop amount is large, hydraulic oil in the second oil paths 45 can be discharged through the third oil path 100 and the proportional valve 44. This can prevent the above-described response delay. Accordingly, for example, when the engine rotation speed is largely reduced, the pressure of hydraulic oil in the second oil paths 45 can be reduced immediately, thereby preventing engine stall.

When the narrowing unit 104 is provided to the second oil paths 45 between a part connected with the third oil path 100 and the operation valve 55, as described above, the pressure of hydraulic oil in the second oil paths 45 can be reduced immediately, thereby preventing engine stall.

Third Embodiment

Figure 5:
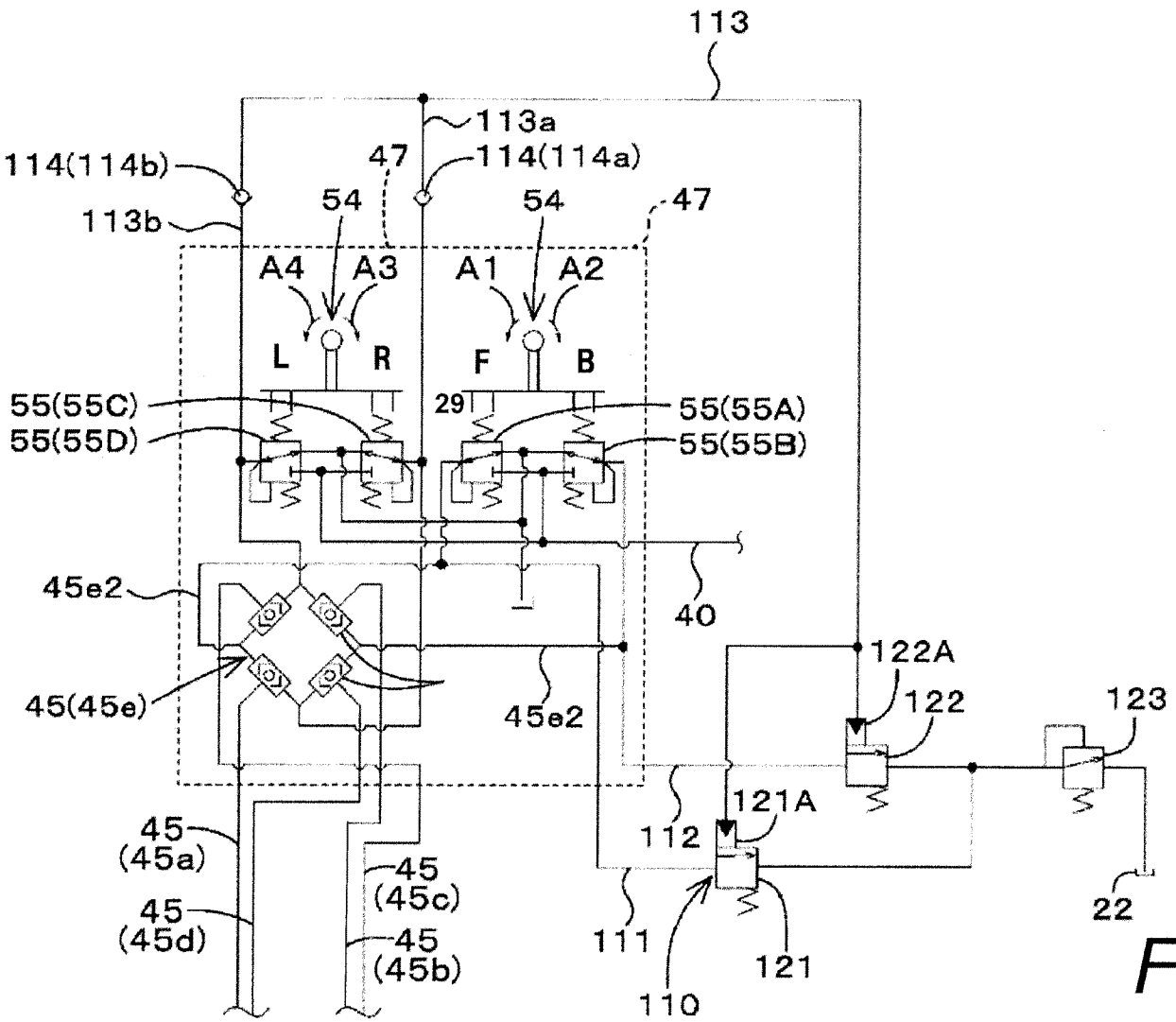
FIG. 5 is a diagram illustrating a hydraulic system (hydraulic circuit) of a traveling system according to a third embodiment.

FIG. 5 illustrates a hydraulic system according to a third embodiment. A hydraulic system of a traveling system described in the third embodiment is applicable to the hydraulic system according to the first embodiment or the second embodiment described above. Description of any configuration same as those of the first and second embodiments will be omitted.

As illustrated in FIG. 5, the hydraulic system includes a pressure changing unit 110 (an oil pressure changing circuit 110). The pressure changing unit 110 changes the pressure of hydraulic oil acting on a hydraulic instrument from a travel operation device 47 when the operation device (travel operation device) 47 is operated in a different operation mode. For example, in the travel operation device 47, the pressure changing unit 110 sets the pressure of hydraulic oil acting on hydraulic instruments such as travel pumps 53L and 53R from an operation valve 55 when an operation member 54 is operated in one direction (for example, toward the front side), and the pressure of hydraulic oil acting on hydraulic instruments such as the travel pumps 53L and 53R from the operation valve 55 when the operation member 54 is operated in the other direction (for example, toward the back side), to be different from each other. In the present embodiment, for the purpose of description, a first operation valve 55A refers to the operation valve 55A, a third operation valve 55B refers to the operation valve 55B, a second operation valve 55C refers to the operation valve 55C, and a fourth operation valve 55D refers to the operation valve 55D.

Specifically, the pressure changing unit 110 includes a first variable relief valve 121 and a second variable relief valve 122. A port (input port) of the first variable relief valve 121 is connected with the first operation valve 55A among the operation valves 55 (first operation valve 55A and third operation valve 55B) configured to be actuated when the operation member 54 is operated in the first direction. A discharge oil path 111 is connected with a coupling path 45*d*2 coupled with an output port of the first operation valve 55A, and is connected with the input port of the first variable relief valve 121.

The second variable relief valve 122 is connected with the third operation valve 55B among the operation valves 55 (first operation valve 55A and third operation valve 55B) configured to be actuated when the operation member 54 is operated in the first direction. A discharge oil path 112 is connected with a coupling path 45*d*2 coupled with an output port of the third operation valve 55B, and is connected with an input port of the second variable relief 122.

The discharge oil path 111 and the discharge oil path 112 are joined to each other downstream of the first variable relief valve 121 and the second variable relief valve 122. A relief valve 123 is provided to a section of the discharge oil path 111 and the discharge oil path 112 after the joining, and the discharge oil path 111 and the discharge oil path 112 downstream of the relief valve 123 are connected with, for example, a hydraulic oil tank 22. A pressure receiving unit 121A of the first variable relief valve 121 is connected with second operation valve 55C and fourth operation valve 55D through a flow path 113. A pressure receiving unit 122A of the second variable relief valve 122 is connected with the second operation valve 55C and the fourth operation valve 55D through the flow path 113. A check valve 114 is provided to a middle part of the flow path 113. The check valve 114 includes a check valve 114*a* provided to a flow path 113*a* of the flow path 113 connected with the operation valve 55D, and a check valve 114*b* provided to a flow path 113*b* of the flow path 113 connected with the operation valve 55D.

For example, when the first operation valve 55A swingable in the first direction (body width direction) is operated in one direction (toward the front side), the second operation valve 55C and the fourth operation valve 55D swingable in the second direction (front-back direction) are operated. In this case, the operation of the second operation valve 55C and the fourth operation valve 55D changes the pressure of hydraulic oil acting on pressure receiving units of the first variable relief valve 121 and the second variable relief valve 122, thereby reducing the set pressures of the first variable relief valve 121 and the second variable relief valve 122. When the set pressures of the first variable relief valve 121 and the second variable relief valve 122 becomes equal to or higher than a predetermined value, the first variable relief valve 121 and the second variable relief valve 122 blow, thereby changing pressure acting on the second oil paths 45 when the first operation valve 55A is operated. Thus, the pressure of hydraulic oil acting on the first travel oil path 45*a* and the third travel oil path 45*c* can be changed by operating the second operation valve 55C and the fourth operation valve 55D while operating the first operation valve 55A, thereby changing the rotation speed of the work machine 1.

When the second operation valve 55C and the fourth operation valve 55D are operated while the third operation valve 55B is operated in the other direction (the back side), pressure acting on the second travel oil path 45*b* and the fourth travel oil path 45*d* when the third operation valve 55B is operated can be changed by changing the set pressures of the first variable relief valve 121 and the second variable relief valve 122. Thus, the rotation speed of the work machine 1 can be changed also when the second operation valve 55C and the fourth operation valve 55D are operated while the third operation valve 55B is operated. In this manner, the pressure of hydraulic oil acting on travel pumps 53L and 53R from the first operation valve 55A when the operation member 54 is operated in one direction (for example, toward the left side), and the pressure of hydraulic oil acting on travel pumps 53L and 53R from the second operation valve 55 when the operation member 54 is operated in the other direction (for example, toward the back side) are set to be different from each other, thereby achieving improved response at rotation in straight travel.

In above-described embodiment, for the purpose of description, the first operation valve is the operation valve 55A, the second operation valve is the operation valve 55B, the third operation valve is the operation valve 55C, the fourth operation valve is the operation valve 55D, the first operation valve is a valve connected with the input port of the first variable relief valve 121, and the second operation valve is a valve connected with the input port of the second variable relief valve 122. However, the first operation valve and the second operation valve are not limited to this configuration in the above-described embodiment, but may be any of the operation valve 55A, the operation valve 55B, the operation valve 55C, and the operation valve 55D, and all combinations thereof are applicable. The input port of the first variable relief valve 121 may be connected with the third operation valve, and the second variable relief valve 122 may be connected with the fourth operation valve. The pressure changing unit 110 may set the pressure of hydraulic oil acting on the hydraulic instrument from the first operation valve or the second operation valve, and the pressure of hydraulic oil acting on the hydraulic instrument from the third operation valve or the fourth operation valve, to be different from each other.

Fourth Embodiment

Figure 6:
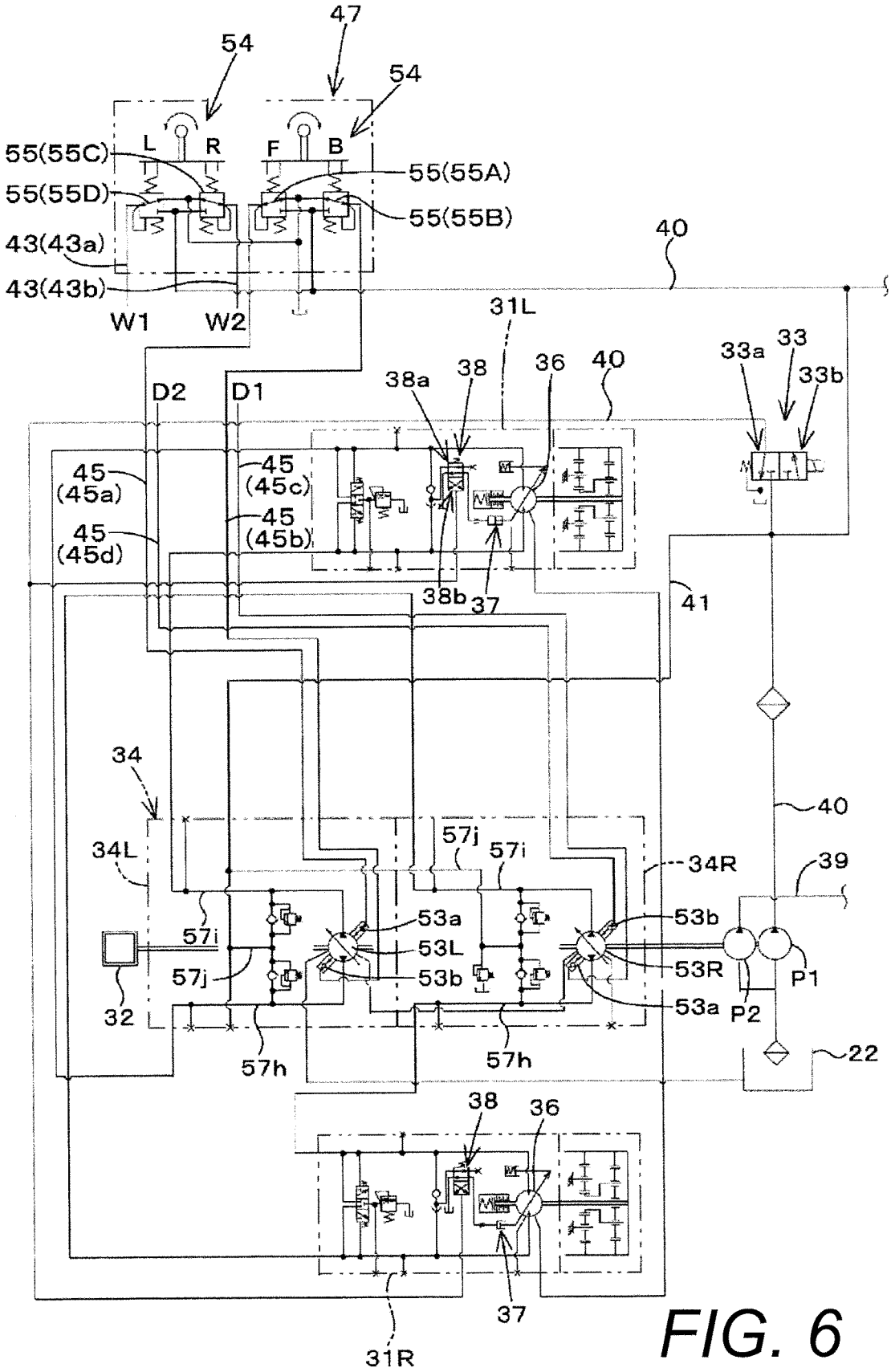
FIG. 6 is a diagram illustrating a hydraulic system (hydraulic circuit) of a traveling system of a work machine according to a fourth embodiment.
Figure 7:
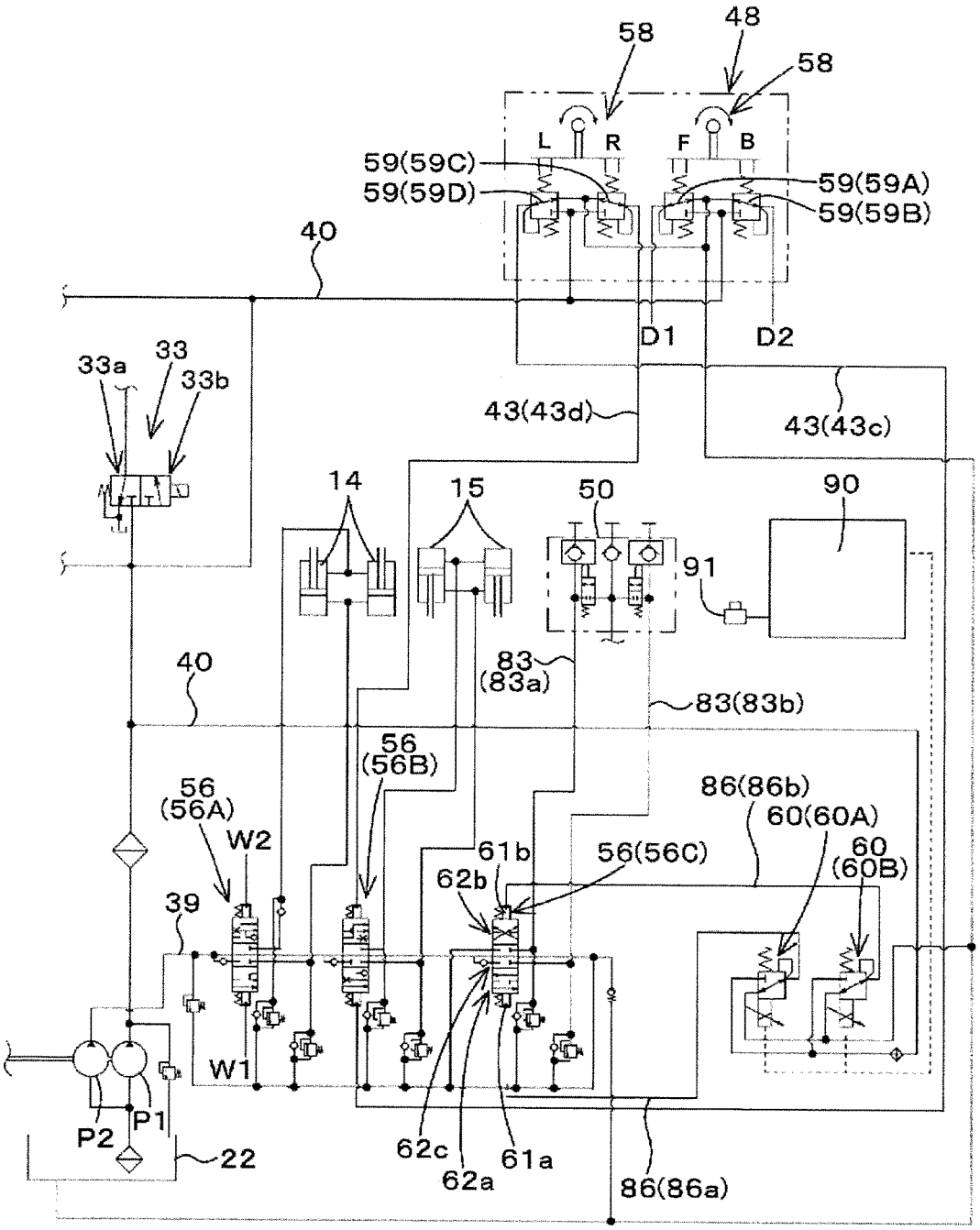
FIG. 7 is a diagram illustrating a hydraulic system (hydraulic circuit) of a work system of the work machine according to the fourth embodiment.

FIGS. 6 and 7 illustrate a hydraulic system according to a fourth embodiment. The hydraulic system described in the fourth embodiment is applicable to the hydraulic system according to the first to third embodiments described above. Description of any configuration same as those of the first to third embodiments will be omitted. In the above-described embodiments, the travel (forward travel, backward travel, leftward travel, and rightward travel) of a work machine 1 is performed through a single operation member 54. In the fourth embodiment, however, the travel of the work machine 1 is performed through a plurality of operation members. For example, the operation member (operation lever) 54 may be arranged on the left side of an operator seat 8, the operation member (operation lever) 58 may be arranged on the right side thereof so that the operation valve 55 is operated through these two operation levers 54 and 58.

As illustrated in FIG. 6, an operation device 47 is provided on the left side of the operator seat 8, and is capable of performing an operation (travel operation) related to the travel of the work machine 1 and an operation (work operation) related to work. As illustrated in FIG. 7, an operation device 48 is provided on the right side of the operator seat 8, and is capable of performing an operation (travel operation) related to the travel of the work machine 1 and an operation (work operation) related to work. Hereinafter, for the purpose of description, the first operation device 47 refers to the operation device 47, and the second operation device 48 refers to the operation device 48. In addition, the first operation member 54 refers to the operation member 54, and the second operation member 58 refers to the operation member 58.

The first operation member 54 is a lever capable of performing a first operation of moving in the front-back direction (first direction) and a second operation of moving in the body width direction (second direction). In the first operation member 54, the first operation is allocated to a travel operation, and the second operation is allocated to a work operation. Thus, the first operation member 54 serves as an operation member (travel operation member) for travel and an operation member (work operation member) for work. The first operation member 54 is not limited to a lever but may be any device capable of independently performing at least the first operation and the second operation.

The plurality of operation valves 55 are provided to a lower part of the first operation member 54. The plurality of operation valves 55 are an operation valve 55A, an operation valve 55B, an operation valve 55C, and an operation valve 55D. The operation valve 55A, the operation valve 55B, the operation valve 55C, and the operation valve 55D are connected with a discharging oil path 40. The operation valve 55A and the operation valve 55B are actuated by the first operation to perform a motion corresponding to a travel operation. The operation valve 55C and the operation valve 55D are actuated by the second operation to perform a motion corresponding to a work operation.

The second operation member 58 is a lever capable of performing a first operation of moving in the front-back direction (first direction) and a second operation of moving in the body width direction (second direction). In the second operation member 58, the first operation is allocated to a travel operation, and the second operation is allocated to a work operation. Thus, the second operation member 58 serves as an operation member (travel operation member) for travel and an operation member (work operation member) for work. The second operation member 58 is not limited to a lever but may be any device capable of independently performing at least the first operation and the second operation.

The plurality of operation valves 59 are provided to a lower part of the second operation member 58. The plurality of operation valves 59 are an operation valve 59A, an operation valve 59B, an operation valve 59C, and an operation valve 59D. The operation valve 59A, the operation valve 59B, the operation valve 59C, and the operation valve 59D are connected with the discharging oil path 40.

The operation valve 59A and the operation valve 59B are actuated by the first operation to perform a motion corresponding to a travel operation. The operation valve 59C and the operation valve 59D are actuated by the second operation to perform a motion corresponding to a work operation.

As described above, among a plurality of operation valves, the operation valve 55A, the operation valve 55B, the operation valve 59A, and the operation valve 59B are actuated in response to a travel operation, and the operation valve 55C, the operation valve 55D, the operation valve 59C, and the operation valve 59D are actuated in response to a work operation. For the purpose of description, the operation valve 55A, the operation valve 55B, the operation valve 59A, and the operation valve 59B are also referred to a travel operation valve collectively. The operation valve 55C, the operation valve 55D, the operation valve 59C, and the operation valve 59D are also referred to as a work operation valve collectively.

The following describes connections between the travel operation valve and the work operation valve with reference to FIGS. 6 and 7. In FIGS. 6 and 7, reference numerals (D1, D2, W1, and W2) indicate connection destinations of oil paths.

The travel operation valve is connected with the travel oil path (second oil path) 45. The travel oil path 45 includes a first travel oil path 45*a*, a second travel oil path 45*b*, a third travel oil path 45*c*, and a fourth travel oil path 45*d*. In the present embodiment, the first travel oil path 45*a* is connected with a forward-movement pressure receiving unit 53*a* of a travel pump 53L and connected with the operation valve 55A. The second travel oil path 45*b* is connected with a backward-movement pressure receiving unit 53*b* of the travel pump 53L and connected with operation valve 55B. The third travel oil path 45*c* is connected with the forward-movement pressure receiving unit 53*a* of a travel pump 53R and connected with the operation valve 59A. The fourth travel oil path 45*d* is connected with the backward-movement pressure receiving unit 53*b* of the travel pump 53R and connected with the operation valve 59B.

When the first operation member 54 is tilted toward the front side, pilot pressure is output from the operation valve 55A. This pilot pressure acts on the forward-movement pressure receiving unit 53*a* of the travel pump 53L. When the second operation member 58 is tilted toward the front side, pilot pressure is output from the operation valve 59A. This pilot pressure acts on the forward-movement pressure receiving unit 53*a* of the travel pump 53R.

When the first operation member 54 is tilted toward the back side, pilot pressure is output from the operation valve 55B. This pilot pressure acts on the backward-movement pressure receiving unit 53*b* of the travel pump 53L. When the second operation member 58 is tilted toward the back side, pilot pressure is output from the operation valve 59B. This pilot pressure acts on the backward-movement pressure receiving unit 53*b* of the travel pump 53R.

Accordingly, when the first operation member 54 and the second operation member 58 are swung toward the front side, a travel motor (HST motor) 36 performs normal rotation at a speed proportional to the swing amounts of the first operation member 54 and the second operation member 58, so that the work machine 1 travels straight toward the front side. When the first operation member 54 and the second operation member 58 are swung toward the back side, the travel motor 36 performs reverse rotation at a speed proportional to the swing amounts of the first operation member 54 and the second operation member 58, so that the work machine 1 travels straight toward the back side.

When one of the first operation member 54 and the second operation member 58 is swung toward the front side and the other is swung toward the back side, the travel motors 36 on the left and right sides rotate in directions different from each other, so that the work machine 1 rotates rightward or leftward.

As described above, the travel operations of forward travel, backward travel, rightward rotation (rightward travel), and leftward rotation (leftward travel) of the work machine 1 can be performed by moving the first operation member 54 in the front-back direction and moving the second operation member 58 in the front-back direction.

The work operation valve is connected with a work oil path 43. The work oil path 43 includes a first work oil path 43*a*, a second work oil path 43*b*, a third work oil path 43*c*, and a fourth work oil path 43*d*. The first work oil path 43*a* is connected with a first control valve 56A and the operation valve 55D. The second work oil path 43*b* is connected with the first control valve 56A and the operation valve 55C. The third work oil path 43*c* is connected with the second control valve 56B and the operation valve 59D. The fourth work oil path 43*d* is connected with the second control valve 56B and the operation valve 59C.

When the first operation member 54 is tilted toward the left side, the pilot pressure of pilot oil output from the operation valve 55D is set. This pilot pressure acts on the first control valve 56A to expand a boom cylinder 14, thereby moving up a boom 10.

When the first operation member 54 is tilted toward the right side, the pilot pressure of pilot oil output from the operation valve 55C is set. This pilot pressure acts on the first control valve 56A to contract the boom cylinder 14, thereby moving down the boom 10.

When the second operation member 58 is tilted toward the left side, the pilot pressure of pilot oil output from the operation valve 59D is set. This pilot pressure acts on the control valve 56B to contract a bucket cylinder 15, thereby causing a bucket 11 to perform a scooping operation.

When the second operation member 58 is tilted toward the right side, the pilot pressure of pilot oil output from the operation valve 59C is set. This pilot pressure acts on the second control valve 56B to expand the bucket cylinder 15, thereby causing the bucket 11 to perform a dumping operation.

As described above, the work operations of the moving up and down of the boom 10 and the dumping operation and scooping operation of the bucket can be performed by moving the first operation member 54 in the right-left direction and moving the second operation member 58 in the right-left direction.

In the hydraulic system according to the fourth embodiment, when the travel operation valve (operation valve 55A, operation valve 55B, operation valve 59A, and operation valve 59B) is actuated, a braking state of a travel device 5 can be canceled. Hereinafter, for the purpose of description, the first operation valve 55A refers to the operation valve 55A, the third operation valve 55B refers to the operation valve 55B, the fifth operation valve 59A refers to the operation valve 59A, and the sixth operation valve 59B refers to the operation valve 59B. Braking of the travel device 5 will be described.

Figure 8A:
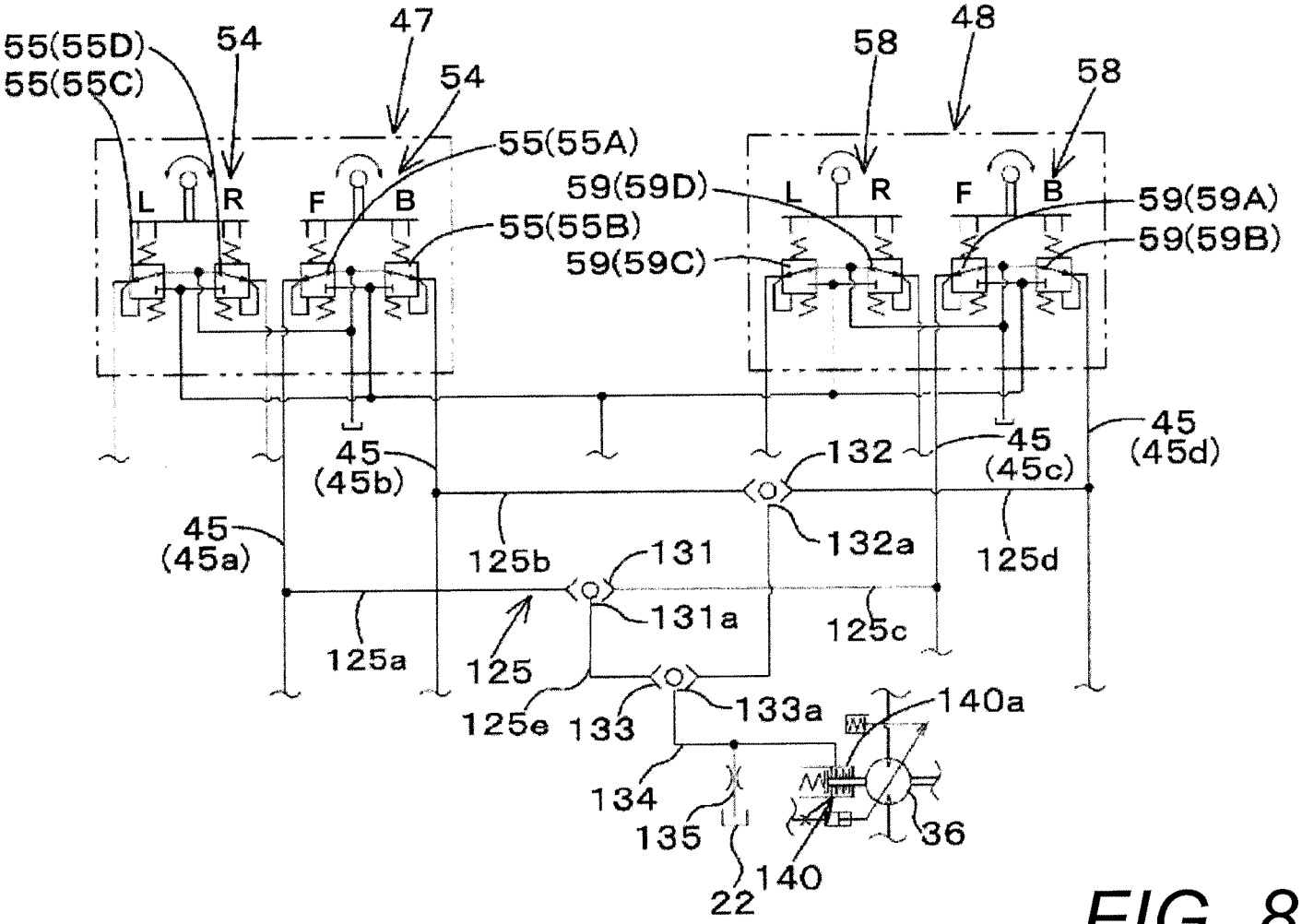
FIG. 8A is a diagram illustrating a relation among an operation device, a travel oil path, a selection valve, and a braking device.
Figure 8B:
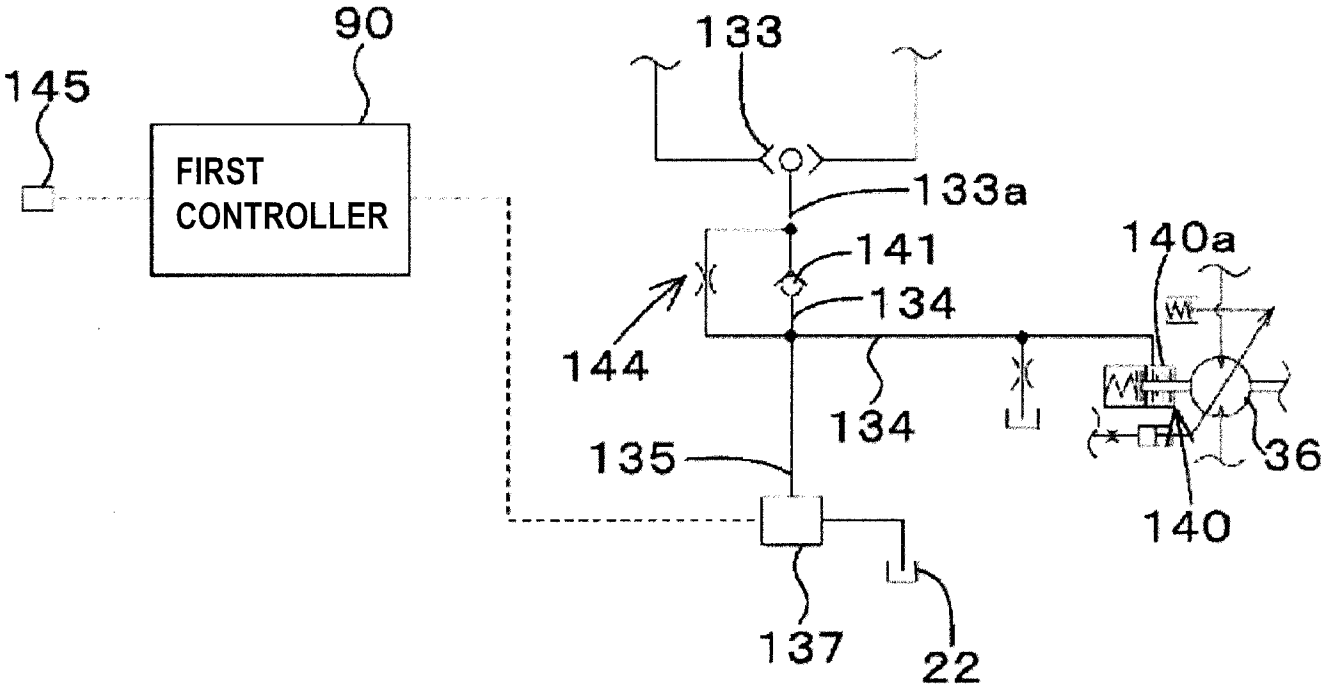
FIG. 8B is a diagram illustrating a first modification of the relation among the operation device, the travel oil path, the selection valve, and the braking device.

FIGS. 8A and 8B are diagram of a relation among, for example, an operation device, a travel oil path, a braking device.

As illustrated in FIG. 8A, a bifurcated oil path 125 is connected with a travel oil path (second oil path) 45.

Specifically, the bifurcated oil path 125 includes a first bifurcated oil path 125*a*, a second bifurcated oil path 125*b*, a third bifurcated oil path 125*c*, a fourth bifurcated oil path 125*d*, and a fifth bifurcated oil path 125*e*.

The first bifurcated oil path 125*a* is bifurcated from a middle part of the first travel oil path 45*a*. The second bifurcated oil path 125*b* is bifurcated from a middle part of the second travel oil path 45*b*. The third bifurcated oil path 125*c* is bifurcated from a middle part of the third travel oil path 45*c*. The fourth bifurcated oil path 125*d* is bifurcated from a middle part of the fourth travel oil path 45*d*.

The first bifurcated oil path 125*a* and the third bifurcated oil path 125*c* are connected with a first selection valve 131. The second bifurcated oil path 125*b* and the fourth bifurcated oil path 125*d* are connected with the second selection valve 132. The first selection valve 131 and a second selection valve 132 is connected with the fifth bifurcated oil path 125*e* to which a third selection valve 133 is provided.

The first selection valve (shuttle valve) 131 includes an output port 131*a* configured to output one of hydraulic oil in the first bifurcated oil path 125*a* (hydraulic oil output from first operation valve 55A) and hydraulic oil in the third bifurcated oil path 125*c* (hydraulic oil output from fifth operation valve 59A), having a higher pressure.

The second selection valve (shuttle valve) 132 includes an output port 132*a* configured to output one of hydraulic oil in the second bifurcated oil path 125*b* (hydraulic oil output from third operation valve 55B) and hydraulic oil in the fourth bifurcated oil path 125*d* (hydraulic oil output from sixth operation valve 59B), having a higher pressure.

The third selection valve (shuttle valve) 133 includes an output port 133*a* configured to output one of hydraulic oil output from the output port 131*a* of the first selection valve 131 and hydraulic oil output from the output port 132*a* of the second selection valve 132, having a higher pressure. The output port 133*a* of the third selection valve (shuttle valve) 133 is connected with a fourth oil path 134. The fourth oil path 134 is connected with a braking device 140. A fifth oil path 135 is connected with a middle part of the fourth oil path 134. The fifth oil path 135 is a discharge oil path through which hydraulic oil can be discharged.

The braking device 140 is configured to perform braking of the travel device 5 or braking cancellation thereof. Specifically, the braking device 140 includes a first disk provided to the output shaft of the travel motor 36, a movable second disk, and a spring configured to bias such that the second disk becomes in contact with the first disk. The braking device 140 includes a housing unit (housing case) 140*a* that houses the first disk, the second disk, and the spring. Part of the housing unit 140*a* where the second disk is housed is connected with the fourth oil path 134. When pilot oil is supplied to a storage part of the housing unit 140*a* to achieve a predetermined pressure inside the storage part, the second disk is moved in a direction opposite to a direction corresponding to braking (opposite to the biasing direction by the spring), thereby canceling braking by the braking device 140. When the pressure of the pilot oil in the storage part of the housing unit 140*a* becomes equal to or lower than the predetermined pressure, the second disk is moved in such a direction that the second disk become in contact with the first disk, thereby performing braking of the travel motor 36.

Thus, when any one of the travel operation valves of the first operation valve 55A, the third operation valve 55B, the fifth operation valve 59A, and the sixth operation valve 59B is operated, the pressure of hydraulic oil output from the operation valve thus operated acts on the fourth oil path 134 through the first selection valve 131 and the second selection valve 132. Accordingly, when any one of the travel operations (forward travel, backward travel, and rotation) is performed, the braking by the braking device 140 can be canceled by operating the first operation member 54 or the second operation member 58.

As illustrated in FIG. 8B, a check valve (first check valve) 141 may be provided to the fourth oil path 134. The first check valve 141 allows hydraulic oil to flow from the third selection valve 133 to the braking device 140 but prevents hydraulic oil from flowing from the braking device 140 to the third selection valve 133. A switching valve 137 may be provided to the fifth oil path 135. The switching valve 137 is capable of discharging hydraulic oil in the fifth oil path 135 by switching, and is a two-position switching valve switchable between a first position and a second position. The switching of the switching valve 137 is preferably performed by a switch (parking switch) 145 connected with, for example, a control device 90. The parking switch 145 is a switch that can be turned on and off. When the parking switch 145 is turned on, the control device 90 holds the switching valve 137 at the first position through demagnetization of a solenoid of the switching valve 137, and discharges hydraulic oil in the fifth oil path 135 to, for example, the hydraulic oil tank 22 through the switching valve 137. When the parking switch 145 is turned off, the control device 90 holds the switching valve 137 at the second position through excitation of the solenoid of the switching valve 137, and does not discharge hydraulic oil in the fifth oil path 135 to, for example, the hydraulic oil tank 22. Thus, when the switching valve 137 is switched to the first position, hydraulic oil in the fifth oil path 135 and the fourth oil path 134 are discharged to, for example, the hydraulic oil tank 22, thereby achieving braking by the braking device 140. When the switching valve 137 is switched to the second position, hydraulic oil in the fifth oil path 135 and the fourth oil path 134 are not discharged to, for example, the hydraulic oil tank 22, thereby achieving cancellation of braking by the braking device 140. The fourth oil path 134 and the fifth oil path 135 may be provided with a bypass oil path 144 including a narrowing unit 143 (a throttle 143) for reducing the flow rate of hydraulic oil.

Figure 8C:
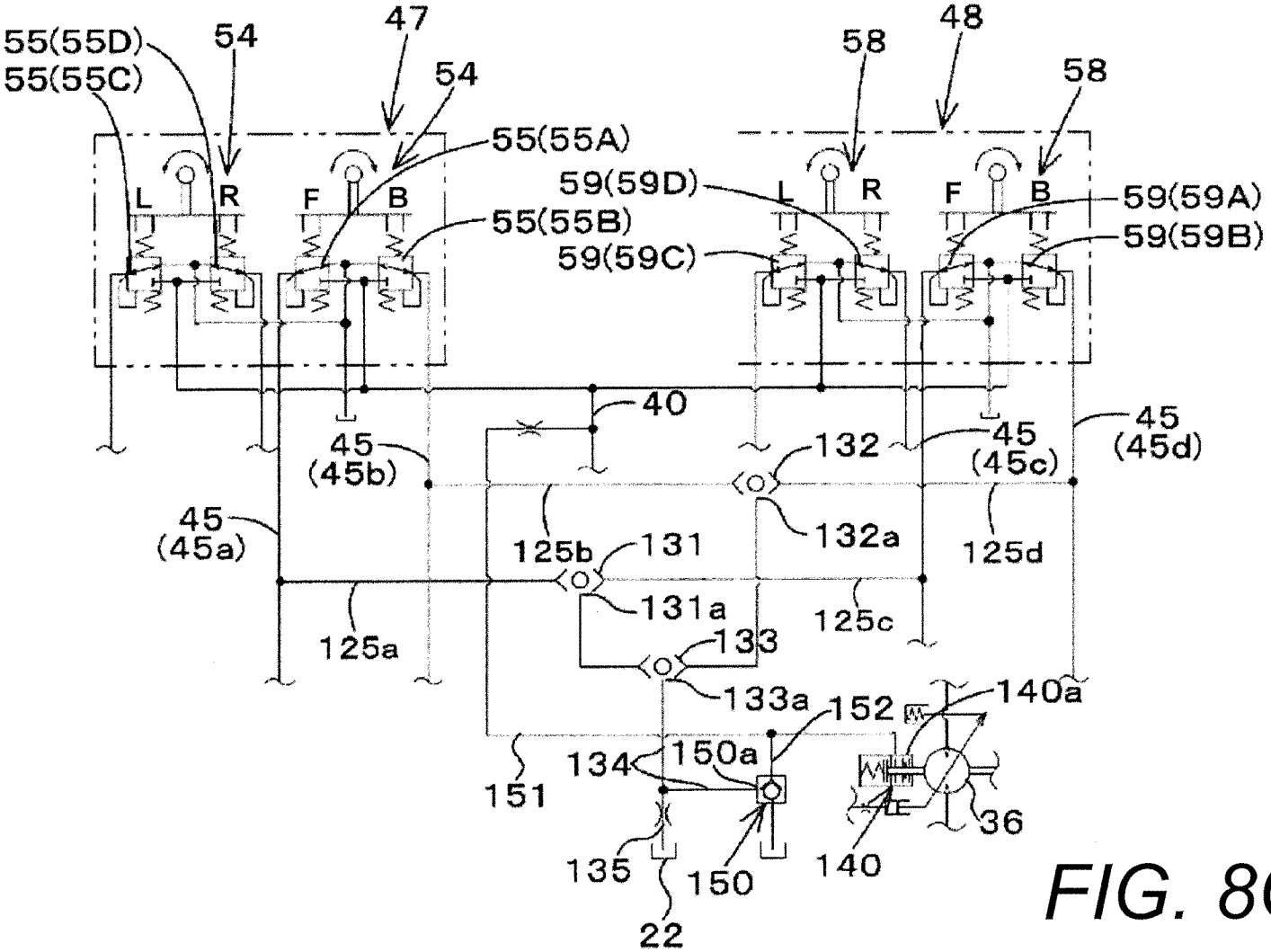
FIG. 8C is a diagram illustrating a second modification of the relation among the operation device, the travel oil path, the selection valve, and the braking device.

As illustrated in FIG. 8C, a pilot check valve 150 may be provided to the fourth oil path 134 to cancel braking by the braking device 140. Specifically, the discharging oil path 40 is provided with a bifurcated oil path 151 bifurcated from the discharging oil path 40. The bifurcated oil path 151 is connected with the braking device 140. A discharge oil path 152 is connected with a middle part of the bifurcated oil path 151 and provided with the pilot check valve 150. The fourth oil path 134 is connected with a pressure receiving unit 150*a* of the pilot check valve 150.

In the hydraulic system illustrated in FIG. 8C, when any one of the travel operations (forward travel, backward travel, and rotation) is performed, in other words, when the first operation member 54 or the second operation member 58 is operated, the pressure of hydraulic oil in the fourth oil path 134 increases and acts on the pressure receiving unit 150*a* of the pilot check valve 150. When the pressure of hydraulic oil acts on the pressure receiving unit 150*a* of the pilot check valve 150, the pilot check valve 150 is closed. This allows the pressure of hydraulic oil in the bifurcated oil path 151 to act on the braking device 140, thereby canceling braking by the braking device 140. When no travel operation is performed, the pressure of hydraulic oil in the fourth oil path 134 is reduced and pilot check valve 150 is opened. When pilot check valve 150 is opened, the pressure of hydraulic oil in the bifurcated oil path 151 is reduced, thereby achieving braking by the braking device 140.

The hydraulic system of the work machine described above includes the first selection valve 131, the second selection valve 132, the third selection valve 133, the fourth oil path 134, and the braking device 140 connected with the fourth oil path 134. Thus, in a work machine in which the travel device 5 is actuated by operating the operation member 54 arranged on the left side of the operator seat 8 and the operation member 58 arranged on the right side of the operator seat 8, braking of the travel device 5 by the braking device 140 can be canceled through the operations of the operation members 54 and 58. For example, the pressure of hydraulic oil is allowed to act on the braking device 140 by operating any one of the operation members 54 and 58, and thus the braking cancellation can be easily performed. Braking of the travel device 5 by the braking device 140 can be easily performed by setting the operation members 54 and 58 to the neutral position.

In the above-described embodiments, control (HST control) of an HST pump (travel pump) 66 and the travel motor 36 is performed by using hydraulic oil (pilot oil), but an embodiment of the present invention is not limited thereto, and the control may be performed, for example, electrically. Specifically, in the HST control, control of the travel pump or a swash plate of, for example, a travel motor may be performed by using, for example, an electromagnetic proportional valve, or may be performed by other methods. In the above-described embodiments, a discharge oil path through which hydraulic oil is discharged is connected with the hydraulic oil tank 22, but the connection destination is not limited but may be an inlet port of a hydraulic pump or other parts. The first hydraulic pump P1 and the second hydraulic pump P2 may be swash-plate variable capacitor pumps or other pumps. The operation valves 55 and 59 illustrated in FIG. 8 may be each a proportional valve including a potentiometer configured to electrically detect the operation amounts of the operation members 54 and 58.

Figure 9A:
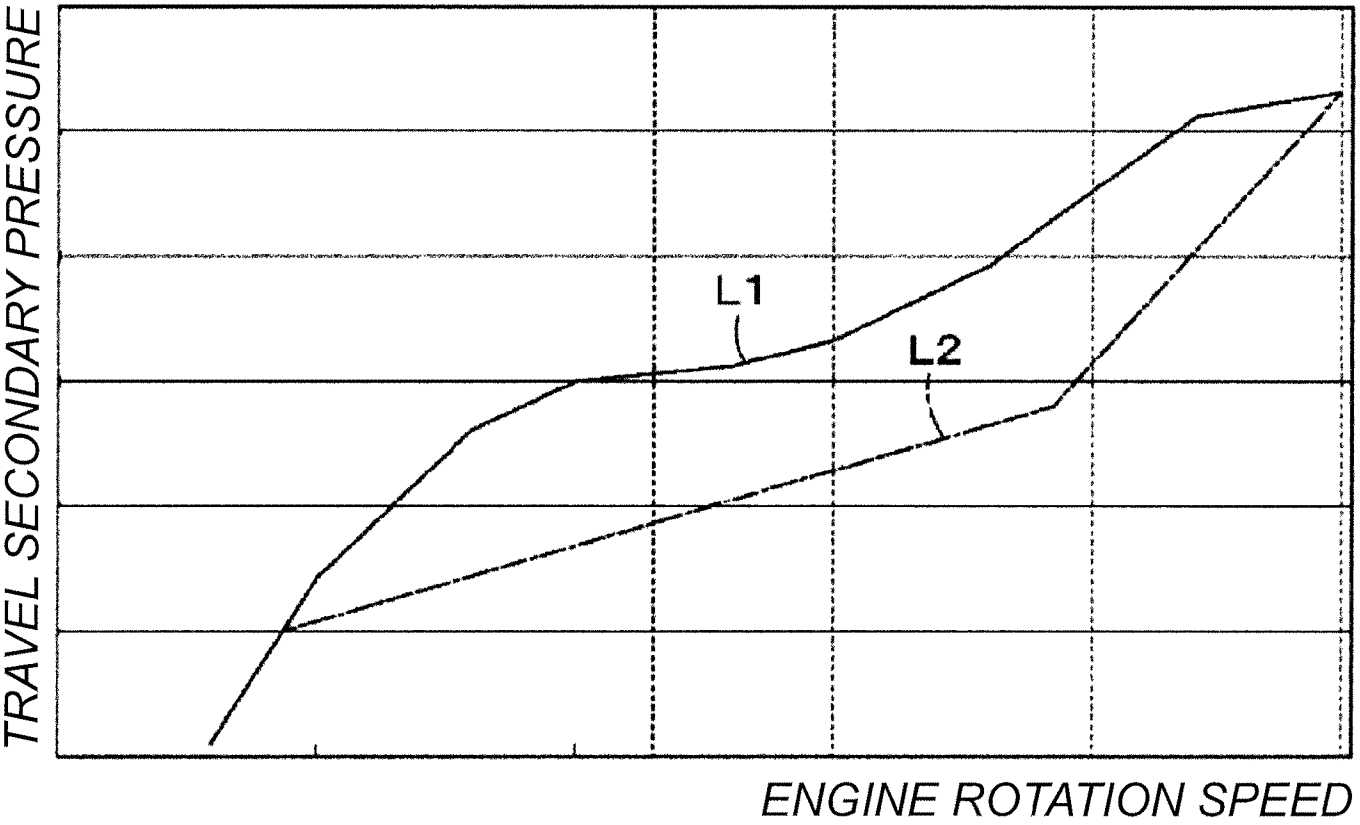
FIG. 9A is a diagram illustrating a relation among the engine rotation speed, a travel secondary pressure, and the control line.
Figure 9B:
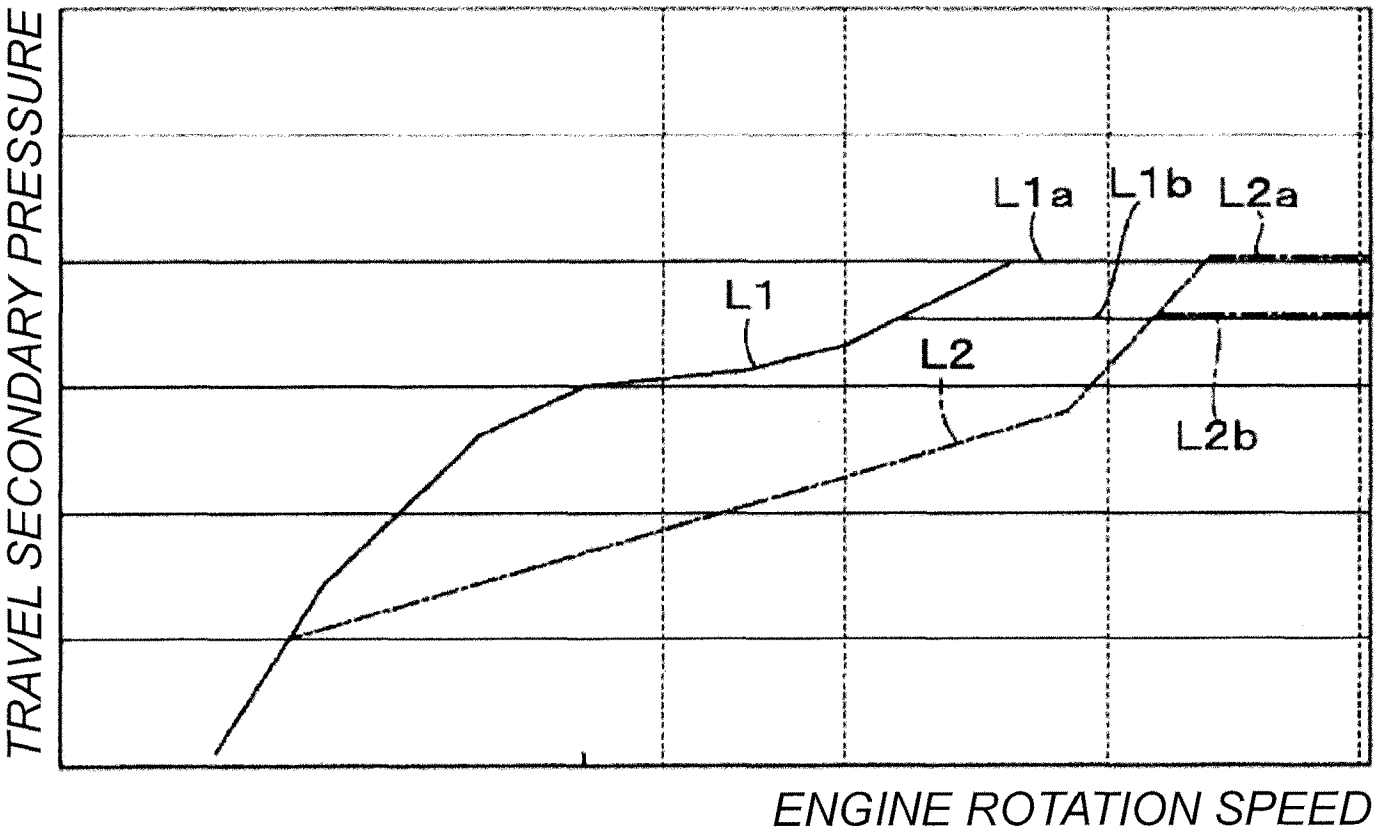
FIG. 9B is a diagram illustrating an example in which an upper limit of the travel secondary pressure is set.

In the above-described embodiments, the degree of opening of the actuation valve (proportional valve) 44 is controlled by the first control device 90 to prevent engine stall, but the engine stall may be prevented by an actuation valve such as the variable relief valve 72. Specifically, as illustrated in FIG. 9A, the engine stall may be prevented by using the control lines L1 and L2 illustrating a relation between a travel secondary pressure and the engine rotation speed. The travel secondary pressure is the pressure of hydraulic oil flowing from the operation valves 55 (operation valve 55A, operation valve 55B, operation valve 55C, and operation valve D) to the travel pumps (HST pumps) 53L and 53R in the travel oil paths 45 (first travel oil path 45*a*, second travel oil path 56*b*, third travel oil path 45*c*, fourth travel oil path 45*d*). When the drop amount is smaller than a predetermined value, the first control device 90 adjusts the degree of opening of the actuation valve (variable relief valve) 72 so that the relation between the actual the engine rotation speed and the travel secondary pressure matches with the control line L1. When the drop amount is equal to or larger than the predetermined value, the first control device 90 adjusts the degree of opening of the variable relief valve 72 so that the relation between the actual the engine rotation speed and the travel secondary pressure matches with the control line L2. When the oil temperature of hydraulic oil measured by the measurement device 91 is high temperature, the degree of opening of the variable relief valve 72 is changed based on the control lines L1 and L2 illustrated in FIG. 9A. When the oil temperature is low temperature, the set pressure of the variable relief valve 72 is changed by the first control device 90, and the travel secondary pressure can be adjusted to be lower than the predetermined pressure as illustrated by control lines L1*a* and L2*a* in FIG. 9B. As illustrated in FIG. 9B, the values of control lines L1*a* L1*b*, L2*a*, and L2*b* (upper limit of the travel secondary pressure) are preferably set in accordance with the oil temperature. For example, when the oil temperature is a low temperature of −15° C., the travel secondary pressure is set by using the control lines L1*a* and L2*a*. When the oil temperature is a low temperature of −20° C., the travel secondary pressure is set by using the control lines L1*b* and L2*b*. According to the control lines L1 and L2, the travel secondary pressure is reduced (set to be lower) for a lower oil temperature. The oil temperature when the control lines L1*a*, L1*b*, L2*a*, and L2*b* are set is not limited to the above-described numerical values. The number of control lines for setting the travel secondary pressure at low temperature is not limited to the above-described number. In this manner, a plurality of control lines for setting the upper limit of the travel secondary pressure are provided for each predetermined temperature at low temperature, which enables warm up while making the work machine 1 travel.

Fifth Embodiment

Figure 12:
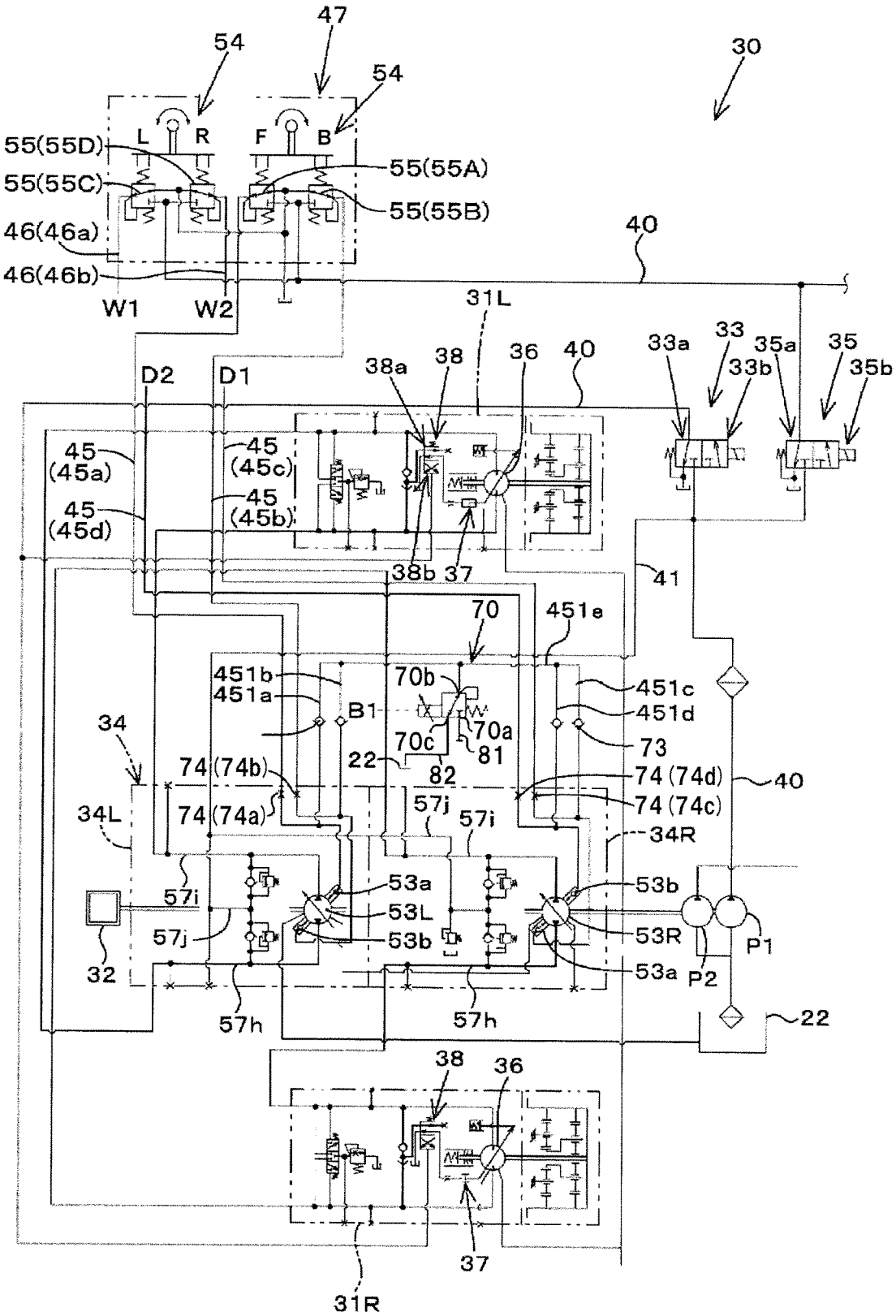
FIG. 12 is a first schematic diagram of a hydraulic system according to a fifth embodiment.

As illustrated in FIG. 12, a hydraulic system 30 includes a first hydraulic pump P1, a left travel motor device (first travel motor device) 31L, a right travel motor device (second travel motor device) 31R, a drive device 32, a first actuation valve 33, a travel hydraulic device 34, and a second actuation valve 35.

The drive device 32 is, for example, an electric motor or an engine. In the present embodiment, the drive device 32 is an engine. The first hydraulic pump P1 is a constant-capacity gear pump driven by the power of the drive device 32. The first hydraulic pump P1 is capable of discharging hydraulic oil accumulated in a tank 22. In particular, the first hydraulic pump P1 discharges hydraulic oil mainly used for control. For the purpose of description, the tank 22 that accumulates hydraulic oil is also referred to as a hydraulic oil tank. Hydraulic oil discharged from the first hydraulic pump P1 and used for control is also referred to as pilot oil, and the pressure of the pilot oil is also referred to as pilot pressure.

An oil path (discharging oil path) 40 is provided on a discharging side of the first hydraulic pump P1 so as to flow hydraulic oil (pilot oil) therethrough. The discharging oil path (first oil path) 40 is provided with the first actuation valve 33, the second actuation valve 35, the first travel motor device 31L, and the second travel motor device 31R.

The first actuation valve 33 is an electromagnetic valve for changing rotation of the first travel motor device 31L and the second travel motor device 31R, and is a two-position switching valve switchable between a first position 33*a* and a second position 33*b* by excitation. A switching operation of the first actuation valve 33 is performed by, for example, an operation member (not illustrated).

The second actuation valve 35 is an electromagnetic valve for switching flow of the hydraulic oil to the discharging oil path 40 downstream of the second actuation valve 35, and is a two-position switching valve switchable between the first position 35*a* and the second position 35*b* by excitation. A switching operation of the second actuation valve 35 is performed through, for example, a switch provided around the operator seat 8. When the switch is turned on, the second actuation valve 35 is switched to the first position 35*a*, and the hydraulic oil does not flow to the discharging oil path 40 downstream of the second actuation valve 35. When the switch is turned off, the second actuation valve 35 is switched to the second position 35*b*, and the hydraulic oil flows to the discharging oil path 40 downstream of the second actuation valve 35.

The first travel motor device 31L is a motor for transferring power to a drive shaft of the travel device 5 provided on the left side of the body 2. The second travel motor device 31R is a motor for transferring power to a drive shaft of the travel device 5 provided on the right side of the body 2.

The first travel motor device 31L includes an HST motor (travel motor) 36, a swash plate switching cylinder 37, and a travel control valve (hydraulic switching valve) 38. The travel motor 36 is a swash-plate variable-capacity axial motor capable of changing a vehicle speed (rotation) to the first or second speed. The travel motor 36 is capable of changing a travel speed (rotational speed).

The swash plate switching cylinder 37 is a cylinder for changing the angle of a swash plate of the travel motor 36 through expansion and contraction. The travel control valve 38 is a valve for expansion and contraction of the swash plate switching cylinder 37 toward one end or the other end, and is a two-position switching valve switchable between the first position 38*a* and the second position 38*b*. A switching operation of the travel control valve 38 is performed by the first actuation valve 33 connected with the travel control valve 38 and positioned upstream thereof. The second travel motor device 31R has the same configuration and actuation as those of the first travel motor device 31L, and thus description thereof will be omitted.

The travel hydraulic device 34 is configured to drive the first travel motor device 31L and the second travel motor device 31R, and includes a drive circuit (left drive circuit) 34L for drive of the first travel motor device 31L, and a drive circuit (right drive circuit) 34R for drive of the second travel motor device 31R.

The left drive circuit 34L and the right drive circuit 34R include travel pumps (travel hydraulic pumps) 53L and 53R, respectively, and each include speed-change oil paths (third oil paths) 57*h* and 57*i* and a second charge oil path 57*j*. The speed-change oil paths (third oil paths) 57*h* and 57*i* connect the travel pump 53L or 53R and the travel motor 36. The second charge oil path 57*j* is connected with the speed-change oil paths 57*h* and 57*i* and is an oil path for supplying the hydraulic oil from the first hydraulic pump P1 to the speed-change oil paths 57*h* and 57*i*.

The travel pumps 53L and 53R are swash-plate variable-capacity axial pumps driven by the power of the drive device 32. The travel pumps 53L and 53R each include a forward-movement pressure receiving unit 53*a* and a backward-movement pressure receiving unit 53*b* on which the pilot pressure acts. The pilot pressure acting on the forward-movement pressure receiving unit 53*a* and the backward-movement pressure receiving unit 53*b* changes the angle of the swash plate. Changing the angle of the swash plate can change the outputs (discharge amounts of hydraulic oil) of the travel pumps 53L and 53R and the discharge direction of hydraulic oil.

As described above, according to the first travel motor device 31L, when the first actuation valve 33 is switched to the first position 33*a* through an operation of the operation member, the pilot oil is discharged from a section between the first actuation valve 33 and the travel control valve 38, and the travel control valve 38 is switched to the first position 38*a*. As a result, the swash plate switching cylinder 37 is contracted to set the travel motor 36 to the first speed. When the first actuation valve 33 is switched to the second position 33*b* through an operation of the operation member, the pilot oil is supplied to the travel control valve 38 through the first actuation valve 33, and the travel control valve 38 is switched to the second position 38*b*. As a result, the swash plate switching cylinder 37 is expanded to set the travel motor 36 to the second speed.

The following describes a hydraulic system of a work system.

Figure 13:
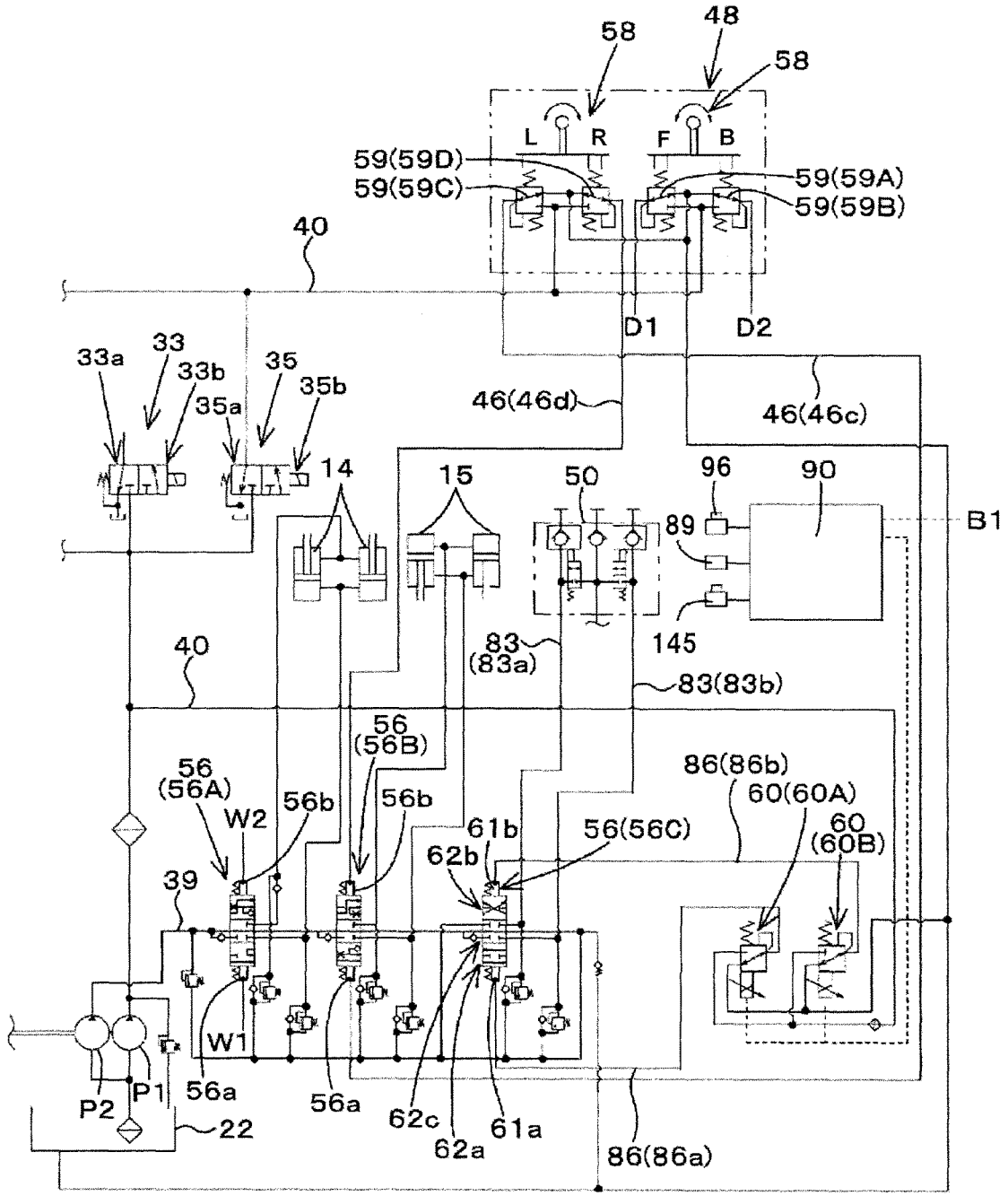
FIG. 13 is a second schematic diagram of the hydraulic system according to the fifth embodiment.

As illustrated in FIG. 13, the hydraulic system 30 includes a plurality of control valves 56, and a work system hydraulic pump (second hydraulic pump) P2.

The second hydraulic pump P2 is a constant-capacity gear pump installed at a position different from that of the first hydraulic pump P1. The second Hydraulic pump P2 is capable of discharging hydraulic oil accumulated in the hydraulic oil tank 22. In particular, the second hydraulic pump P2 mainly discharges hydraulic oil for actuating a hydraulic actuator.

An oil path (main oil path) 39 is provided on a discharging side of the second hydraulic pump P2. The main oil path 39 is connected with the plurality of control valves 56. The control valve 56 is capable of switching a direction in which the hydraulic oil flows through the pilot pressure of the pilot oil. The control valve 56 is capable of controlling a hydraulic instrument. The hydraulic instrument is an instrument for controlling (driving), for example, hydraulic devices such as a boom, a bucket, a hydraulic crusher, a hydraulic breaker, an angle broom, an earth auger, a pallet folk, a sweeper, a mower, and a snow blower, and is, for example, a hydraulic cylinder or a hydraulic motor.

The plurality of control valves 56 are a first control valve 56A, a second control valve 56B, and a third control valve 56C. The first control valve 56A controls the hydraulic cylinder (boom cylinder) 14 for controlling a boom. The second control valve 56B controls the hydraulic cylinder (bucket cylinder) 15 for controls a bucket. The third control valve 56C controls a hydraulic instrument (hydraulic cylinder or hydraulic motor) mounted on an auxiliary attachment such as a hydraulic crusher, a hydraulic breaker, an angle broom, an earth auger, a pallet folk, a sweeper, a mower, or a snow blower.

The first control valve 56A and the second control valve 56B are each a pilot-type directly-operated spool three-position switching valve. The first control valve 56A and the second control valve 56B are each switched, by the pilot pressure, to a neutral position, a first position different from the neutral position, and a second position different from the neutral position and the first position. The first control valve 56A is connected with the boom cylinder 14 through an oil path, and the second control valve 56B is connected with the bucket cylinder 15 through an oil path.

The third control valve 56C is connected with a supplying and discharging oil path 83. One end of the supplying and discharging oil path 83 is connected with a supplying and discharging port of the third control valve 56C, a middle part of the supplying and discharging oil path 83 is connected with the connecting member 50, and the other end part of the supplying and discharging oil path 83 is connected with the hydraulic instrument of the auxiliary attachment.

Specifically, the supplying and discharging oil path 83 includes a first supplying and discharging oil path 83*a* connecting a first supplying and discharging port of the third control valve 56C and a first port of the connecting member 50. The supplying and discharging oil path 83 includes a second supplying and discharging oil path 83*b* connecting a second supplying and discharging port of the third control valve 56C and a second port of the connecting member 50. With this configuration, the third control valve 56C can be operated to flow the hydraulic oil toward the first supplying and discharging oil path 83*a* from the third control valve 56C and toward the second supplying and discharging oil path 83*b* from the third control valve 56C.

The third control valve 56C is operated through a plurality of proportional valves 60. Each proportional valve 60 is an electromagnetic valve the degree of opening of which is changeable by excitation. The plurality of proportional valves 60 are a first proportional valve 60A and a second proportional valve 60B. The first proportional valve 60A and the second proportional valve 60B are connected with the discharging oil path 40. The first proportional valve 60A and the second proportional valve 60B are supplied with the pilot oil, which is hydraulic oil used for control among the hydraulic oil, from the first hydraulic pump P1.

The third control valve 56C, the proportional valves 60 (first proportional valve 60A and second proportional valve 60B) are connected with each other through the control oil path 86.

The control oil path 86 is an oil path through which the pilot oil flows to the third control valve 56C through the proportional valves 60 (first proportional valve 60A and second proportional valve 60B). The control oil path 86 is, for example, a steel pipe, a pipe, or a hose. The control oil path 86 includes a first control oil path 86*a* connecting the first proportional valve 60A and a pressure receiving unit 61*a* of the third control valve 56C, and a second control oil path 86*b* connecting the second proportional valve 60B and a pressure receiving unit 61*b* of the third control valve 56C.

With this configuration, when the first proportional valve 60A is opened, the pilot oil acts on the pressure receiving unit 61*a* of the third control valve 56C through the first control oil path 86*a*, so that the pilot pressure applied (acted on) to the pressure receiving unit 61*a* is determined in accordance with the degree of opening of the first proportional valve 60A. When the pilot pressure applied to the pressure receiving unit 61*a* becomes equal to or higher than a predetermined value, movement of a spool switches the third control valve 56C from a third position (the neutral position) 62*c* to a first position 62*a*. When the second proportional valve 60B is opened, the pilot oil acts on the pressure receiving unit 61*b* of the third control valve 56C through the second control oil path 86*b*, so that the pilot pressure applied (acted on) to the pressure receiving unit 61*b* is determined in accordance with the degree of opening of the second proportional valve 60B. When the pilot pressure applied to the pressure receiving unit 61*b* becomes equal to or larger than a predetermined value, movement of the spool switches the third control valve 56C from the third position (the neutral position) 62*c* to the second position 62*b*.

An operation (opening and closing) of the proportional valves 60 (first proportional valve 60A and second proportional valve 60B) is performed by the control device 90. The control device 90 includes a CPU. The control device 90 is connected with an operation member 96. The control device 90 receives input of an operation amount (for example, a slide amount or a swing amount) of the operation member 96. The operation member 96 is, for example, a swingable seesaw switch, a slidable slide switch, or a push switch that can be freely pressed.

When the operation member 96 is operated, the control device 90 applies current in accordance with the operation amount of the operation member 96 to a solenoid of the first proportional valve 60A or a solenoid of the second proportional valve 60B. Thus, the degrees of opening of the first proportional valve 60A and the second proportional valve 60B are changed in accordance with the operation amount of the operation member 96.

For example, when the pilot pressure acting on the pressure receiving unit 61*a* of the third control valve 56C becomes equal to or larger than a predetermined value as a result of adjusting the degree of opening of the first proportional valve 60A by swinging or sliding the operation member 96 in one direction, the spool of the third control valve 56C is moved to switch the third control valve 56C from the third position 62*c* to the first position 62*a*. For example, when the pilot pressure acting on the pressure receiving unit 61*b* of the third control valve 56C becomes equal to or larger than a predetermined value as a result of adjusting the degree of opening of the second proportional valve 60B by swinging or sliding the operation member 96 in the other direction, the spool of the third control valve 56C is moved to switch the third control valve 56C from the third position 62*c* to the second position 62*b*. In this manner, an auxiliary actuator can be actuated by switching the control valve 56.

As illustrated in FIGS. 12 and 13, an operation (travel operation) related to traveling of the work machine 1 and an operation (work operation) related to work are performed by a first operation device 47 provided to the left of the operator seat 8, and a second operation device 48 provided to the right of the operator seat 8.

The following describes in detail the first operation device 47 and the second operation device 48.

The first operation device 47 is capable of performing both of the travel operation and the work operation, and includes a first operation member 54. The first operation member 54 is a lever capable of performing a first operation of moving in the forward-backward direction, and a second operation of moving in the rightward-leftward direction (body width direction) different from the forward-backward direction. In other words, the first operation member 54 is a lever capable of moving in one direction (for example, forward or leftward) and the other direction (for example, backward or rightward) different from the one direction.

In the first operation member 54, the first operation is allocated to the travel operation, and the second operation is allocated to the work operation. Thus, the first operation member 54 serves as an operation member (travel operation member) for traveling and an operation member (work operation member) for work. The first operation member 54 is not limited to a lever but may be any component capable of independently performing at least the first operation and the second operation.

A plurality of pilot valves (operation valves) 55 are provided to a lower part of the first operation member 54. The plurality of pilot valves 55 are a pilot valve 55A, a pilot valve 55B, a pilot valve 55C, and a pilot valve 55D. The pilot valve 55A, the pilot valve 55B, the pilot valve 55C, and the pilot valve 55D are connected with the discharging oil path 40 downstream of the second actuation valve 35.

The pilot valve 55A is actuated by the forward operation involved in the first operation (forward-backward operation), and is capable of changing the pressure of hydraulic oil output in accordance with the operation amount (operation) of the forward operation. The pilot valve 55B is actuated by the backward operation involved in the first operation (forward-backward operation), and is capable of changing the pressure of hydraulic oil output in accordance with the operation amount (operation) of the backward operation. In other words, the pilot valve 55A and the pilot valve 55B are actuated by the first operation, and perform movements corresponding to the travel operation.

The pilot valve 55C is actuated by the leftward operation involved in the second operation (rightward-leftward operation), and is capable of changing the pressure of hydraulic oil output in accordance with the operation amount (operation) of the leftward operation. The pilot valve 55D is actuated by the rightward operation involved in the second operation (rightward-leftward operation), and is capable of changing the pressure of hydraulic oil output in accordance with the operation amount (operation) of the rightward operation. In other words, the pilot valve 55C and the pilot valve 55D are actuated by the second operation, and perform movements corresponding to the work operation.

The second operation device 48 is capable of performing both of the travel operation and the work operation, and includes a second operation member 58. The second operation member 58 is a lever capable of performing the first operation of moving forward and backward, and the second operation of moving in the rightward and leftward direction (body width direction) different from the forward-backward direction. In other words, the second operation member 58 is a lever capable of moving one direction (for example, forward or leftward) and the other direction (for example, backward or rightward) different from the one direction.

In the second operation member 58, the first operation is allocated to the travel operation, and the second operation is allocated to the work operation. Thus, the second operation member 48 serves as an operation member (travel operation member) for traveling and an operation member (work operation member) for work. The second operation member 58 is not limited to a lever but may be any component capable of independently performing at least the first operation and the second operation.

A plurality of pilot valves (operation valve) 59 are provided to a lower part of the second operation member 58. The plurality of pilot valves 59 are a pilot valve 59A, a pilot valve 59B, a pilot valve 59C, and a pilot valve 59D. The pilot valve 59A, the pilot valve 59B, the pilot valve 59C, and the pilot valve 59D are connected with the discharging oil path 40 downstream of the second actuation valve 35.

The pilot valve 59A is actuated by the forward operation involved in the second operation (forward-backward operation), and is capable of changing the pressure of hydraulic oil output in accordance with the operation amount (operation) of the forward operation. The pilot valve 59B is actuated by the backward operation involved in the first operation (forward-backward operation), and is capable of changing the pressure of hydraulic oil output in accordance with the operation amount (operation) of the backward operation. In other words, the pilot valve 59A and the pilot valve 59B are actuated by the first operation, and perform movements corresponding to the travel operation.

The pilot valve 59C is actuated by the leftward operation involved in the first operation (rightward-leftward operation), and is capable of changing the pressure of hydraulic oil output in accordance with the operation amount (operation) of the leftward operation. The pilot valve 59D is actuated by the rightward operation involved in the second operation (rightward-leftward operation), and is capable of changing the pressure of hydraulic oil output in accordance with the operation amount (operation) of the rightward operation. In other words, the pilot valve 59C and the pilot valve 59D are actuated by the second operation, and perform movements corresponding to the work operation.

As described above, the pilot valve 55A, the pilot valve 55B, the pilot valve 59A, and the pilot valve 59B among the plurality of pilot valves are actuated by the travel operation, and the pilot valve 55C, the pilot valve 55D, the pilot valve 59C, and the pilot valve 59D are actuated by the work operation. For the purpose of description, the pilot valve 55A, the pilot valve 55B, the pilot valve 59A, and the pilot valve 59B are also referred to as a first operation valve (travel operation valve) collectively. In addition, the pilot valve 55C, the pilot valve 55D, the pilot valve 59C, and the pilot valve 59D are also referred to as a second operation valve (work operation valve) collectively.

The following describes a relation among the first operation valve (travel operation valve), the second operation valve (work operation valve), and the hydraulic instrument. In FIGS. 12 and 13, reference numerals "W1", "W2", "D1", and "D2" indicate connection destinations of oil paths.

The first operation valve (travel operation valve) is connected with the travel pumps 53L and 53R as hydraulic instruments (travel hydraulic instruments) of the traveling system through a travel oil path (second oil path) 45. In other words, the travel pumps 53L and 53R are each a first hydraulic instrument that can be actuated by the hydraulic oil output from the first operation valve.

The travel oil path 45 includes a first travel oil path 45*a*, a second travel oil path 45*b*, a third travel oil path 45*c*, and a fourth travel oil path 45*d*. The first travel oil path 45*a* connects the first operation valve 55A and the forward-movement pressure receiving unit 53*a* of the travel pump 53L. The second travel oil path 45*b* connects the third operation valve 55B and the backward-movement pressure receiving unit 53*b* of the travel pump 53L. The third travel oil path 45*c* connects the fifth operation valve 59A and the forwards-movement pressure receiving unit 53*a* of the travel pump 53R. The fourth travel oil path 45*d* connects the sixth operation valve 59B and the backward-movement pressure receiving unit 53*b* of the travel pump 53R.

When the first operation member 54 is tilted forward, the first operation valve 55A is operated to output the pilot pressure. This pilot pressure acts on the forward-movement pressure receiving unit 53*a* of the travel pump 53L. When the second operation member 58 is tilted forward, the fifth operation valve 59A is operated to output the pilot pressure. This pilot pressure acts on the forward-movement pressure receiving unit 53*a* of the travel pump 53R.

When the first operation member 54 is tilted backward, the third operation valve 55B is operated to output the pilot pressure. This pilot pressure acts on the backward-movement pressure receiving unit 53*b* of the travel pump 53L. When the second operation member 58 is tilted backward, the sixth operation valve 59B is operated to output the pilot pressure. This pilot pressure acts on the backward-movement pressure receiving unit 53*b* of the travel pump 53R.

Thus, when the first operation member 54 and the second operation member 58 are swung forward, the travel motor (HST motor) 36 performs normal rotation at a speed proportional to the swing amounts of the first operation member 54 and the second operation member 58, and accordingly, the work machine 1 travels straight toward the front side. When the first operation member 54 and the second operation member 58 are swung backward, the travel motor 36 performs reverse rotation at a speed proportional to the swing amounts of the first operation member 54 and the second operation member 58, and accordingly, the work machine 1 travels straight toward the back side.

When one of the first operation member 54 and the second operation member 58 is swung forward and the other is swung backward, the travel motor 36 on the left side and the travel motor 36 on the right side rotate in different directions, and accordingly, the work machine 1 rotates to the right or left.

As described above, the travel operation involving forward and backward travel and right and left rotation of the work machine 1 can be performed by moving the first operation member 54 and the second operation member 58 forward and backward.

The second operation valve (work operation valve) is connected with the control valve 56 as a hydraulic instrument (work hydraulic instrument) of the work system through a work oil path (fourth oil path) 46. In other words, the control valve 56 is a second hydraulic instrument that can be actuated by the hydraulic oil output from the second operation valve.

The work oil path 46 includes a first work oil path 46*a*, a second work oil path 46*b*, a third work oil path 46*c*, and a fourth work oil path 46*d*. the first work oil path 46*a* connects the second operation valve 55C and the pressure receiving unit 56*a* of the first control valve 56A. The second work oil path 46*b* connects the fourth operation valve 55D and the pressure receiving unit 56*b* of the first control valve 56A. The third work oil path 46*c* connects the seventh operation valve 59C and the pressure receiving unit 56*a* of the second control valve 56B. The fourth work oil path 46*d* connects the eighth operation valve 59D and the pressure receiving unit 56*b* of the second control valve 56B.

When the first operation member 54 is tilted leftward, the second operation valve 55C is operated to set the pilot pressure of the pilot oil output from the second operation valve 55C. This pilot pressure acts on the pressure receiving unit 56*a* of the first control valve 56A to expand the boom cylinder 14, so that the boom 10 is moved up.

When the first operation member 54 is tilted rightward, the fourth operation valve 55D is operated to set the pilot pressure of the pilot oil output from the fourth operation valve 55D. This pilot pressure acts on the pressure receiving unit 56*b* of the first control valve 56A to contract the boom cylinder 14, so that the boom 10 is moved down.

When the second operation member 58 is tilted leftward, the seventh operation valve 59C is operated to set the pilot pressure of the pilot oil output from the seventh operation valve 59C. This pilot pressure acts on the pressure receiving unit 56*a* of the second control valve 56B to contract the bucket cylinder 15, so that the bucket 11 performs a scooping operation.

When the second operation member 58 is tilted rightward, the eighth operation valve 59D is operated to set the pilot pressure of the pilot oil output from the eighth operation valve 59D. This pilot pressure acts on the pressure receiving unit 56*b* of the second control valve 56B to expand the bucket cylinder 15, so that the bucket 11 performs a dumping operation.

As described above, the work operation involving the moving up and down of the boom 10 and the dumping operation or the scooping operation of the bucket can be performed by moving the first operation member 58 and the second operation member 58 rightward and leftward.

The hydraulic system 30 is provided with a circuit capable of reducing (decompressing) the pressure of the hydraulic oil in the travel oil path (second oil path) 45. As illustrated in FIG. 12, the travel oil path (second oil path) 45 connecting the travel pumps 53L and 53R and the first operation valve is bifurcated such that, a reducing unit (decompressing unit, reducing oil circuit) 70 capable of reducing the pressure of the hydraulic oil in the travel oil path 45 is provided on the oil path after the bifurcation.

Specifically, the travel oil path (second oil path) 45 includes a first bifurcated oil path 451*a*, a second bifurcated oil path 451*b*, a third bifurcated oil path 451*c*, a fourth bifurcated oil path 451*d*, and a fifth bifurcated oil path 451*e*.

The first bifurcated oil path 451*a* bifurcates from a middle part of the first travel oil path 45*a*. The second bifurcated oil path 451*b* bifurcates from a middle part of the second travel oil path 45*b*. The third bifurcated oil path 451*c* bifurcates from a middle part of the third travel oil path 45*c*. The fourth travel oil path 45*d* bifurcates from a middle part of the fourth travel oil path 45*d*. The fifth bifurcated oil path 451*e* connects the first bifurcated oil path 451*a*, the second bifurcated oil path 451*b*, the third bifurcated oil path 451*c*, and the fourth bifurcated oil path 451*d*. The reducing unit 70 is connected with the fifth bifurcated oil path 451*e*.

The first bifurcated oil path 451*a*, the second bifurcated oil path 451*b*, the third bifurcated oil path 451*c*, and the fourth travel oil path 451*d* are each provided with the check valve 73 that allows the hydraulic oil to flow toward the fifth bifurcated oil path 451*e* from a bifurcation part but prevents the hydraulic oil from flowing toward the bifurcation part from the fifth bifurcated oil path 451*e*.

The travel oil path (second oil path) 45 is provided with a narrowing unit 74 that reduces the flow rate of the hydraulic oil flowing from the first operation valve to the bifurcated oil path (first bifurcated oil path 451*a*, second bifurcated oil path 451*b*, third bifurcated oil path 451*c*, and fourth bifurcated oil path 451*d*).

The narrowing unit 74 includes a first narrowing unit 74*a*, a second narrowing unit 74*b*, a third narrowing unit 74*c*, and a fourth narrowing unit 74*d*. The first narrowing unit 74*a* is an aperture provided in a section (main oil path) of the first travel oil path 45*a* between a bifurcation part from which the first bifurcated oil path 451*a* is bifurcated and the first operation valve 55A. The second narrowing unit 74*b* is an aperture provided in a section (main oil path) of the second travel oil path 45*b* between a bifurcation part from which the second bifurcated oil path 451*b* is bifurcated and the third operation valve 55B. The third narrowing unit 74*c* is an aperture provided in a section (main oil path) of the third travel oil path 45*c* between a bifurcation part from which the third bifurcated oil path 451*c* is bifurcated and the fifth operation valve 59A. The fourth narrowing unit 74*d* is an aperture provided in a section (main oil path) of the fourth travel oil path 45*d* between a bifurcation part from which the fourth bifurcated oil path 451*d* is bifurcated and the sixth operation valve 59B.

The reducing unit 70 is an electromagnetic proportional valve (proportional valve) in which the degree of opening is changeable through excitation of a solenoid. The proportional valve 70 includes a primary port (pump port) 70*a*, a secondary port 70*b*, and a discharge port 70*c*. The primary port 70*a* of the proportional valve 70 is closed by a plugging member 72 such as a plug. The secondary port 70*b* of the proportional valve 70 is connected with the fifth bifurcated oil path 451*e* of the travel oil path 45. The discharge port 70*c* is connected with the hydraulic oil tank 22 through an oil path (sixth oil path) 82 for discharging the hydraulic oil. Although the sixth oil path 82 is connected with the hydraulic oil tank 22 in the present embodiment, the sixth oil path 82 may be any oil path for discharging the hydraulic oil, and may be connected with an intake circuit of a pump other than the hydraulic oil tank 22 or with other circuits.

The secondary port 70*b* and the discharge port 70*c* can be connected with each other by changing the degree of opening of the proportional valve 70 when being fully closed, which allows the hydraulic oil in the fifth bifurcated oil path 451*e* to be discharged from the discharge port 70*c* through the secondary port 70*b*. Thus, with the above-described configuration, the proportional valve 70 can achieve reduction in the pressure of the hydraulic oil in the fifth bifurcated oil path 451*e*, that is, the first travel oil path 45*a*, the second travel oil path 45*b*, the third travel oil path 45*c*, and the fourth travel oil path 45*d*, which are connected with the fifth bifurcated oil path 451*e*.

The degree of opening of the proportional valve 70 is changed by the control device 90. The control device 90 is connected with a detection device 89 configured to detect a load of the drive device 32. The detection device 89 receives input of, for example, an engine rotation speed as an index indicating the load of the drive device 3. When the engine rotation speed becomes equal to or smaller than a predetermined value, the control device 90 outputs a control signal for opening the proportional valve 70. Accordingly, the proportional valve 70 is opened to release pressure in the travel oil path 45, thereby reducing the outputs of the travel pumps 53L and 53R. Thus, pressure on a secondary side of the first operation valve (travel operation valve) can be reduced by the proportional valve 70 to reduce the outputs of the travel pumps 53L and 53R, thereby preventing engine stall. Alternatively, the load of the drive device may be directly measured so that the pressure on the secondary side of the first operation valve (travel operation valve) is reduced when the load of the drive device becomes equal to or larger than the predetermined value.

In the above-described embodiment, engine stall is prevented by opening the proportional valve 70 to reduce the pressure (secondary pressure of the first operation valve) in the travel oil path 45, but the pressure in the travel oil path 45 may be reduced by control as follows.

The control device 90 is connected with a switch (parking switch) 145 that can be turned on and off. When the switch 145 is turned on, the work device 4 is actuated while traveling is stopped. Specifically, when the switch 145 is turned on, the control device 90 outputs a control signal for fully opening the proportional valve 70. Accordingly, the pressure in the travel oil path 45 is released when the proportional valve 70 is fully opened, so that almost no hydraulic oil is discharged from the travel pumps 53L and 53R, and the travel motor 36 stops rotating. Thus, the pressure on the secondary side of the first operation valve (travel operation valve) is set to zero by the proportional valve 70 to stop the travel motor 36, thereby moving the work device 4 while the work machine 1 is being stopped.

A variable relief valve or a balanced relief valve may be used as the above-described configuration for reducing the pressure on the secondary side of the first operation valve, that is, the reducing unit (decompressing unit) 70 that reduces the pressure in the second oil path 45. According to the present embodiment, the pressure in the second oil path 45 is reduced by opening the proportional valve 70 when the primary port 70*a* is closed by the plugging member 81 such as a plug while the secondary port 70*b* of the proportional valve 70 is connected with a control target instrument (hydraulic instrument). Thus, in a model with no variable relief valve mounted on an oil path on the secondary side of the first operation valve, the proportional valve (electromagnetic proportional valve) 70 may be provided to reduce the pressure on the secondary side, thereby reducing the output of a hydraulic instrument. In the present embodiment, the output of the travel hydraulic instrument connected with one (travel oil path) of the travel oil path (second oil path) 45 and the work oil path (fourth oil path) 46 can be reduced. Alternatively, the output of the work hydraulic instrument connected with the other (work oil path) of the travel oil path (second oil path) 45 and the work oil path (fourth oil path) 46 may be reduced.

Sixth Embodiment

Figure 14:
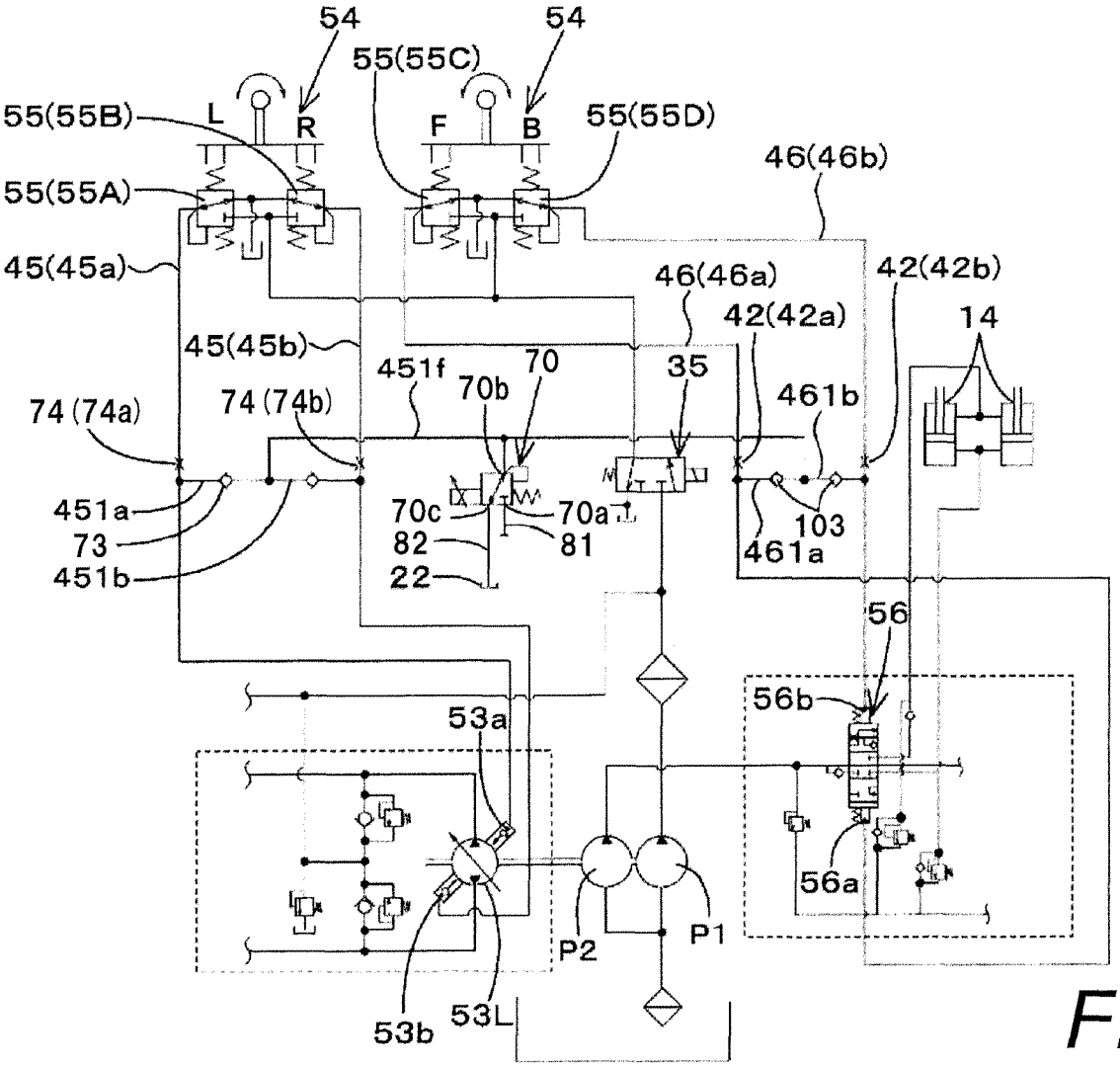
FIG. 14 is a schematic diagram of a hydraulic system according to a sixth embodiment.

FIG. 14 illustrates part of a hydraulic system according to a second embodiment. A part other than the part of the hydraulic system illustrated in FIG. 14 is the same as that in the above-described embodiment. Description of any configuration same as that in the above-described embodiment will be omitted.

The hydraulic system according to the second embodiment is a circuit capable of reducing not only the pressure on the secondary side of the first operation valve (travel operation valve) but also the pressure on the secondary side of the second operation valve (work operation valve).

As illustrated in FIG. 14, a first travel oil path 45*a* and a second travel oil path 45*b* is connected with a travel hydraulic instrument (travel pump 53L). A sixth bifurcated oil path 451*f* connects a first bifurcated oil path 451*a* bifurcating from a middle part of the first travel oil path 45*a* and a second bifurcated oil path 451*b* bifurcating from a middle part of the second travel oil path 45*b*.

A first work oil path 46*a* and a second work oil path 46*b* are connected with a work hydraulic instrument (control valve 56A). The sixth bifurcated oil path 451*f* connects a first bifurcated oil path 461*a* bifurcating from a middle part of the first work oil path 46*a* and a second bifurcated oil path 461*b* bifurcating from a middle part of the second work oil path 46*b*. Thus, the sixth bifurcated oil path 451*f* is part of a travel oil path 45 and part of a work oil path 46.

The work oil path (fourth oil path) 46 is provided with a narrowing unit 42 (a throttle 42) that reduces the flow rate of the hydraulic oil flowing from the second operation valve to the bifurcated oil paths (first work oil path 46*a* and second work oil path 46*b*). The narrowing unit 42 includes a first narrowing unit 42*a* (a first throttle 42*a*) and a second narrowing unit 42*b* (a second throttle 42*b*). The first narrowing unit 42*a* is an aperture provided in a section (main oil path) of the first work oil path 46*a* between a bifurcation part from which the first bifurcated oil path 461*a* is bifurcated and a second operation valve 55C. The second narrowing unit 42*b* is an aperture provided in a section (main oil path) of the second work oil path 46*b* between a bifurcation part from which the second bifurcated oil path 461*b* is bifurcated and a fourth operation valve 55D.

The first bifurcated oil path 461*a* and the second bifurcated oil path 461*b* are each provided with a check valve 103. The check valve 103 is a valve that allows the hydraulic oil to flow toward the sixth bifurcated oil path 451*f* from a bifurcation part but prevents the hydraulic oil from flowing toward the bifurcation part from the sixth bifurcated oil path 451*f*.

A set pressure of the check valve 103 provided to the fourth oil path 46 (first bifurcated oil path 461*a*, second bifurcated oil path 461*b*) and a set pressure of a check valve 73 provided to the second oil path 45 are preferably set to be different from each other. For example, when the set pressure of the check valve 73 is changeable (can be set through, for example, a spring), the check valve 73 is set to have a predetermined set pressure, and the check valve 103 is set to have a set pressure lower than that of the check valve 73.

The sixth bifurcated oil path 451*f* is connected with a reducing unit 70. In other words, the reducing unit 70 is connected with the second oil path 45 and the fourth oil path 46. A secondary port 70*b* of the proportional valve 70 is connected with the sixth bifurcated oil path 451*f*. A primary port 70*a* is closed by a plugging member 81 such as a plug, and a discharge port 70*c* is connected with a hydraulic oil tank 22 through an oil path (sixth oil path) 82.

The secondary port 70*b* and the discharge port 70*c* can be connected with each other by changing the degree of opening of the proportional valve 70 when being fully closed, which allows the hydraulic oil in the sixth bifurcated oil path 451*f* to be discharged from the discharge port 70*c* through the secondary port 70*b*. Thus, with the above-described configuration, the proportional valve 70 can achieve reduction in both of the pressure of the hydraulic oil in the predetermined travel oil path 45 and the pressure of the hydraulic oil in the predetermined work oil path 46.

In the hydraulic system of the work system, a work hydraulic instrument such as the control valve 56A can be actuated along with the work operation of an operation member such as the second operation member 48. For example, the control valve 56A can be forcibly returned to the neutral position by operating the proportional valve 70 to reduce the secondary pressure in the predetermined work oil path 46. For example, when the work hydraulic instrument is a control valve 56B, the actuation of the bucket cylinder 15 (scooping operation of bucket 11) can be delayed by operating the proportional valve 70 to reduce the secondary pressure in a third work oil path 46*c*. Thus, a particular hydraulic instrument operation among a plurality of actuation hydraulic instruments included in the hydraulic system can be delayed.

Seventh Embodiment

Figure 15A:
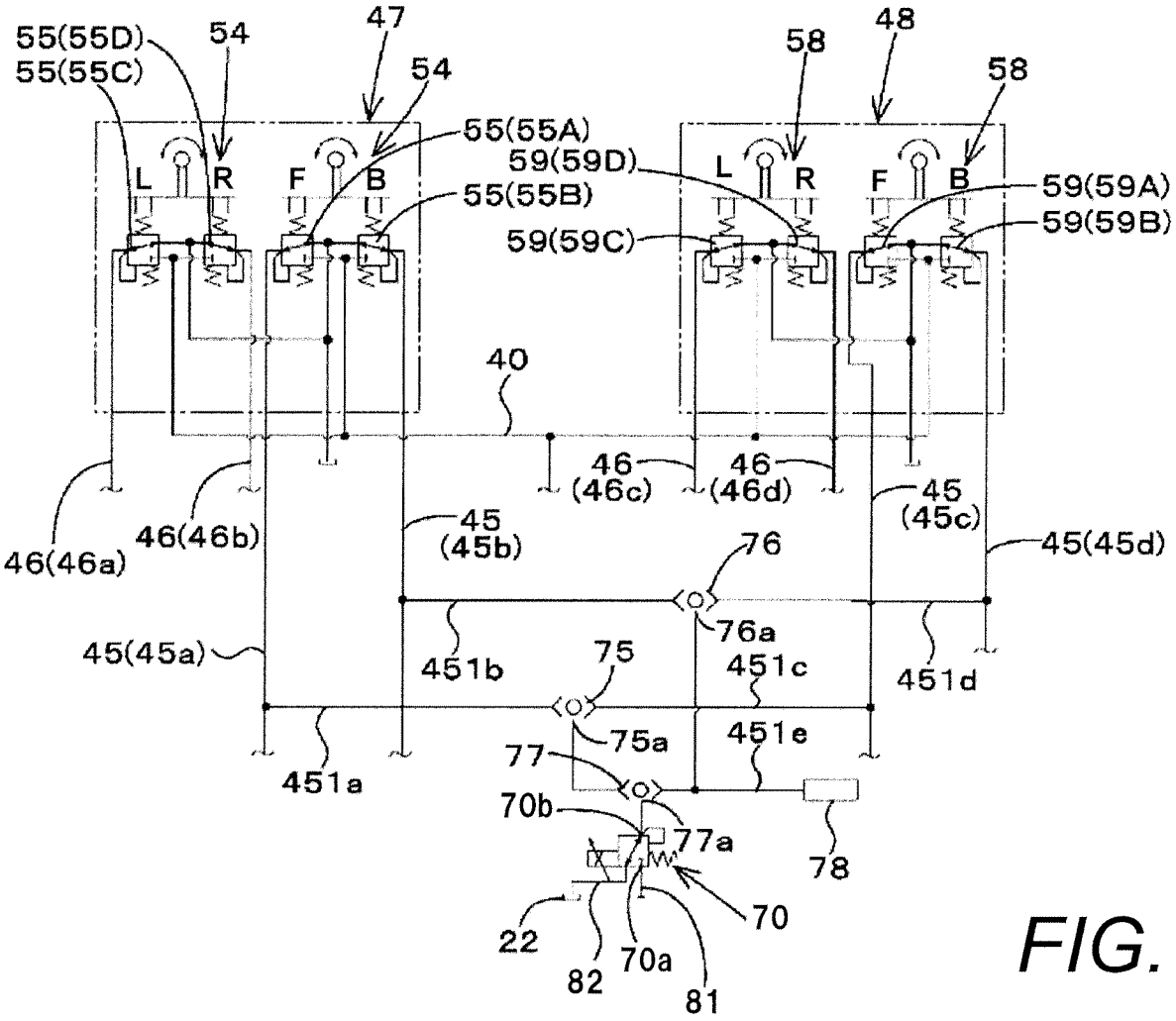
FIG. 15A is a schematic diagram of a hydraulic system according to a seventh embodiment.
Figure 15B:
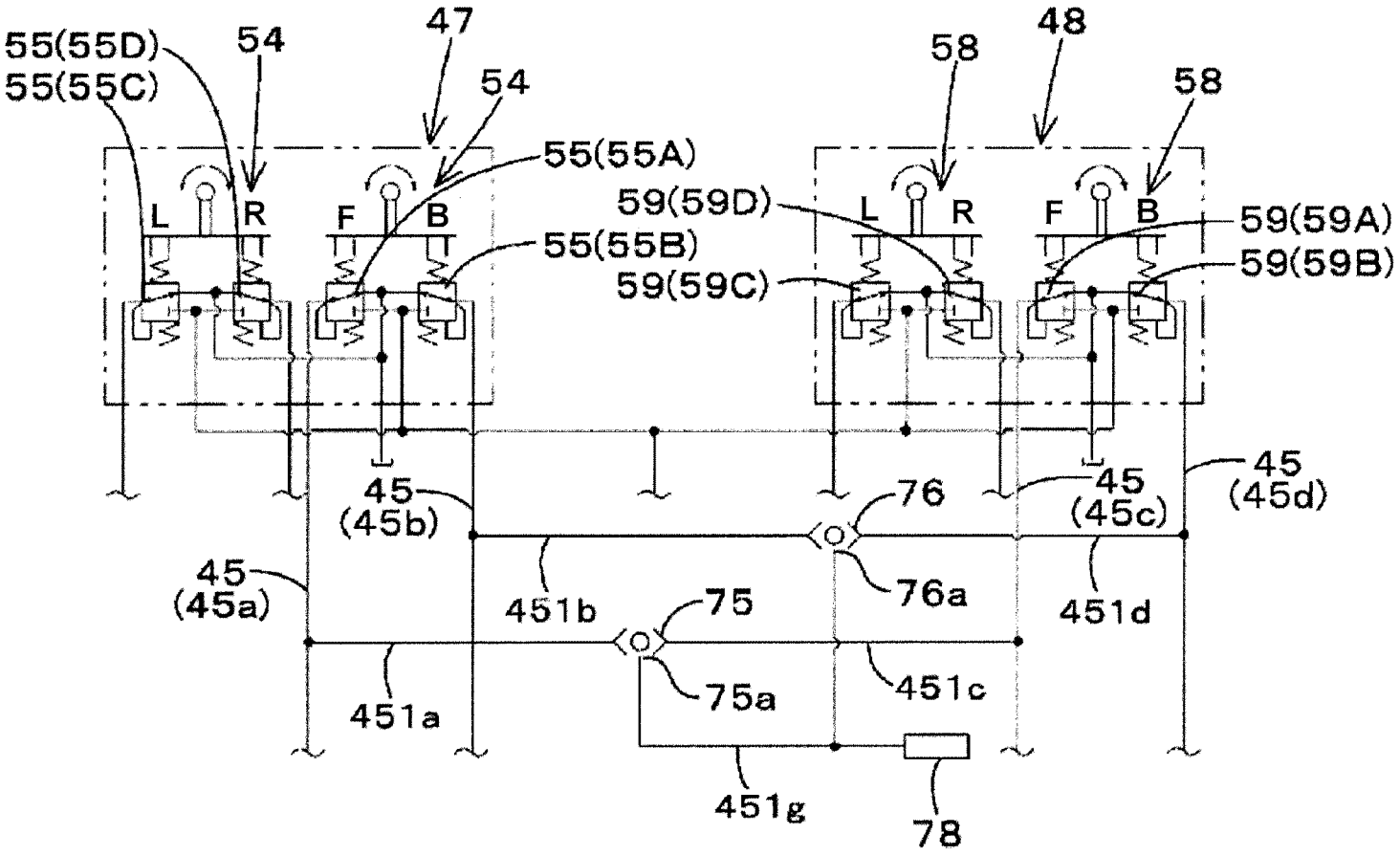
FIG. 15B is a diagram illustrating a first modification of the hydraulic system according to the seventh embodiment.
Figure 15C:
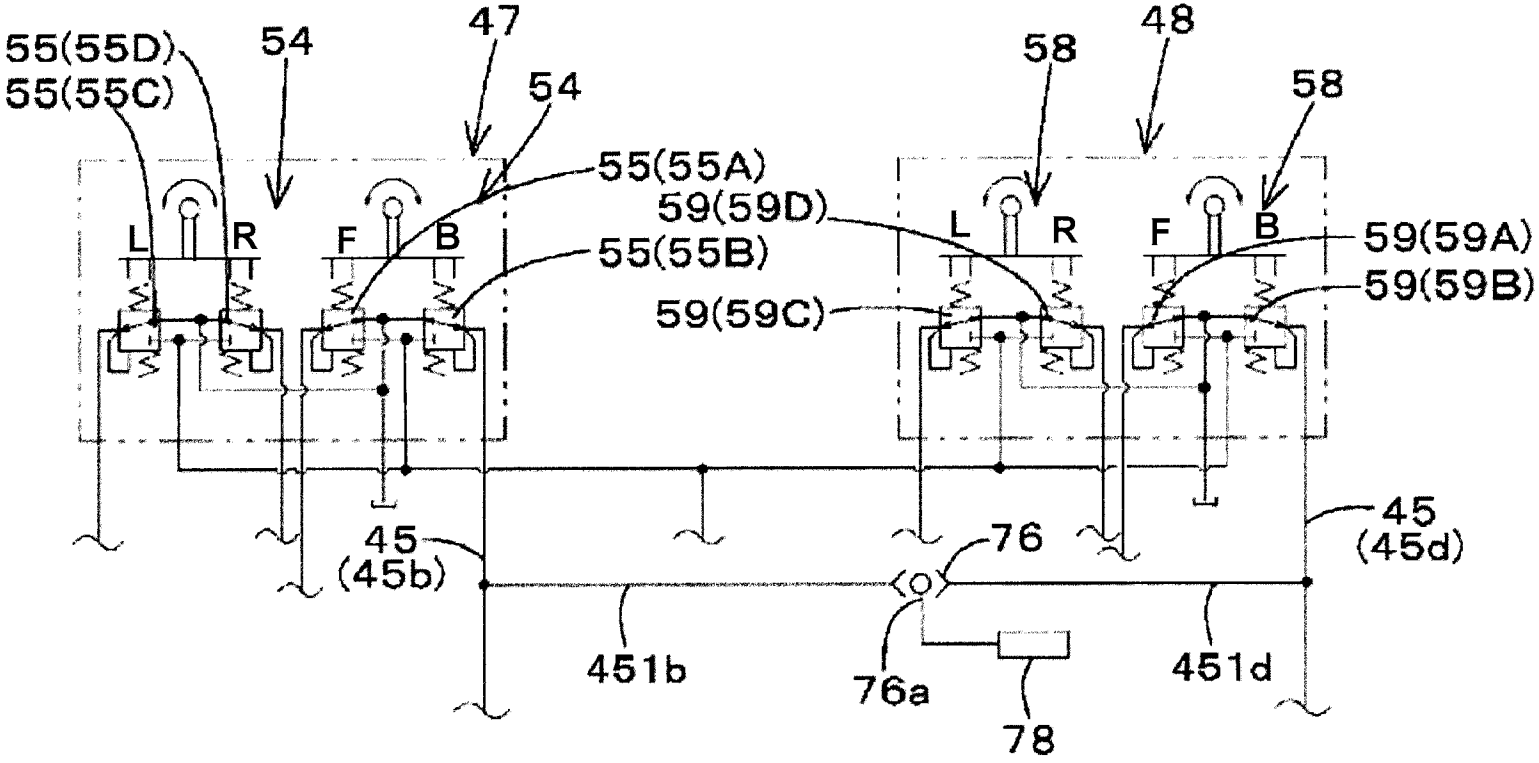
FIG. 15C is a diagram illustrating a second modification of the hydraulic system according to the seventh embodiment.

FIG. 15A illustrates part of a hydraulic system according to a third embodiment. A part other than the part of the hydraulic system illustrated in FIGS. 15A to 15C is the same as that in the above-described embodiment. Description of any configuration same as that in the above-described embodiment will be omitted. For the purpose of description, in the third embodiment, among the plurality of travel operation valves (pilot valve 55A, pilot valve 55B, pilot valve 59A, and pilot valve 59B), a pilot valve 55A is referred to as a first travel operation valve, a pilot valve 55B is referred to as a second travel operation valve, a pilot valve 59A is referred to as a third travel operation valve, and a pilot valve 59B is referred to as a fourth travel operation valve.

As illustrated in FIGS. 15A to 15C, the first travel operation valve 55A is connected with a first travel oil path 45*a*. The second travel operation valve 55B is connected with a second travel oil path 45*b*. The third travel operation valve 59A is connected with a third travel oil path 45*c*. The fourth travel operation valve 59B is connected with a fourth travel oil path 45*d*.

A first bifurcated oil path 451*a* of the first travel oil path 45*a* and a third bifurcated oil path 451*c* of the third travel oil path 45*c* are connected with a first selection valve 75. A second bifurcated oil path 451*b* of the second travel oil path 45*b* and a fourth bifurcated oil path 451*d* of the fourth travel oil path 45*d* are connected with a second selection valve 76. The first selection valve 75 and the second selection valve 76 are connected with each other through a fifth bifurcated oil path 451*e* to which a third selection valve 77 is provided. The fifth bifurcated oil path 451*e* is connected with a detection device (pressure sensor, pressure switch) 78 configured to detect the pressure of the hydraulic oil. In response to input of a predetermined pressure, the detection device 78 is switched on or the flow of the hydraulic oil is detected by the pressure sensor.

The first selection valve (shuttle valve) 75 includes an output port 75*a* configured to output one of the hydraulic oil in the first bifurcated oil path 451*a* (hydraulic oil output from first travel operation valve 55A) and the hydraulic oil in the third bifurcated oil path 451*c* (hydraulic oil output from third travel operation valve 59A), having a higher pressure.

The second selection valve (shuttle valve) 76 includes an output port 76*a* configured to output one of the hydraulic oil in the second bifurcated oil path 451*b* (hydraulic oil output from second travel operation valve 55B) and the hydraulic oil in the fourth bifurcated oil path 451*d* (hydraulic oil output from fourth travel operation valve 59B), having a higher pressure.

The third selection valve (shuttle valve) 77 includes an output port 77*a* configured to output one of the hydraulic oil output from the output port 75*a* of the first selection valve 75 and the hydraulic oil output from the output port 76*a* of the second selection valve 76, having a higher pressure. The output port 77*a* of the third selection valve (shuttle valve) 77 is connected with a reducing unit 70 that is an electromagnetic proportional valve (proportional valve). Specifically, the output port 77*a* of the third selection valve (shuttle valve) 77 is connected with a secondary port 70*b* of the proportional valve 70.

In the hydraulic system illustrated in FIG. 15A, when the first operation member 54 and the second operation member 58 are swung backward, the hydraulic oil is output from the second selection valve 76 and flows to the fifth bifurcated oil path 451*e*, which is detected by the detection device 78, thereby detecting backward travel of a work machine 1. In the hydraulic system according to an embodiment of the present invention, the first operation member 54 arranged on the left side of the operator seat 8 and the second operation member 58 arranged on the right side of the operator seat 8 are used to perform a backward travel operation. Thus, the first travel operation valve 55A and the second travel operation valve 55B operated by the first operation member 54, and the third travel operation valve 59A and the fourth travel operation valve 59B operated by the second operation member 58 are arranged with the operator seat 8 interposed therebetween. If a detection device is provided to each of the first travel operation valve 55A, the second travel operation valve 55B, the third travel operation valve 59A, and the fourth travel operation valve 59B, a larger number of detection devices are needed, and also a larger number of harnesses are needed to connect these detection devices with a control device 90. The hydraulic system illustrated in FIG. 15A only requires one detection device and one harness, which leads to reduction in work to arrange harnesses on the right and left sides.

Moreover, when the degree of opening of the proportional valve 70 is changed, the secondary port 70*b* and the discharge port 70*c* become connected with each other to allow discharge from the discharge port 70*c* of the fifth bifurcated oil path 451*e*. Thus, with the above-described configuration, the proportional valve 70 can achieve reduction in the pressure of the hydraulic oil in the first travel oil path 45*a*, the second travel oil path 45*b*, the third travel oil path 45*c*, and the fourth travel oil path 45*d*.

FIG. 15B illustrates a first modification of the third embodiment, and FIG. 15C illustrates a second modification of the third embodiment.

As illustrated in FIG. 15B, the first selection valve 75 is connected with the first bifurcated oil path 451*a* and the third bifurcated oil path 451*c*. The second selection valve 76 is connected with the second bifurcated oil path 451*b* and the fourth bifurcated oil path 451*d*. The first selection valve 75 and the second selection valve 76 are connected with each other through a seventh bifurcated oil path 451*g*. The seventh bifurcated oil path 451*g* is connected with the detection device 78 configured to detect the pressure of the hydraulic oil. In the hydraulic system illustrated in FIG. 15B, when the travel operation is performed in the first operation member 54 and the second operation member 58, the hydraulic oil is output from the first selection valve 75 or the second selection valve 76 and flows to the seventh bifurcated oil path 451*g*, which allows the detection device 78 to detect the travel operation.

As illustrated in FIG. 15C, the second selection valve 76 is connected with the second bifurcated oil path 451*b* and the fourth bifurcated oil path 451*d*. An output port of the second selection valve 76 is connected with the detection device 78. In the hydraulic system illustrated in FIG. 15C, when an operation to make the work machine 1 travel backward is performed in the first operation member 54 and the second operation member 58, the hydraulic oil is output from the second selection valve 76, which can be detected by the detection device 78.

Eighth Embodiment

Figure 16:
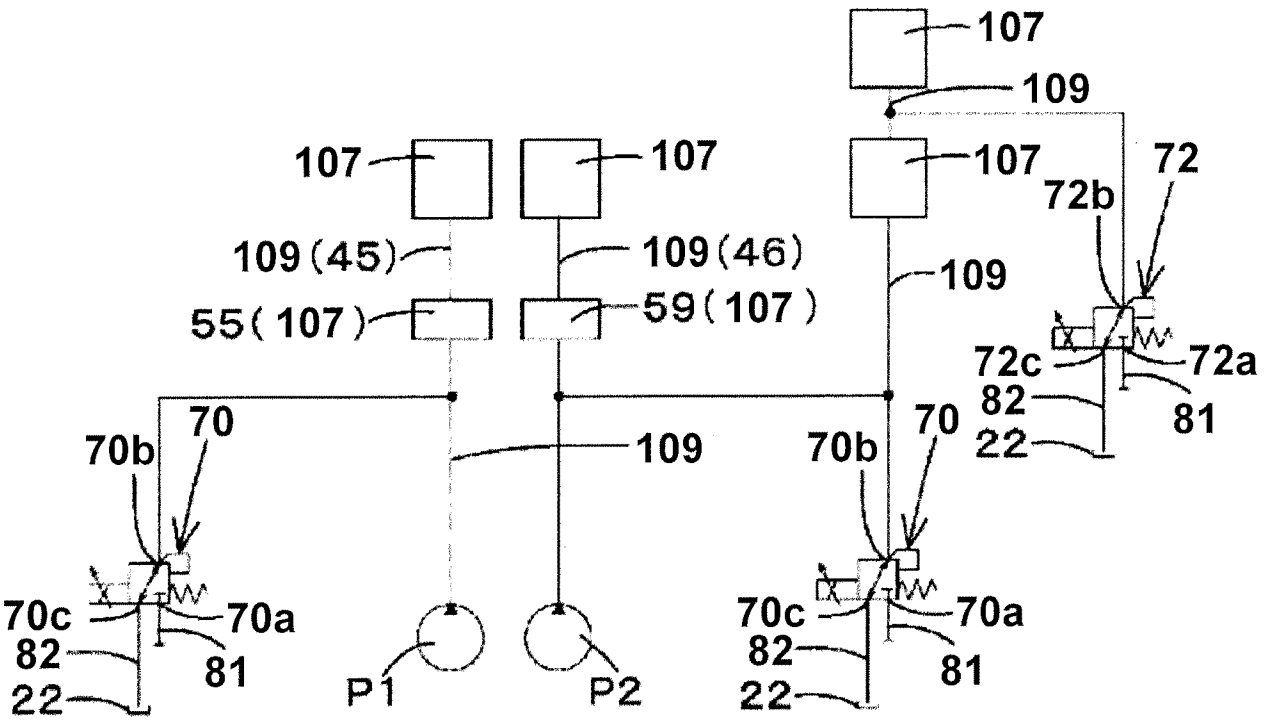
FIG. 16 is a schematic diagram of a hydraulic system according to an eighth embodiment.

FIG. 16 illustrates a hydraulic system according to a fourth embodiment. The hydraulic system according to the fourth embodiment is a modification of a connection destination of a proportional valve 70. Description of any configuration same as that in the above-described embodiment will be omitted.

As illustrated in FIG. 16, a hydraulic system of a work machine is provided with a plurality of hydraulic instruments 107. The plurality of hydraulic instruments 107 are connected with each other through a plurality of fifth oil paths 109. The fifth oil path 109 is an oil path in which hydraulic oil such as hydraulic oil discharged from a first hydraulic pump P1 and a second hydraulic pump P2 flows. The fifth oil path 109 includes a travel oil path (second oil path) 45 or a work oil path (fourth oil path) 46 described above.

The hydraulic instruments 107 are various kinds of instruments constituting the hydraulic system and actuated by the hydraulic oil. Examples of the hydraulic instruments 107 include a hydraulic motor rotated by the hydraulic oil, a hydraulic cylinder expanded and contracted by the hydraulic oil, a control valve, a switching valve, and an operation valve that each change the flow rate and direction of the hydraulic oil. A proportional valve 70 is provided at various places for decompression in the fifth oil path 109. For example, as illustrated in FIG. 16, the proportional valve 70 is connectable with the fifth oil path 109 connecting the first hydraulic pump P1 and an operation valve 55, the fifth oil path 109 connecting the second hydraulic pump P2 and the hydraulic instruments 107, and the fifth oil path 109 connecting the hydraulic instruments 107 and the hydraulic instruments 107. A primary port 70*a* of the proportional valve 70 is closed by a plugging member 81 such as a plug. A secondary port 70*b* is connected with the fifth oil path 109. A discharge port 70*c* is connected with a hydraulic oil tank 22 through an oil path (sixth oil path) 82. With this configuration, when opened, the proportional valve 70 allows the hydraulic oil in the various fifth oil paths 109 to flow to the hydraulic oil tank 22. Thus, the proportional valve 70 can be used as a decompression valve that reduces the pressure in the fifth oil path 109. FIG. 16 illustrates an example in which the proportional valve 70 is used as a decompression valve, and the proportional valve 70 may be provided at various places illustrated in FIG. 16 in the hydraulic system (hydraulic circuit).

Above-described hydraulic pumps P1 and P2 are exemplary, and may be any pump capable of discharging the hydraulic oil.

Figure 17:
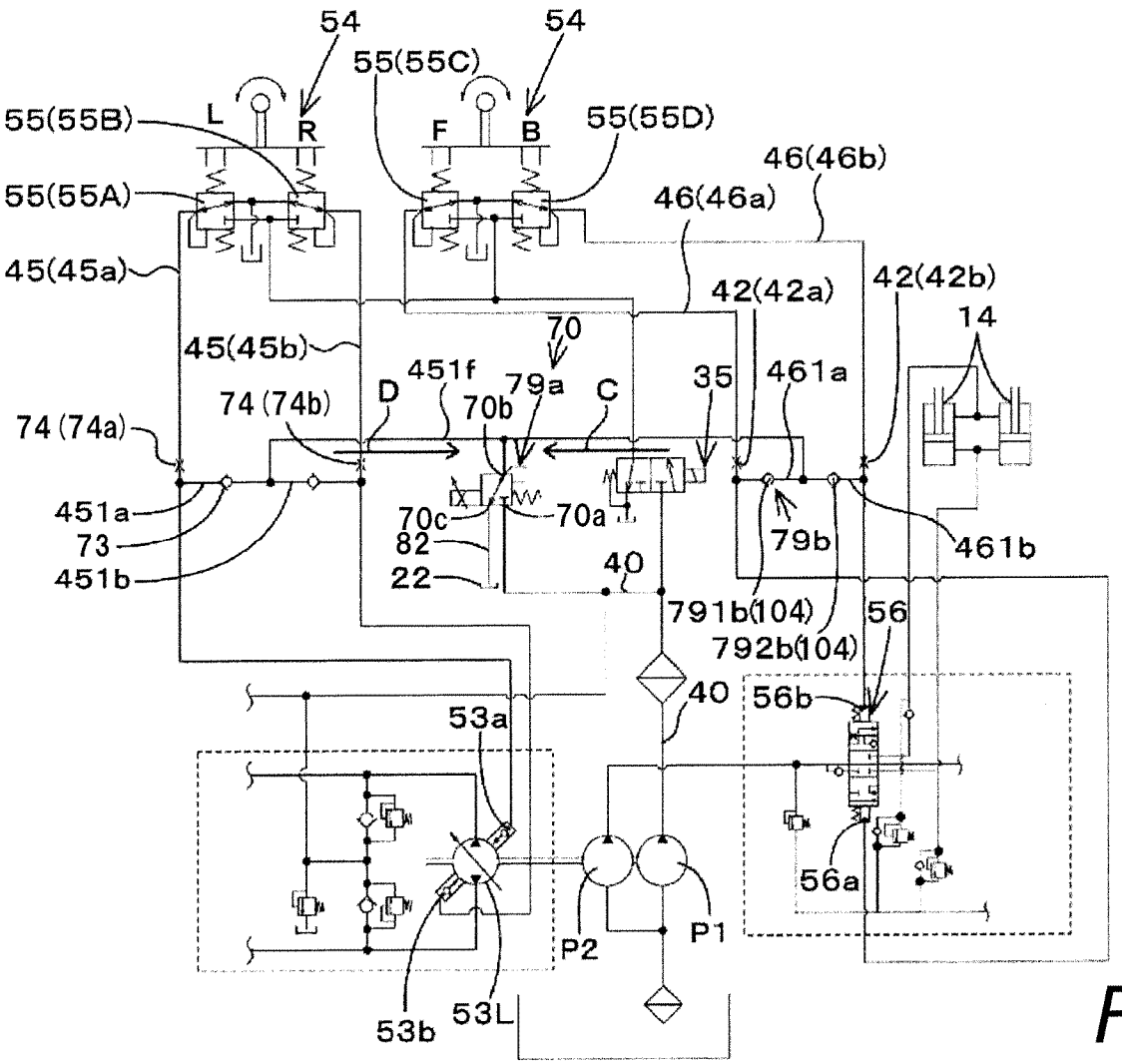
FIG. 17 is a schematic diagram of a hydraulic system according to the eighth embodiment.

FIG. 17 illustrates a hydraulic system as a modification of the reducing unit. The reducing unit in FIG. 17 is applicable to all above-described embodiments. As illustrated in FIG. 17, the reducing unit 70 includes an electromagnetic proportional valve (proportional valve) 79*a* and a check valve 79*b*. The proportional valve 79*a* includes the primary port 70*a*, the secondary port 70*b*, and the discharge port 70*c*.

The primary port 70*a* of the proportional valve 79*a* is connected with a discharging oil path 40 provided on the discharging side of the first hydraulic pump P1. The secondary port 70*b* of the proportional valve 79*a* is connected with the oil paths (fifth oil paths) connecting the plurality of hydraulic instruments. As illustrated in FIG. 17, for example, the secondary port 70*b* of the proportional valve 79*a* is connected with a second oil path 45 connected with the travel hydraulic instrument, and a fourth oil path 46 connected with the work hydraulic instrument. Thus, the secondary port 70*b* is connected with a sixth bifurcated oil path 451*f* serving as the second oil path 45 and the fourth oil path 46. The discharge port 70*c* is connected with the hydraulic oil tank 22 through an oil path (sixth oil path) 82 for discharging the hydraulic oil.

The check valve 79*b* is connected with an oil path connecting the proportional valve 79*a* and a hydraulic instrument. For example, the check valve 79*b* is provided to the second oil path 45 and the fourth oil path 46. For example, the check valve 79*b* includes a first check valve 791*b* provided to a first bifurcated oil path 461*a* and a second check valve 792*b* provided to a second bifurcated oil path 461*b*. In other words, the first check valve 791*b* and the second check valve 792*b* are the same as the above-described check valve 103. The first check valve 791*b* and the second check valve 792*b* allow the hydraulic oil to flow toward the secondary port 70*b* of the proportional valve 79*a* but prevent the hydraulic oil from flowing from the proportional valve 79*a* to a predetermined hydraulic instrument (work hydraulic instrument).

According to the modification illustrated in FIG. 17, when the primary port 70*a* of the proportional valve 79*a* is connected with an oil path (discharging oil path 40) of the first hydraulic pump P1, and the secondary port 70*b* of the proportional valve 79*a* is connected with oil paths connected with a plurality of hydraulic instruments such as the travel hydraulic instrument and the work hydraulic instrument, the pressure of the hydraulic oil in the sixth bifurcated oil path 451*f* can be reduced by the proportional valve 79*a* and the check valve 79*b* (first check valve 791*b* and second check valve 792*b*).

For example, when the pressure of the hydraulic oil flowing through the fourth oil path 46 in the work hydraulic instrument is higher than the pressure of the hydraulic oil flowing through the second oil path 45 in the travel hydraulic instrument, setting a degree of opening of the proportional valve 79*a* to be large allows the hydraulic oil in the sixth bifurcated oil path 451*f* to enter into the proportional valve 79*a* through the check valve 79*b* as indicated by arrow C before being discharged from the discharge port 70*c*. Thus, the pressure of the hydraulic oil can be reduced through the proportional valve 79*a* and the check valve 79*b* in the same manner as a relief valve.

Although the check valve 103 provided to the fourth oil path 46 serves as the check valve 79*b* included in the reducing unit 70 in the above-described embodiment, the check valve 73 provided to the second oil path 45 also serves as the check valve 79*b* included in the reducing unit 70. For example, when the pressure of the hydraulic oil flowing through the second oil path 45 in the travel hydraulic instrument is higher than the pressure of the hydraulic oil flowing through the fourth oil path 46 in the work hydraulic instrument, setting a degree of opening of proportional valve 79*a* to be large allows the hydraulic oil in the sixth bifurcated oil path 451*f* to enter into the proportional valve 79*a* through the check valve 73 as indicated by arrow D before being discharged from the discharge port 70*c*.

FIG. 17 illustrates exemplary hydraulic instruments and oil paths, and an embodiment of the present invention is not limited thereto, but the proportional valve 79*a* and the check valve 79*b* are applicable to any hydraulic instruments and oil paths. When the check valve 79*b* is provided as a reducing unit connected with a secondary port of a switching valve such as a two-position switching valve, the pressure of the hydraulic oil can be reduced through the switching valve.

The embodiments in the present disclosure are merely exemplary and not limiting examples. The scope of the present invention is defined by the claims, not by the above description, and intended to include all modifications within a gist and a scope equivalent to those of the claims.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system of a work machine, comprising:

a hydraulic pump to discharge hydraulic oil;

a drive device to generate power to actuate the hydraulic pump;

a first sensor to detect temperature of the hydraulic oil;

a first oil path which is connected to the hydraulic pump and though which the hydraulic oil is to flow from the hydraulic pump;

an operation valve connected to the first oil path;

an operation lever to control the operation valve to control pressure of the hydraulic oil in accordance with an operation of the operation lever;

a hydraulic instrument to be actuated by the hydraulic oil output from the operation valve;

a second oil path connecting the operation valve and the hydraulic instrument;

a discharge oil path through which the hydraulic oil in the second oil path is discharged;

an actuation valve provided in the discharge oil path; and an actuation valve controller to control the actuation valve to be opened and closed according to the temperature of the hydraulic oil detected by the first sensor, wherein a throttle is provided between the operation valve and a connection of the second oil path and the discharge oil path.

2. The hydraulic system according to claim 1, wherein the actuation valve is opened when the temperature of hydraulic oil detected by the first sensor is equal to or lower than a temperature threshold.

3. A hydraulic system of a work machine, comprising:

a hydraulic pump to discharge hydraulic oil;

a drive device to generate power to actuate the hydraulic pump;

a first sensor to detect temperature of the hydraulic oil;

a second sensor to measure temperature of air external to the work machine;

a first oil path which is connected to the hydraulic pump and though which the hydraulic oil is to flow from the hydraulic pump;

an operation valve connected to the first oil path;

an operation lever to control the operation valve to control pressure of the hydraulic oil in accordance with an operation of the operation lever;

a hydraulic instrument to be actuated by the hydraulic oil output from the operation valve;

a second oil path connecting the operation valve and the hydraulic instrument;

a discharge oil path through which the hydraulic oil in the second oil path is discharged;

an actuation valve provided in the discharge oil path; and an actuation valve controller to control the actuation valve to be opened and closed according to the temperature of the hydraulic oil detected by the first sensor, wherein the actuation valve is opened when the temperature of the hydraulic oil is equal to or lower than a first temperature threshold and the temperature of the air measured by the second sensor is equal to or lower than a second temperature threshold.

4. A hydraulic system of a work machine, comprising:

a hydraulic pump to discharge hydraulic oil;

a first oil path connected to the hydraulic pump;

an operation valve provided in the first oil path;

an operation lever to control the operation valve to control pressure of the hydraulic oil in accordance with an operation of the operation lever;

a hydraulic instrument to be actuated by the hydraulic oil output from the operation valve;

a second oil path connecting the operation valve and the hydraulic instrument;

an actuation valve provided in the first oil path between the operation valve and the hydraulic pump, the first oil path having a first section between the operation valve and the actuation valve;

a third oil path connecting the first section and the second oil path; and a check valve provided in the third oil path, the hydraulic oil being configured to flow from the second oil path to the first oil path via the check valve, the hydraulic oil being prevented from flowing from the first oil path to the second oil path via the check valve.

5. The hydraulic system according to claim 4, wherein a throttle is provided in the second oil path between the operation valve and a connection of the second oil path and the third oil path.

6. A hydraulic system of a work machine, comprising:

an operation lever operable in a first direction and a second direction orthogonal to the first direction;

a hydraulic pump to discharge hydraulic oil;

a first oil path connected to the hydraulic pump;

a first operation valve connected to the first oil path, the operation lever being configured to control the first operation valve to control pressure of the hydraulic oil in accordance with an operation of the operation lever in the first direction to output a first pressure of the hydraulic oil;

a second operation valve connected to the first oil path, the operation lever being configured to control the second operation valve to control pressure of the hydraulic oil in accordance with an operation of the operation lever in the second direction to output a second pressure of the hydraulic oil;

a third operation valve connected to the first oil path, the operation lever being configured to control the third operation valve to control pressure of the hydraulic oil in accordance with an operation of the operation lever in a third direction opposite to the first direction to output a third pressure of the hydraulic oil;

a fourth operation valve connected to the first oil path, the operation lever being configured to control the fourth operation valve to control pressure of the hydraulic oil in accordance with an operation of the operation lever in a fourth direction opposite to the second direction to output a fourth pressure of the hydraulic oil;

a hydraulic instrument to be actuated by the hydraulic oil output from at least one of the first operation valve, the second operation valve, the third operation valve, and the fourth operation valve, the hydraulic instrument being a travel device to travel forward, backward, rightward, and leftward, the first operation valve being configured to output the hydraulic oil for forward travel to the travel device, the third operation valve being configured to output the hydraulic oil for backward travel to the travel device, the second operation valve being configured to output the hydraulic oil for rightward travel to the travel device, and the fourth operation valve being configured to output the hydraulic oil for leftward travel to the travel device; and an oil pressure changing circuit configured:

to change pressure of the hydraulic oil acting on the hydraulic instrument from the first operation valve from the first pressure when the operation lever is operated both in the first direction and in the second direction and to change pressure of the hydraulic oil acting on the hydraulic instrument from the second operation valve from the second pressure when the operation lever is operated both in the first direction and in the second direction;

to change pressure of the hydraulic oil acting on the hydraulic instrument from the second operation valve from the second pressure when the operation lever is operated both in the third direction and in the second direction and to change pressure of the hydraulic oil acting on the hydraulic instrument from the third operation valve from the third pressure when the operation lever is operated both in the third direction and in the second direction;

to change pressure of the hydraulic oil acting on the hydraulic instrument from the first operation valve from the first pressure when the operation lever is operated both in the first direction and in the fourth direction and to change pressure of the hydraulic oil acting on the hydraulic instrument from the fourth operation valve from the fourth pressure when the operation lever is operated both in the first direction and in the fourth direction; and to change pressure of the hydraulic oil acting on the hydraulic instrument from the third operation valve from the third pressure when the operation lever is operated both in the third direction and in the fourth direction and to change pressure of the hydraulic oil acting on the hydraulic instrument from the fourth operation valve from the fourth pressure when the operation lever is operated both in the third direction and in the fourth direction, wherein the oil pressure changing circuit includes a first variable relief valve including a pressure receiving unit on which pressure output from the second operation valve acts and connected to the first operation valve, and a second variable relief valve including a pressure receiving unit on which pressure output from the fourth operation valve acts and connected to the third operation valve.

7. A hydraulic system of a work machine, comprising:

a hydraulic pump to discharge hydraulic oil;

a first oil path connected to the hydraulic pump;

a travel device to be actuated by the hydraulic oil;

a first operation device connected to the travel device, the first operation device comprising:

a first operation lever operable in a first direction and a third direction opposite to the first direction;

a first operation valve connected to the first oil path, the first operation lever being configured to control the first operation valve to control pressure of the hydraulic oil in accordance with an operation of the first operation lever in the first direction; and a third operation valve connected to the first oil path, the first operation lever being configured to control the third operation valve to control pressure of the hydraulic oil in accordance with an operation of the first operation lever in the third direction;

a second operation device connected to the travel device, the second operation device comprising:

a second operation lever operable in a fifth direction and a sixth direction opposite to the fifth direction;

a fifth operation valve connected to the first oil path, the second operation lever being configured to control the fifth operation valve to control pressure of the hydraulic oil in accordance with an operation of the second operation lever in the fifth direction; and a sixth operation valve connected to the first oil path, the second operation lever being configured to control the sixth operation valve to control pressure of the hydraulic oil in accordance with an operation of the second operation lever in the sixth direction;

a first selection valve including an output port through which one of the hydraulic oil output from the first operation valve and the hydraulic oil output from the fifth operation valve is output, the one having a higher pressure than another of the hydraulic oil output from the first operation valve and the hydraulic oil output from the fifth operation valve has;

a second selection valve including an output port through which one of the hydraulic oil output from the third operation valve and the hydraulic oil output from the sixth operation valve is output, the one having a higher pressure than another of the hydraulic oil output from the third operation valve and the hydraulic oil output from the sixth operation valve has;

a third selection valve including an output port through which one of the hydraulic oil output from the output port of the first selection valve and the hydraulic oil output from the output port of the second selection valve is output, the one having a higher pressure than another of the hydraulic oil output from the output port of the first selection valve and the hydraulic oil output from the output port of the second selection valve has;

a fourth oil path connected to the output port of the third selection valve; and a braking device connected to the fourth oil path to cancel a braking state of the travel device when pressure of the hydraulic oil is applied.

8. The hydraulic system according to claim 7, further comprising:

a fifth oil path connected to a middle part of the fourth oil path; and a switching valve connected to the fifth oil path to discharge the hydraulic oil in the fifth oil path by switching.

9. The hydraulic system according to claim 7, further comprising a first check valve provided in the fourth oil path, the hydraulic oil being configured to flow from the third selection valve to the braking device via the first check valve, the hydraulic oil being prevented from flowing from the braking device to the third selection valve via the first check valve.

10. The hydraulic system according to claim 9, further comprising a second check valve, the hydraulic oil being configured to flow from the first check valve to the switching valve via the second check valve, the hydraulic oil being prevented from flowing from the switching valve to the first check valve via the second check valve.

11. The hydraulic system according to claim 7, wherein the switching valve includes a switch to be switched between a position for discharging hydraulic oil in the fourth oil path and a position for not discharging hydraulic oil in the fourth oil path.

12. A hydraulic system of a work machine, comprising:

a drive device;

a hydraulic pump to discharge hydraulic oil;

a first oil path through which the hydraulic oil discharged from the hydraulic pump flows;

at least one operation valve connected to the first oil path;

at least one operation lever to control the at least one operation valve to control pressure of the hydraulic oil in accordance with an operation of the at least one operation lever;

at least one hydraulic instrument to be actuated by the hydraulic oil output from the at least one operation valve;

a second oil path connecting the at least one operation valve and the at least one hydraulic instrument; and a reducing oil circuit connected to the second oil path to reduce pressure of the hydraulic oil in the second oil path, wherein the at least one hydraulic instrument includes a travel hydraulic pump to be driven by power of the drive device to change a flow rate of the hydraulic oil in accordance with pressure of the hydraulic oil output from the at least one operation valve, and the reducing oil circuit reduces pressure of the hydraulic oil in the second oil path when a load of the drive device is equal to or larger than a load threshold or when a rotation speed of the drive device is equal to or smaller than a rotation speed threshold.

13. The hydraulic system according to claim 12, wherein the second oil path includes a main oil path extending from the at least one operation valve to the at least one hydraulic instrument, and a bifurcated oil path bifurcated from the main oil path and connected to the reducing oil circuit, and the main oil path is provided with a throttle to reduce a flow rate of the hydraulic oil flowing from the at least one operation valve to the bifurcated oil path.

14. The hydraulic system according to claim 12, further comprising:

a third oil path which is connected to the travel hydraulic pump and through which the hydraulic oil from the travel hydraulic pump flows; and a travel motor connected to the third oil path to control a travel speed by the hydraulic oil discharged from the travel hydraulic pump.

15. The hydraulic system according to claim 12, wherein the at least one operation lever comprises:

a travel operation lever to perform a travel operation; and a work operation lever to perform a work operation, the at least one operation valve comprises:

a travel operation valve connected to the first oil path to change pressure of the hydraulic oil in accordance with an operation of the travel operation lever; and a work operation valve connected to the first oil path to change pressure of the hydraulic oil in accordance with an operation of the work operation lever, the at least one hydraulic instrument comprises:

a travel hydraulic instrument to be actuated by the hydraulic oil output from the travel operation valve; and a work hydraulic instrument to be actuated by the hydraulic oil output from the work operation valve, the second oil path connects the travel operation valve and the travel hydraulic instrument, the hydraulic system further comprises a fourth oil path connecting the work operation valve and the work hydraulic instrument, and the reducing oil circuit is connected to the second oil path and the fourth oil path to reduce pressure of the hydraulic oil in the second oil path and the fourth oil path.

16. The hydraulic system according to claim 15, further comprising:

a travel motor to control a travel speed by the hydraulic oil; and a hydraulic actuator to be actuated by the hydraulic oil in work, wherein the travel hydraulic instrument includes the travel hydraulic pump, the work hydraulic instrument includes a control valve to control the hydraulic actuator in accordance with pressure of the hydraulic oil output from the work operation valve, and the reducing oil circuit reduces pressure of the hydraulic oil in the second oil path and the fourth oil path when the load of the drive device is equal to or larger than the load threshold.

17. A hydraulic system of a work machine, comprising:

a hydraulic pump to discharge hydraulic oil;

a hydraulic instrument to be actuated by the hydraulic oil;

a first oil path through which hydraulic oil discharged from the hydraulic pump flows;

a fifth oil path connected to the hydraulic instrument;

a sixth oil path through which the hydraulic oil is discharged;

a proportional valve including a primary port connected to the first oil path, a secondary port connected to the fifth oil path, and a discharge port connected to the sixth oil path; and a check valve provided in a section of the fifth oil path connecting the proportional valve and the hydraulic instrument, the hydraulic oil being configured to flow toward the secondary port of the proportional valve via the check valve, the hydraulic oil being prevented from flowing from the proportional valve to a hydraulic instrument.

18. The hydraulic system according to claim 17, further comprising:

an operation valve; and an operation lever to control the operation valve to control pressure of the hydraulic oil output in accordance with an operation of the operation lever, wherein the fifth oil path includes an oil path connecting the operation valve and the hydraulic instrument, and the secondary port of the proportional valve is connected to the oil path.

19. The hydraulic system according to claim 17, wherein the primary port is closed.

20. The hydraulic system according to claim 12, wherein the at least one operation lever is configured to perform a first operation and a second operation different from the first operation, the at least one operation valve includes a first operation valve connected to the first oil path to change pressure of the hydraulic oil in accordance with the first operation of the operation lever, and a second operation valve connected to the first oil path to change pressure of the hydraulic oil in accordance with the second operation of the operation lever, the at least one hydraulic instrument includes a first hydraulic instrument to be actuated by the hydraulic oil output from the first operation valve, and a second hydraulic instrument to be actuated by the hydraulic oil output from the second operation valve, the second oil path is configured to connect the first operation valve and the first hydraulic instrument, the hydraulic system further comprises a fourth oil path to connect the second operation valve and the second hydraulic instrument, and a reducing oil circuit connected to the second oil path to reduce pressure of the hydraulic oil in the second oil path.

21. The hydraulic system according to claim 7, further comprising:

a detector connected to the output port of the third selection valve to detect flow of the hydraulic oil; and a reducing oil circuit connected to the output port of the third selection valve to reduce pressure of the hydraulic oil.

22. The hydraulic system according to claim 7, further comprising:

a detector connected to the output port of the first selection valve and the output port of the second selection valve to detect flow of the hydraulic oil.

23. A hydraulic system of a work machine, comprising:
a hydraulic pump to discharge hydraulic oil;
a first sensor to detect temperature of the hydraulic oil;
a first oil path which is connected to the hydraulic pump and though which the hydraulic oil is to flow from the hydraulic pump;
an operation valve connected to the first oil path;
an operation lever to control the operation valve to control pressure of the hydraulic oil in accordance with an operation of the operation lever;
a hydraulic instrument to be actuated by the hydraulic oil output from the operation valve;
a second oil path connecting the operation valve and the hydraulic instrument;
a discharge oil path through which the hydraulic oil in the second oil path is discharged;
a throttle provided between the operation valve and a connection of the second oil path and the discharge oil path;
an actuation valve provided in the discharge oil path; and
an actuation valve controller to control the actuation valve to be opened and closed according to the temperature of the hydraulic oil detected by the first sensor.

24. A hydraulic system of a work machine, comprising:
a hydraulic pump to discharge hydraulic oil;
a first sensor to detect temperature of the hydraulic oil;
a first oil path which is connected to the hydraulic pump and though which the hydraulic oil is to flow from the hydraulic pump;
an operation valve connected to the first oil path;
an operation lever to control the operation valve to control pressure of the hydraulic oil in accordance with an operation of the operation lever;
a hydraulic instrument to be actuated by the hydraulic oil output from the operation valve;
a second oil path connecting the operation valve and the hydraulic instrument;
a discharge oil path through which the hydraulic oil in the second oil path is discharged;
an actuation valve provided in the discharge oil path;
an actuation valve controller to control the actuation valve to be opened and closed according to the temperature of the hydraulic oil detected by the first sensor; and
a second sensor to measure temperature of air external to the work machine, wherein
the actuation valve is opened when the temperature of the hydraulic oil is equal to or lower than a first temperature threshold and the temperature of the air measured by the second sensor is equal to or lower than a second temperature threshold.

25. A hydraulic system of a work machine, comprising:
a hydraulic pump to discharge hydraulic oil;
a first oil path through which the hydraulic oil discharged from the hydraulic pump flows;
at least one operation valve connected to the first oil path;
at least one operation lever to control the at least one operation valve to control pressure of the hydraulic oil in accordance with an operation of the at least one operation lever;
at least one hydraulic instrument to be actuated by the hydraulic oil output from the at least one operation valve;
a second oil path connecting the at least one operation valve and the at least one hydraulic instrument; and
a reducing oil circuit connected to the second oil path to reduce pressure of the hydraulic oil in the second oil path, wherein
the second oil path includes a main oil path extending from the at least one operation valve to the at least one hydraulic instrument, and a bifurcated oil path bifurcated from the main oil path and connected to the reducing oil circuit, and
the main oil path is provided with a throttle to reduce a flow rate of the hydraulic oil flowing from the at least one operation valve to the bifurcated oil path.

26. A hydraulic system of a work machine, comprising:
a hydraulic pump to discharge hydraulic oil;
a hydraulic instrument to be actuated by the hydraulic oil;
a fifth oil path connected to the hydraulic instrument;
a sixth oil path through which the hydraulic oil is discharged; and
a proportional valve including a primary port, a secondary port connected to the fifth oil path, and a discharge port connected to the sixth oil path, wherein
the primary port is closed.

27. The hydraulic system according to claim 26, further comprising:
an operation valve; and
an operation lever to control the operation valve to control pressure of the hydraulic oil in accordance with an operation of the operation lever, wherein
the fifth oil path includes an oil path connecting the operation valve and the hydraulic instrument, and
the secondary port of the proportional valve is connected to the oil path.

28. A hydraulic system of a work machine, comprising:
a hydraulic pump to discharge hydraulic oil;
a first oil path connected to the hydraulic pump;
a travel device to be actuated by the hydraulic oil;
a first operation device connected to the travel device, the first operation device comprising:
a first operation lever operable in a first direction and a third direction opposite to the first direction;
a first operation valve connected to the first oil path, the first operation lever being configured to control the first operation valve to control pressure of the hydraulic oil in accordance with an operation of the first operation lever in the first direction; and
a third operation valve connected to the first oil path, the first operation lever being configured to control the third operation valve to control pressure of the hydraulic oil in accordance with an operation of the first operation lever in the third direction;
a second operation device connected to the travel device, the second operation device comprising:
a second operation lever operable in a fifth direction and a sixth direction opposite to the fifth direction;
a fifth operation valve connected to the first oil path, the second operation lever being configured to control the fifth operation valve to control pressure of the hydraulic oil in accordance with an operation of the second operation lever in the fifth direction; and
a sixth operation valve connected to the first oil path, the second operation lever being configured to control the sixth operation valve to control pressure of the hydraulic oil in accordance with an operation of the second operation lever in the sixth direction;
a first selection valve including an output port through which one of the hydraulic oil output from the first operation valve and the hydraulic oil output from the fifth operation valve is output, the one having a higher pressure than another of the hydraulic oil output from the first operation valve and the hydraulic oil output from the fifth operation valve has;

a second selection valve including an output port through which one of the hydraulic oil output from the third operation valve and the hydraulic oil output from the sixth operation valve is output, the one having a higher pressure than another of the hydraulic oil output from the third operation valve and the hydraulic oil output from the sixth operation valve has;

a third selection valve including an output port through which one of the hydraulic oil output from the output port of the first selection valve and the hydraulic oil output from the output port of the second selection valve is output, the one having a higher pressure than another of the hydraulic oil output from the output port of the first selection valve and the hydraulic oil output from the output port of the second selection valve has;

a detector connected to the output port of the third selection valve to detect flow of the hydraulic oil; and a reducing oil circuit connected to the output port of the third selection valve to reduce pressure of the hydraulic oil.

29. A hydraulic system of a work machine, comprising:

a hydraulic pump to discharge hydraulic oil;

a first oil path connected to the hydraulic pump;

a travel device to be actuated by the hydraulic oil;

a first operation device connected to the travel device, the first operation device comprising:

a first operation lever operable in a first direction and a third direction opposite to the first direction;

a first operation valve connected to the first oil path, the first operation lever being configured to control the first operation valve to control pressure of the hydraulic oil in accordance with an operation of the first operation lever in the first direction; and a third operation valve connected to the first oil path, the first operation lever being configured to control the third operation valve to control pressure of the hydraulic oil in accordance with an operation of the first operation lever in the third direction;

a second operation device connected to the travel device, the second operation device comprising:

a second operation lever operable in a fifth direction and a sixth direction opposite to the fifth direction;

a fifth operation valve connected to the first oil path, the second operation lever being configured to control the fifth operation valve to control pressure of the hydraulic oil in accordance with an operation of the second operation lever in the fifth direction; and a sixth operation valve connected to the first oil path, the second operation lever being configured to control the sixth operation valve to control pressure of the hydraulic oil in accordance with an operation of the second operation lever in the sixth direction;

a first selection valve including an output port through which one of the hydraulic oil output from the first operation valve and the hydraulic oil output from the fifth operation valve is output, the one having a higher pressure than another of the hydraulic oil output from the first operation valve and the hydraulic oil output from the fifth operation valve has;

a second selection valve including an output port through which one of the hydraulic oil output from the third operation valve and the hydraulic oil output from the sixth operation valve is output, the one having a higher pressure than another of the hydraulic oil output from the third operation valve and the hydraulic oil output from the sixth operation valve has; and a detector connected to the output port of the first selection valve and the output port of the second selection valve to detect flow of the hydraulic oil.

30. The hydraulic system according to claim 3, wherein the actuation valve is opened when the temperature of hydraulic oil detected by the first sensor is equal to or lower than a temperature threshold.

* * * * *